US007321337B2

(12) United States Patent
Ikeda et al.

(10) Patent No.: US 7,321,337 B2
(45) Date of Patent: Jan. 22, 2008

(54) ELECTRONIC DEVICE HAVING METAL PACKAGE UNIT HAVING BUILT-IN ANTENNA UNIT

(75) Inventors: Ienobu Ikeda, Tokyo (JP); Takashi Ihara, Tokyo (JP); Minoru Kobayashi, Tokyo (JP); Yasuo Maekawa, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 0 days.

(21) Appl. No.: 10/536,763

(22) PCT Filed: May 17, 2004

(86) PCT No.: PCT/JP2004/006999

§ 371 (c)(1),
(2), (4) Date: May 26, 2005

(87) PCT Pub. No.: WO2004/102738

PCT Pub. Date: Nov. 25, 2004

(65) Prior Publication Data

US 2006/0109188 A1 May 25, 2006

(30) Foreign Application Priority Data

May 15, 2003 (JP) ..... 2003-136757
May 19, 2003 (JP) ..... 2003-140456

(51) Int. Cl.
*H01Q 1/12* (2006.01)
*H01Q 7/08* (2006.01)

(52) U.S. Cl. ..... 343/718; 343/702; 343/788; 343/985; 343/866

(58) Field of Classification Search ..... 343/718, 343/702; 368/10, 278, 47, 281, 276
See application file for complete search history.

(56) References Cited

U.S. PATENT DOCUMENTS 6,411,569 B1 6/2002 Megner et al.
6,825,751 B1 * 11/2004 Kita et al. ..... 340/5.61
6,853,605 B2 * 2/2005 Fujisawa et al. ..... 368/10
6,934,222 B2 * 8/2005 Fujimori ..... 368/204

(Continued)

FOREIGN PATENT DOCUMENTS

DE 202 11 848 12/2002

(Continued)

*Primary Examiner*—Douglas W. Owens
*Assistant Examiner*—Chuc Tran
(74) *Attorney, Agent, or Firm*—Greer, Burns & Crain, Ltd.

(57) ABSTRACT

An electronic device an antenna, an information processing apparatus for the purpose of processing information captured by the antenna, and a metal exterior parts capable of housing therewithin the antenna and the information processing apparatus, wherein the metal exterior parts is configured so that the antenna can receive magnetic flux from outside the metal exterior parts that has passed through the metal exterior parts and can resonate, and wherein at least a part of the metal exterior parts has an electrical resistance value that is different from another part of the metal exterior parts.

67 Claims, 34 Drawing Sheets

U.S. PATENT DOCUMENTS

| | | | | |
|---|---|---|---|---|
| 6,992,952 | B2 * | 1/2006 | Endo et al. | 368/10 |
| 7,027,359 | B2 * | 4/2006 | Apotheloz et al. | 368/10 |
| 7,170,462 | B2 * | 1/2007 | Ihara et al. | 343/788 |
| 7,190,638 | B2 * | 3/2007 | Oguchi | 368/47 |
| 2002/0071346 | A1 * | 6/2002 | Paratte et al. | 368/10 |

FOREIGN PATENT DOCUMENTS

| | | |
|---|---|---|
| EP | 1 065 791 | 1/2001 |
| EP | 1 308 883 | 5/2003 |
| JP | 2000286761 | * 11/1999 |
| JP | 2001-208875 | 8/2001 |
| JP | 2001-264463 | 9/2001 |
| JP | 2002-118490 | 4/2002 |
| JP | 2002-293644 | 10/2002 |
| JP | 2003-050983 | 2/2003 |
| JP | 2003-215271 | 7/2003 |
| WO | WO 03/003130 | 1/2003 |

* cited by examiner (A)

PART OF THE SCREW THREADS ARE CUT (B)

(A)

(B)

(A)

(B)

| | BEFORE CHANGE | AFTER CHANGE | NO 10° CONTACT POINT |
|---|---|---|---|
| RESONANT FREQUENCY (KHz) | 41.4 | 41.6 | 40 |
| GAIN (dB) | -48.69 | -48.16 | -45.9 |
| BANDWIDTH (Hz) | 7845 | 7412 | 5832 |
| Q | 5.24 | 5.47 | 6.82 |

(A)

(B)

| | BEFORE CHANGE | AFTER CHANGE |
|---|---|---|
| RESONANT FREQUENCY (KHz) | 41.9 | 41.7 |
| GAIN (dB) | -49.86 | -49.47 |
| BANDWIDTH (Hz) | 8305 | 8253 |
| Q | 5.00 | 5.02 |

| | BEFORE CHANGE | AFTER CHANGE |
|---|---|---|
| RESONANT FREQUENCY (KHz) | 41.9 | 41.3 |
| GAIN (dB) | -49.86 | -49.3 |
| BANDWIDTH (Hz) | 8305 | 7959 |
| Q | 5.00 | 5.18 |

(A)

(B)

| | BEFORE CHANGE | AFTER CHANGE |
|---|---|---|
| RESONANT FREQUENCY (KHz) | 41.9 | 41.8 |
| GAIN (dB) | -49.86 | -49.3 |
| BANDWIDTH (Hz) | 8305 | 7806 |
| Q | 5.00 | 5.25 |

Fig. 29

| | MASS PRODUCTION | PRE-PROPRODUCTION | | | | PRE-PRODUCTION |
|---|---|---|---|---|---|---|
| | SAMPLE A | SAMPLE B | SAMPLE C | SAMPLE D Ti | SAMPLE E SS | SAMPLE F |
| RESONANT FREQUENCY (KHz) | 40.9 | 41.2 | 41.3 | 41.8 | 41.0 | 41 |
| GAIN (dB) | -47.7 | -48.77 | -47.4 | -51.3 | -49.54 | -44.5 |
| BANDWIDTH (Hz) | 7130 | 7609 | 6195 | 8239 | 7351 | 4704 |
| Q | 5.69 | 5.35 | 6.66 | 5.07 | 5.56 | 8.67 |

Fig. 30

| | SAMPLE D Ti | | SAMPLE E SS | |
|---|---|---|---|---|
| | BEFORE CHANGE | AFTER CHANGE | BEFORE CHANGE | AFTER CHANGE |
| RESONANT FREQUENCY (KHz.) | 41.8 | 41.6 | 41.0 | 40.4 |
| GAIN (dB) | -51.3 | -48.7 | -49.54 | -46.8 |
| BANDWIDTH (Hz) | 8239 | 6877 | 7351 | 6434 |
| Q | 5.07 | 5.99 | 5.56 | 6.27 |

Notes: bolting torque is fixed 3 N·m.

Fig. 31

| | no cut | | cut part | | cut part | |
|---|---|---|---|---|---|---|
| RESONANT FREQUENCY (KHz) | 41 | 61.6 | 40 | 59 | 41.3 | 61.2 |
| ref(dB) | -48.8 | -48.8 | -45.96 | -46.3 | -48.1 | -48.2 |
| ΔF | 7928 | 13798 | 5816 | 11090 | 7309 | 13213 |
| Q | 5.14 | 4.42 | 6.86 | 5.3 | 5.55 | 4.6 |

(A)

(B)

(C)

| ANGLE | LENGTH (B) | RATIO (B/A) |
|---|---|---|
| 10 | 2.614617 | 0.217885 |
| 30 | 7.76441 | 0.647034 |
| 50 | 12.6783 | 1.056525 |
| 120 | 25.98043 | 2.165036 |
| 180 | 30 | 2.5 |

ELECTRONIC DEVICE HAVING METAL PACKAGE UNIT HAVING BUILT-IN ANTENNA UNIT

BACKGROUND OF THE INVENTION

1. Field of the Invention

This application is a 371 of PCT/JP 04/06999 May 5, 2004

The present invention relates to an electronic device having a function that receives a radio signal that sends prescribed information, including time information and displays or gives notification of as it displays the prescribed information, and that corrects the time information to accurate time information, and more particularly the present invention relates to an electronic device having improved radio signal receiving performance in the case in which a metal exterior part such as a metal case is used.

Additionally, more specifically the present invention relates to an electronic device configured so that performance of an antenna in receiving a radio signal does not worsen, even in the case in which a resonant antenna is in the vicinity of a metal object or is placed within a metal exterior part, and more specifically it relates to a radio controlled time piece in which an antenna is disposed within a metal exterior part.

2. Background Art

In recent years, many commercially made electronic devices, such as watches, mobile telephones, and radio communication equipment and the like, receive a standard radio signal having a long wave and including a time code therein, and have a radio-signal correction function which, during operation, automatically adjusts the time of a time-keeping circuit in the electronic device to the time of the standard time.

In the past, it is well-known that formats of displaying the time in a watch, which is a specific example of such an electronic device, include the analog method, in which the time is indicated by two or three hands, the digital method, in which an electro-optical device such as LCD or LED is used to indicate the time, and a combination method, which is the combination of the above-noted two methods.

Of these methods, among the analog time piece, it is also well-known that users can select it depending upon the likes of the user, for example, that based upon whether or not the time piece has a second hand or a calendar, and further can select it based upon whether or not the time piece has such secondary time-keeping functions as a chronograph function, an alarm function, and an age of the moon indicating function or the like.

In addition, while the accuracy of the electronic time pieces in the past was almost always determined by the accuracy of a circuit block such as the quartz oscillator within the movement, with the establishment in recent years of transmitting facilities in various countries for standard time radio signals, radio controlled time piece that enable automatic time correction by receiving these standard time signals have come into use.

With regard these radio controlled time pieces, there have been many patent applications in the past (for example, there is the Japanese Patent Examined Patent publication 11-304973 and the Japanese Unexamined Patent Publication No. 2001-33571).

In general, a radio controlled time piece automatically corrects for errors in the time kept by an internal counter in the time piece itself by receiving a standard time radio signal, as long as the time piece is in an environment in which it is possible to receive a radio signal, it is possible to bring the indication error of the watch hands extremely close to zero. The frequency and data format of the standard time radio signal is established by the transmitting facilities, and at present, in addition to Japan, there are transmissions in Germany and the US, for example, and radio controlled time pieces are widely used in those countries. The radio signal used in current radio controlled time pieces is a long-wave signal, because of the ability to cover a broad area with minimal transmitting facilities. Furthermore, to avoid interference at the borders between standard time radio signals in Japan, the two stations currently transmitting in Japan transmit on different frequencies, 40 kHz and 60 kHz.

Problems encountered in the past are described below, taking the example of a time piece having a radio-signal correction function (hereinafter called radio controlled time piece), which is a typical electronic device.

Specifically, a known radio controlled time piece receives a standard radio signal as noted above, this being a standard radio signal (carrier wave) that includes time information, and extracts time information from the radio signal, so as to obtain the accurate time. The radio signal including the time information differs in frequency depending upon the country and, for example as noted above in Japan, under the administration of the Ministry of General Affairs and Ministry of Posts, is transmitted as standard radio signals at 40 kHz and 60 kHz.

FIG. 20 is a block diagram showing the general functioning of a specific example of such a radio controlled time piece. This radio controlled time piece is formed by an antenna 1, a radio-controlled watch receiver 2, a CPU 3, a display drive section 4, and an input device 5 and the like.

In addition, although not shown in the drawing, the time piece includes hour, minute, and second hands, or a display section using a liquid-wind shield or the like.

In this radio controlled time piece, a radio signal including time information is first received by the antenna 1.

The receiver 2 of a radio controlled time piece amplifies and detects the radio signal received by the antenna 1, and extracts and outputs time information from the radio signal. The CPU 3 outputs the current time data, based on time information output from the receiver 2 of the radio controlled time piece. The display drive section 4, based on the current time data output from the CPU 3, causes the display section to indicate the current time. The input device 5 is used, for example, in inputting operation information such as resetting and the like, to the CPU 3.

The time information (time code) included in the radio signal is a pulse signal having a 60-second period and, although it varies depending on the country, in the case of Japan, it has one pulse riding thereon, each having either one of a width of 200, 500, or 800 ms each second. A combination of these pulses enables the acquisition of the time in 60 seconds. The CPU 3, by reading from the received pulse signal the pulse width of the pulse each 1 second, obtains the time information (current time). The CPU, using the obtained time information, corrects the time indicated on the display section via the display drive section 4. The radio controlled time piece, therefore, based on the received time information, corrects the indicated time each prescribed interval of time, thereby enabling an accurate display of time at all times.

A wristwatch, in which an antenna, a radio-controlled watch receiver, a CPU, a display drive section, and a display section are housed within a case, which is an antenna enclosure, has already been provided. In order for the antenna to receive radio signals, the material used for the case is usually an electrically non-conductive material, such as synthetic resin or ceramic. That is, if the antenna is housed within a case made of an electrically conductive material such as a metal, magnetic flux generated in the vicinity of the antenna is absorbed by the electrically conductive material, and the resonance phenomenon is hindered, resulting in a significant worsening of the receiving performance of the antenna.

FIG. 35 shows the general configuration of another specific example of an analog type radio controlled time piece.

Specifically, in FIG. 35, 101 denotes an antenna that receives a radio signal, 102 is a watch movement that drives hands, 103 is an outer case that houses the watch movement 102 and the antenna 101, 104 is a caseback, 105 is a watch dial having scales indicating the time, and 106 is a glass.

In FIG. 35, the antenna 101 is formed by an antenna core 101*a* having a high magnetic permeability, such as ferrite or an amorphous alloy, and a coil part 101*b* wound around the antenna core 101*a*, and is housed together with the movement 102 inside a closed space 107 formed by the outer case 103, the caseback 104, and the watch dial 105.

In this time piece, when a radio signal 109 that arrives by passing through the outer case 103 and passes through the antenna core 101*a*, a current is generated in the antenna coil part 101*b*. A circuit block (not illustrated), which is a constituent part of the watch movement 102, is electrically coupled to the two ends of the antenna coil part 101*b*, and the current generated in the antenna coil part 101*b* is sent to a circuit via this coupling part. The current sent to the circuit resonates at a frequency that is the same as a pre-established as the standard time radio signal and is filtered by a quartz resonator, the time information only being extracted therefrom by a decoding circuit (not illustrated).

In this case, the watch movement 102 has in its circuitry system a time-keeping counter for the time, separate from the above-noted time information. The watch movement 102 compares the time in accordance with the time-keeping counter and the filtered time information and, in the case in which there is a mutual difference therebetween, outputs a hand-correction instruction to a motor block (not illustrated), a motor being moved so that the hands are corrected to the time information from the standard time radio signal. By doing this, at the point in time at which the standard time radio signal is received, the time indicated by the time piece is corrected to the proper time.

In FIG. 35, however, the antenna 101 and the watch movement 102 are housed in the closed space 107 surrounded by the outer case 103, the caseback 104, and the watch dial 105, and the antenna 101 must receive the radio signal 109 from within this closed space 107.

For this reason, in FIG. 35 the outer case 103 and the rear case 104 are formed of a substance that has a high eddy current loss, such as typified by a high polymer resin. By doing this, the radio signal 109 is able to reach the antenna 101 housed within the closed space 107 without being attenuated by the outer case 103 and the caseback 104.

However, in the case in which the outer case 103 is formed of a high polymer resin, there is a significant loss of rigidity in comparison with the metals such as stainless steel and titanium used in usual watches. For this reason, in order to prevent breakage of the watch by dropping in normal use, it is necessary to make the material thickness of the outer case 103 and the caseback 104 greater than the case in which these are formed from metal, resulting in the problem of the watch itself becoming large.

A past example of an improvement on the above is shown in FIG. 36. FIG. 36 shows a plan view of an improved example of the past, in which elements that are the same as in FIG. 35 are assigned the same reference numerals and are not described herein. As shown in FIG. 36, there is a commercial production having a structure in which the outer case 103 and the caseback 104 are formed of metal, and an antenna case 110 made of a high polymer resin is fixed to a part thereof that is not superposed in overlapped condition in a planar manner with the metal outer case 103 and caseback 104, the antenna 101 sealed therewithin being coupled to the watch movement 102. In the case of this product, because the antenna 101 is disposed on the outside of the closed space 107 formed by the outer case 103, the caseback 104, and the watch dial 105, a radio signal 109 incident to the antenna 101 tends not to be affected by metal parts such as the outer case 103, thereby making it possible to receive the radio signal 109.

In this case, however, the shape of the finished time piece is particular special, and there is the problem that this seriously restricts the design of the finished time piece.

Additionally, because the mass feeling of the outer case 103 and the antenna case 110, which is made of high polymer resin, into which the antenna is sealed become large, this is difficult to accommodate with the design, and there is the problem that the design inevitably becomes one that is difficult for users to accept.

Additionally, in the case in which the outer case 103 and the caseback 104 are made of high polymer resin, there is the drawback of a worsened mass feeling in the texture in comparison with metal. Although it is possible to achieve a metallic gloss by performing surface treatment of the high polymer resin, there is still an undeniable deterioration in terms of gloss and mass feeling of the texture when compared with metal.

Although, in response to the above, there is a practically usable product in which, as shown in FIG. 35, only the part of a side of the watch dial 105 that is directly visible to the user, that is, the bezel 111, is made of metal, the outer case 103 and the caseback 104 on the side surface thereof being formed of high polymer resin, compared with a usual time piece with metal exterior parts, there is an increase in the overall thickness of the finished time piece, and a deterioration in the mass feeling of texture.

In the case of high polymer resin, plastic deformation tends to occur, for example, because of tightening the caseback 104, and there is a problem of water tightness a the joining part between the caseback 104 and the outer case 103, and there is the problem that it is not possible to include in a product group such time pieces as a diver's watch with high waterproofness.

Although, in response to the above, a practical product exists in which the case and caseback are formed of a material other than high polymer resin such as non-metallic material, for example ceramic, sintering is required to maintain the rigidity of ceramic and there is the problem of either not being able to achieve accurate processing after sintering or not being able to polish a complex shape, thereby imposing a serious restriction on design of the exterior parts. Additionally, because of the brittleness of ceramic, there is the problem of cracking and chipping caused by impact.

To avoid such antenna receiving problems, the use of a case made of synthetic resin not only leads to a loss of damage resistance and chemical resistance, but also to a loss of the attractive appearance and feeling of high quality that are required for a time piece that is an accessory. For this reason, a radio controlled time piece having a metal case has been proposed.

FIG. 21 is a cross-sectional view showing an example of the construction of a radio controlled time piece using metal in part of the case. The case 10 of this wristwatch is generally formed by a body 11, a caseback 12, and a wind shield 13. A movement 14 is disposed within the body, which is linked to a band (not illustrated), by a known means. A watch dial 15 and hands 16 are also disposed above the movement 14 by a known means. A bar antenna 17, which is a magnetic long-wave antenna, is disposed below the movement 14 so that it is positioned above the caseback 12. This bar antenna 17 is formed by a magnetic core member 18 and a coil 20 wound around the magnetic core member 18, and is fixed to the upper surface of a holding member made of synthetic resin.

The movement 14 has the above-described radio controlled watch receiving means, a CPU, and a display drive section, and is electrically connected to the bar antenna 17 by a conductor 21. Therefore, based on the standard radio signal received by the bar antenna 17, the CPU of the movement 14 causes a gear mechanism (not illustrated) in the display drive section to move, so as to drive the positions of the hands 16 of the display section so as to constantly correct them. In this description, the up and down directions are taken to indicate the up and down directions in FIG. 21.

The body 11 is made of a non-hollow, that is, solid, electrically conductive material, such as solid stainless steel. A wind shield 13 made of glass, which is an electrically non-conductive material, is fixed to the uppermost part of the body 11 by a known means such as an adhesive or the like. The watch dial 15 is made of synthetic resin or ceramic, which are electrically non-conductive materials. The caseback 12 is formed by an annular peripheral frame 22, made of stainless steel and fixed to the body 11, and an a glass 23 fixed to the inside of the peripheral frame 22. In this manner, although electrically non-conductive materials are visible at the upper and lower surfaces of the body of this wristwatch, because the side surface part of the case is made of metal, there is the advantage of not sacrificing the attractive appearance and high-quality feel of the time piece as an accessory (refer to, for example, Japanese Unexamined Patent Publication No. 2001-33571).

Specifically, as adopted in Japanese Unexamined Patent Publication No. 2001-33571, in the case in which the caseback is made of an non-metallic material such as typified by high polymer resin, glass, or ceramic, although there is the above-noted advantage, there are many restrictions in selecting the material, difficulty in manufacturing, and many problems in achieving a pleasing appearance as a finished time piece, making it desirable to form the caseback from metal.

For these reasons, there is a great restriction to the material of the exterior parts when developing a radio-controlled time piece in the past, and that meant that it was extremely difficult to make the finished time piece minimized.

In the subject radio controlled time piece, it is thought that the receiving performance is determined by the antenna characteristics and the receiving circuit characteristics.

That is, in the general technical knowledge of the past, the lower limit of the input signal of the receiving circuit or receiving IC was in fact approximately 1 μV in signal amplitude, and in order to achieve practical receiving performance it is necessary to obtain an output signal, the signal amplitude of which being approximately 1 μV with a an electrical field strength (radio signal strength) of 40 to 50 dBμV/m, as a signal receiving antenna.

For this reason, in the case in which there is a size restriction, a resonant type antenna, which can achieve a large signal output, was generally used.

Because the radio signal has a long wavelength a bar antenna with conductive wire being wound around a magnetic core is generally used as this type of antenna.

In a receiving antenna of this type, because the output of the receiving antenna is basically proportional to the size of the receiving antenna, in order to achieve practically usable receiving performance, it is not possible for the antenna to be excessively small, leading to the problem of receiving performance and placement in the case of a small time piece such as a wristwatch.

Additionally, the output of the receiving antenna drops dramatically when it is housed in a metal exterior parts.

For this reason, in a wristwatch, in order to use a radio signal, it is necessary to have a parts configuration or design completely different from the configuration of time piece parts in the past, and additionally necessary to have a consideration be such that it does not hinder receiving performance.

Light weight, thinness, ease of portability, degree of freedom in design, mass-feeling of texture (feeling of high quality) are important issues in a wristwatch, and it is desirable to have a built-in antenna and a metal exterior parts.

In the case of a radio controlled time piece of the past, as described above, the main methods were to mount the antenna on the outside enclosure or to build in the antenna.

In the case in which the material of the caseback and sides is metal, the receiving antenna is generally mounted on the outside.

In this case, because the case of the receiving antenna is made of a non-metal such as plastic in order not to reduce the receiving performance, it is in the form of a large protrusion, thereby resulting in a great loss of compactness, thinness, and ease of portability, as well degree of freedom in design.

In the case in which the receiving antenna is built in, although ceramic or plastic is used as the material for the exterior parts (caseback and sides) of the time piece in order not to reduce the receiving performance, the low strength of this material causes the thickness of the watch to increase, thereby sacrificing storability and ease of portability, and imposing a great restriction in terms of design.

Additionally, the result is a wristwatch having little mass-feeling of external texture.

For this reason, as seen for example in Japanese Unexamined Patent Publication No. 2-126408, there is the case in which a metal antenna is disposed within the leather band of the watch.

Further, as disclosed in the Japanese Unexamined Patent Publication No. 5-81787, there is a time piece in which an antenna with a coil wound around a core is disposed between the watch dial and the wind shield, not only removing it from the metal case itself, which interferes with radio signals, but also providing a unique design and, in the international publication WO 95/27928, there is disclosure of a wristwatch having a configuration in which an antenna is mounted to a side part of the watch case.

Additionally, as disclosed in European patent laid open 0382130, there is a time piece in which an antenna is disposed in, for example, an annular shape, on the upper surface of the case.

However, in the configuration of the past in which the antenna is disposed in the band, because the antenna is built into the band, it is necessary to make electrical connection with the electronic device itself, and it is not possible to impart sufficient flexibility to the joining part between the two.

Additionally, because it is not possible to use a metallic band that would interfere with radio signals, it is necessary to use a special watch band, this imposing a restriction on material and design.

Additionally, in a time piece configured with the antenna is disposed on the upper surface or on a side surface thereof, because the antenna is distanced from the metallic part of the time piece itself, there is the problem of an increase in the thickness or size of the overall time piece and the imposition of a design restriction.

Additionally, in the watch in European patent laid open 0382130, in which the antenna is disposed in the shape of a ring on the upper surface of the case, there is the problem that, if metal is present within the ring part, because reception cannot be performed, making it essentially necessary to provide an antenna that is separate from the time piece.

Additionally, although in the Japanese Unexamined Patent Publication No. 11-064547 there is disclosure of a wristwatch in which a coil is disposed in a sunken part provided in a peripheral part of a circuit board and also a core is disposed in a curved shape along the circumferential direction of the printed circuit board, this results in the problems of not only complication of the manufacturing process, but also difficult assembly in the manufacturing process.

In the Japanese Unexamined Patent Publication No. 2001-33571 or the Japanese Unexamined Patent Publication No. 2001-30524 and the like, there is indicated a wristwatch with a configuration in which the wind shield and caseback parts of a wristwatch is made of a non-metallic material such as glass or ceramic, and in which an intermediate portion thereof is made of a metal material such as in the past, so that sufficient radio signals can reach the antenna.

The Japanese Unexamined Patent Publication No. 2001-208875 discloses technology regarding an identification tag for a wristwatch, the basic technical constitution of the identification system disclosed being one in which, when boarding a ski lift or the like, an identification tag is provided within the wristwatch held by a user, and in which information is exchanged with an identifying means provided at the lift boarding gate, so as to determine whether or not the user is an authorized passenger.

However, the basic technical concept of the technical constitution in this patent publication is one of a strong, high-frequency radio signal being transmitted from the identifying means, the wristwatch having the identification tag coming into proximity thereto so that an IC circuit within the wristwatch is activated, with identification tag information being read by the identifying means.

That is, in the above-noted publication the configuration is one in which, when an antenna provided within the time piece receives the high-frequency radio signal, resonance occurs in the IC circuit within the time piece, resulting in reception of electromotive force by the IC circuit and activation thereof, and reading of the identification tag information within the time piece, with radio notification being made to the identifying means.

In this patent publication, therefore, although there is teaching of conversion of the above-noted information by operation of the antenna provided within even a watch having a metal exterior parts, the clear difference in technical concept relative to this application is the provision of an identifying means transmitting a high-power frequency radio signal and the need for the time piece having an identification tag to come into the vicinity of the identifying means, the antenna provided within the time piece being based on a bar antenna so that sufficient reception is possible of the high-frequency radio signal transmitted from the identifying means, and because of the need to make this, within the watch, as thin and as large as possible, there is the need to use a square antenna of the thin, flat type, this clearly differing from the present application, which sets forth a specific relationship between the antenna part and the metallic exterior parts.

Additionally, in the Japanese Unexamined Utility Model Publication No. 57-131042, there is language with regard to a wristwatch in which an antenna is provided that uses an annular magnetic bar that is a C-shaped ferromagnetic body surrounding a conductor part. However, this known example is with regard to an antenna for a wristwatch having a radio, and the antenna is merely disposed on the outside of the wristwatch, making it clear that it not provided inside a metal exterior parts.

Additionally, although in the Japanese Unexamined Patent Publication No. 6-215942, there is language to the effect of an core of an inductor being a separate member, this is directed at a chip inductor, and not only does this clearly differ in technical field from the antenna of a wristwatch in the present invention, but also there is a substantial difference in terms of purpose and technical constitution.

In the Japanese Unexamined Patent Publication No. 11-74138, although there is language regarding a transformer in which a dust core is a combination of a U-shaped member and an I-shaped member, with a secondary coil wound around the U-shaped member, this is directed at obtaining a high-voltage transformer, and not only does this clearly differ in technical field from the antenna of a wristwatch in the present invention, but also there is a substantial difference in terms of purpose and technical constitution.

In the same manner, although in the Japanese Unexamined Utility Model Publication No. 61-203516, there is disclosed a structure in which the abutting surface of a core is caused to be inclined from the perpendicular magnetic path direction, this is directed at obtaining a inductance element, and not only does this clearly differ in technical field from the antenna of a wristwatch in the present invention, but also there is a substantial difference in terms of purpose and technical constitution.

In the Japanese Unexamined Patent Publication No. 2002-184637, there is found language regarding making the gap of the coil core tapered or changing the surface area, this known example being with regard to a high-voltage transformer, and not only does this clearly differ in technical field from the antenna of a wristwatch in the present invention, but also there is a substantial difference in terms of purpose and technical constitution.

Additionally, although in the above-noted known references, a language is found regarding a configuration in which making the core of the inductor a separate member, this is with regard to a high-voltage transformer or chip inductor, and not only does this clearly differ in technical field from the antenna of a wristwatch in the present invention, but also there is a substantial difference in terms of purpose and technical constitution.

That is, the above-noted examples in the past are based on the sharp decrease in the output of an antenna when housed in a metal exterior parts, the object thereof being the decrease in output being reduced by making the material of the caseback non-metallic, and to use the metal side that has a high mass-feeling of texture.

However, in the above-noted examples of the past, because glass or ceramic is used, there is the problem of the watch thickness increasing.

In the past, therefore, because a large, high-sensitivity antenna structure should be used for a radio controlled time piece or the radio controlled time piece can be possible to use only in a region in which the radio signal field strength was large, its convenience has been lost, and thus there was an inevitable increase in the manufacturing cost of the antenna structure, including the design of the physical antenna.

Furthermore, in a wristwatch having this configuration, even if it is possible to have a radio signal reach the antenna, although the caseback is plated with a thin metallic plating so that the user is given the impression that a metal material has been used, there is no sense of weight or mass-feeling of texture in the outer appearance, and the problem of sacrificing the image of the time piece as being of high quality.

Additionally, because the antenna is built into the metal side, the output of the antenna decreases, and the receiving performance decreases.

For this reason, in the past a radio controlled time piece with a totally metal exterior parts having a feeling of high quality was difficult to achieve.

In order to solve these problems with the prior art, the inventors, in Japanese Patent Application 2001-297095, have already identified the problem that, when an antenna is disposed in a time piece enclosure having metal sides or a metal caseback, the Q value decreases, resulting in a decrease in the output from the antenna structure and a prominent decrease in receiving performance, and to solve this problem proposed a technical constitution in which the antenna is given a special structure, so that the decrease in the Q value of the antenna structure is minimized as much as possible, thereby preventing a decrease in the receiving performance of the antenna.

However, in the method of imparting a specific structure to the antenna, because it was learned that there is a limit to the improvement in the receiving performance of the antenna structure, as a result of further active investigation, it was learned that by specifying the structure or characteristics of a metal exterior parts that includes the antenna structure, there is a further improvement of the above-noted problem.

Additionally, as a result of active investigation, verification was made that, with regard to the idea in the past that, in the case in which a metal object having electrical conductivity comes into the vicinity of or into contact with the antenna part for receiving radio signals, the radio signal is absorbed by the metal object, and the radio signal does not reach the antenna part, so that there is a decrease in the resonant output of the antenna part and, for example, there is a decrease in the Q value, the understanding of the problem in the past was in fact mistaken, and that even in the case in which a metal object having electrical conductivity comes into the vicinity of or into contact with the antenna part, a radio signal actually reaches the antenna part, and in the non-resonant case the flow of magnetic flux due to an external radio wave attempting to enter to within the time piece, although somewhat attenuated (approximately 3 dB, for example), the signal substantially reaches the antenna without hindrance.

It was clearly identified that the problem when the antenna part is in resonance is that the magnetic force lines (magnetic flux) emanating from the magnetic core of the antenna part are pulled into the metal object, wherein they cause eddy currents that attenuate the magnetic energy, resulting in the problem of a reduction in the output from the antenna part, and prevention of normal reception.

That is, in the radio controlled time piece of the past as noted in FIG. 21, although there is no great problem radio signal receiving performance when using it portably, because a glass 23 is fixed to the peripheral frame 22 of the caseback 12, if the wristwatch is dropped, for example, so as to impart an impact thereto, there is the problem that the glass 23 breaks. Additionally, because the caseback 12 is in intimate contact with a wrist, over long periods of use perspiration and the like can cause the glass 23 can become removed from the peripheral frame 22, and there is a significant risk that perspiration, water, and dust and the like can intrude into the movement of the wristwatch (antenna 1, radio-controlled watch receiver 2, CPU 3, and display drive section 4 and the like), thereby causing a prominent reduction in functioning as a wristwatch.

Additionally, because the caseback 12 is provided with the glass 23, in addition to an increase in the number of parts, there is the problem of an increase in the number of assembly steps and an increase in cost. Because a non-metallic member is used in the exterior parts, the wristwatch lacks a feeling of weight, and has problems with regard to a feeling of high quality and feeling of attractiveness as well.

The present invention was made in consideration of the above-noted problems in the prior art, and rests in the provision of an electronic device that, even in the case of a conventional metal case, is capable of receiving prescribed information, such as time information with no problem during portable use, and further that has waterproofness quality, and not only provides an improvement in the quality of its outer appearance, but also enables an expansion of design variations in the same manner as a general type of time piece.

Additionally, the present invention has as an object to provide an electronic device that solves the above-noted problems of the past, has good radio-signal receiving performance, and has a metal exterior parts into which is built an antenna part that is not greatly subjected restrictions in terms of material or restrictions in terms of design.

A further object of the present invention, in addition to the above-noted object, when applied to a radio controlled time piece, which is one specific example of the application of the present invention to an electronic device, is not only to prevent an increase in the bulkiness of the wristwatch by an increase in the thickness thereof, but also to provide a radio controlled time piece with a good sense when worn on the wrist.

Additionally, the present invention, similar to a time piece of the past, provides a radio controlled time piece that, although using a metal exterior parts and metal caseback having a relative high permeability made of titanium or stainless steal, maintains the same type of receiving performance as with a watch case and caseback made of a high polymer or ceramic, and also is compact and thin.

DISCLOSURE OF THE INVENTION

In order to achieve the above-noted objects, the present invention adopts the basic technical constitution described below. Specifically, a first aspect of the present invention is an electronic device having at least an antenna, an information processing apparatus for the purpose of processing information captured by the antenna, and a metal exterior parts capable of housing therewithin the antenna and the information processing apparatus, wherein the metal exterior parts is configured so that the antenna can receive magnetic flux from outside the metal exterior parts, that has passed through the metal exterior parts and can resonate, and wherein at least a part of the metal exterior parts has an electrical resistance value that is different from another part of the metal exterior parts. A second aspect of the present invention is an electronic device having at least an antenna, an information processing apparatus for the purpose of processing information captured by the antenna, and a metal exterior parts capable of housing therewithin the antenna the information processing apparatus, wherein the metal exterior parts is configured so that the antenna can receive magnetic flux from outside the metal exterior parts, that has passed through the metal exterior parts and resonate and also is formed by a body part (side) member and a caseback member, and wherein the body part (side) member and the caseback member are mutually joined, the mutual peeling strength between the body (side) member and the caseback member being in the range $10^{-4}$ N·m to 6.0 N·m.

A third aspect of the present invention is an electronic device having at least an antenna, an information processing apparatus for the purpose of processing information captured by the antenna, and a metal exterior parts capable of housing therewithin the antenna the information processing apparatus, wherein the metal exterior parts is configured so that the antenna can receive magnetic flux from outside the metal exterior parts, that has passed through the metal exterior parts and resonate and also is formed by a body (side) member and a caseback member, and wherein the body (side) member and the caseback member are joined via a screw mechanism, the mutual loosening torque between the body (side) member and the caseback member being in the range 0.1 N·m to 6.0 N·m and preferably being 0.2 N·m to 3.5 N·m.

A fourth aspect of the present invention is an electronic device having the above-noted constitution, wherein at least a part of a plurality of mutually joined members that make up the metal exterior parts is provided with an inserted member having an electrical resistance value that is different from the electrical resistance of the metal that forms the metal exterior parts. A fifth aspect of the present invention is an electronic device having the above-noted constitution, wherein a part of the joining surface of one of at least two metal members making up the joining part is removed so as to form a gap between the joining parts.

A sixth aspect of the present invention is a radio controlled time piece with an outer case and a caseback member each being made of metal material and wherein an antenna is housed together with a watch movement within the inside surrounded by the outer case, the caseback, and a watch dial, the antenna being disposed at a position overlapping with the watch dial in planar manner, and the watch dial being generally made of a non-metal material.

BRIEF DESCRIPTION OF THE DRAWINGS

FIG. 26(A) is a partial cross-sectional view showing the configuration of a specific example in which an insulator is inserted between the body member and the caseback member in an electronic device according to the present invention, and FIG. 26(B) is a graph showing data indicating the change in the antenna characteristics values by inserting or not inserting the insulator.

FIG. 29 is a drawing showing data indicating the change in antenna characteristics values in a number of types of specific examples of electronic devices according to the present invention.

FIG. 30 is a drawing showing data indicating the change in antenna characteristics values other specific examples of electronic devices according to the present invention.

FIG. 31 is a drawing describing the results of an experiment in which an antenna position effect was imparted in the case in which a gap was provided in the joining part between the body member and the caseback member making up a metal exterior parts.

DESCRIPTION OF PREFERRED EMBODIMENTS

By adopting the above-noted configuration, an electronic device according to the present invention, without greatly changing the construction, materials, or design of time pieces, mobile telephones, and radio communication equipment of the past, using an antenna part having an easy configuration, provides good receiving performance and, without a different size or thickness in the electronic device itself from the past, has a degree of design freedom, and can easily be used to achieve an electronic device using an exterior parts having a good mass-feeling of texture.

The configuration of an example of an antenna structure and a radio controlled time piece using such an antenna structure according to the present invention are described in detail below, with references made to drawings.

Figure 1:
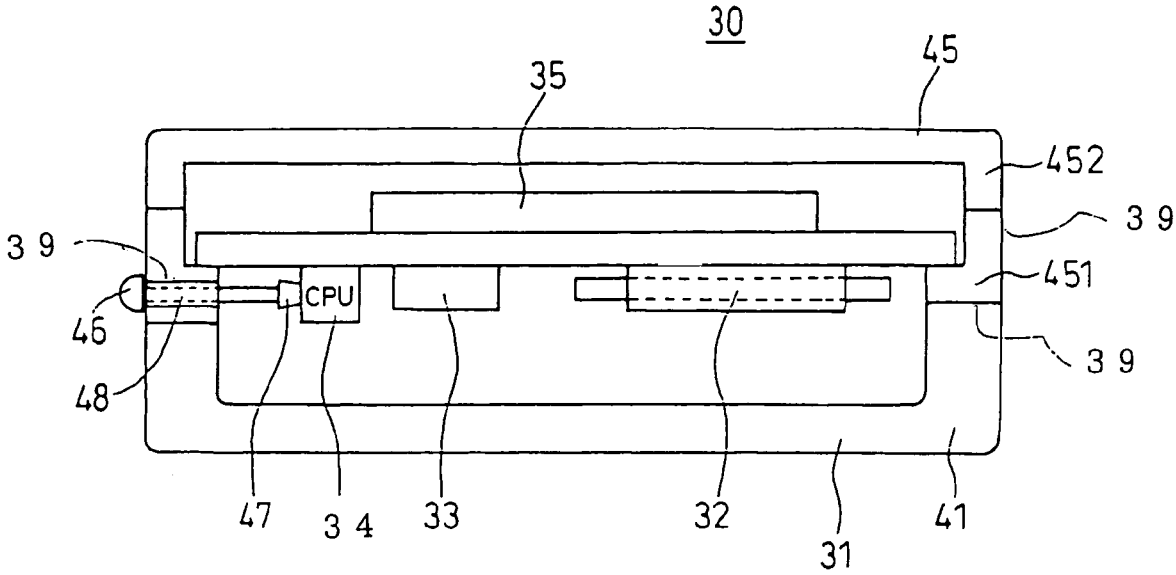
FIG. 1 is a drawing showing the configuration of a specific example of an electronic device according to the present invention.

Specifically, FIG. 1 is a cross-sectional view showing the general configuration of a specific example of an electronic device according to the present invention. This drawing shows an electronic device 30, which minimally has an antenna 32, an information processing apparatus 33 that processes information captured by the antenna 32, and a metal exterior parts 31 capable of housing the antenna 32 and the information processing apparatus 33 therewithin, wherein the metal exterior parts 31 is configured so that the antenna 32 can receive magnetic flux from outside the metal exterior parts 31, that has passed through the metal exterior parts and can resonate, and wherein at least a part of the metal exterior parts 31 has an electrical resistance value that is different from another part of the metal exterior parts 31.

It is preferable that the electronic device 30 be one electronic device 30 selected from a set consisting of, for example, a time piece, a mobile telephone, and a radio communication apparatus.

In FIG. 1, the reference numeral 34 denotes a calculation means controlling the driving of a function of the electronic device 30, such as a computer, and 35 is an information display/notification means, such as a liquid-wind shield display means or speaker or the like, which gives notification or makes display of prescribed information that has been calculated and processed.

Furthermore, in the present invention it is preferable that the metal exterior parts 31 be made of one or more materials selected from a set consisting of stainless steel, titanium, a titanium alloy, gold, a gold alloy, silver, a silver alloy, copper, a copper alloy, brass, aluminum, an aluminum alloy, zinc, a zinc alloy, magnesium, a magnesium alloy, and an ultra-hard metal (an alloy including tungsten carbide and tantalum carbide), and it is necessary that the configuration be such that the generation of eddy currents when the antenna 32 resonates is suppressed.

That is, because it has been clearly learned that the cause of a reduction in the receiving performance of an antenna 32 provided within the metal exterior parts 31 in past was that, when the antenna resonates, electromotive force lines (magnetic flux) coming from the magnetic core of the antenna are pulled into the metal object, in which eddy currents are generated, thereby causing attenuation of the magnetic energy, resulting in a reduction in the output from the antenna and the inability to receive normally, in a configuration encompassing the basic technical concept of the present invention, there is the need to introduce into the metal exterior parts 31 of the electronic device 30 a configuration such that eddy currents are minimized as much as possible in the metal exterior parts 31 when the antenna 32 resonates.

Therefore, one realistic structure that achieves the above-noted technical concept of the present invention is one that introduces a configuration such that there is a reduction in the magnetic flux captured into the metal exterior parts 31 from the antenna 32 when the antenna 32 resonates, and one example of same is a configuration in which at least one part of the metal exterior parts 31 has an electrical resistance value that is different from the electrical resistance value of another part of the metal exterior parts 31.

More specifically, it is desirable that the electrical resistance value of one part of the metal exterior parts be greater than the electrical resistance value of another part making up the metal exterior parts.

Additionally, the metal exterior parts 31 can be one piece, and preferably is formed by the joining of at least two metal members.

In the latter case, it is desirable that the metal exterior parts 31 be formed, for example, by a body or side member 45 and a caseback member 41, in which case it is desirable that the body (side) member 45 and the caseback member 41 be mutually joined or fixed together, or removably joined at a prescribed location.

In the metal exterior parts 31 of the present invention, in the case in which the metal exterior parts 31 is formed with the body (side) member 45 and the caseback member 41 as one, it is desirable that the body or side member 45 be formed by a plurality of two or more side sub-members 451 and 452, and the configuration can be such that the side sub-members 451 and 452 are mutually joined.

In the same manner, in the present invention there are cases in which the metal exterior parts 31 is configured by a body (side) member 45 and the caseback member 41 as one piece, and in which also the body member 45 is formed by an internal body member and an external body member, and in such a case the body member 45 can be formed by mutual joining of the internal body member and the external body member.

That is, the joining part 39 of the metal exterior parts 31 in an electronic device 30 of the present invention is not restricted to the above-noted joining part 39, and in the body member or side member 45 of the metal exterior parts 31, the joining part 39 in the present invention encompasses a joining part between each operation processing mechanism 33 and 34, which are disposed by a stem, an operating button, or an operating pin 46 or the like passing through the body member or side member 45, and an internal surface of a passage hole 48 in the body member or side member 45.

In FIG. 1, reference numeral 47 denotes, for example, a switching circuit.

That is, in the case in which at least one inserted member or abutted member selected from a rod, a pipe, a glass, a bezel, an internal register ring, and the dial open is provided in part of the body member 45, all the above-noted joining parts, including the joining surface between these and body member or side member of the metal exterior parts 31, are candidates for a location in the present invention at which the electrical resistance value is caused to change.

Specifically, the configuration is such that, of a plurality of members that form the metal exterior parts 31, the electrical resistance value of metal forming one member is different from the electrical resistance value of the metal forming another member. For example, in the joining part 39 between the body member 45 and the caseback member 41, which is one desirable joining part 39, the configuration is made such that the electrical resistance value of body member 45 is different from the electrical resistance value of the caseback member 41 and, for example, it is possible the electrical resistance value of the caseback member 41 being made greater than the electrical resistance value of the body member 45.

In this case, it is possible to cause the metal materials that form each of the members to be different.

As another specific example, it is possible for the configuration to be one in which the electrical resistance value of the mutual joining part 39 between the plurality of members that form the metal exterior parts 31 to be different from the electrical resistance value of the metal that forms the metal exterior parts 31.

In this specific embodiment, for example a gap or space having an appropriate interval can be provided in the joining part 39, or the configuration can be one in which there is the insertion of a intervening inserted member 49 made of a film, a plate or an adhesive formed from a material having an electrical resistance value that is larger than the electrical resistance value of the metal material forming the metal exterior parts 31.

The method of forming the joining part 39 at the metal exterior parts 31 in the electronic device 30 in the present invention is an appropriate method of joining two metal members and, although the specific method is not specified, the method used is, for example, one or a plurality of the methods selected from a screw method, an internal threading method, a snap method, a welding method, a brazing method, a crimping method, a bayonet method, a solid-state diffusion joining method and the like.

Figure 39:
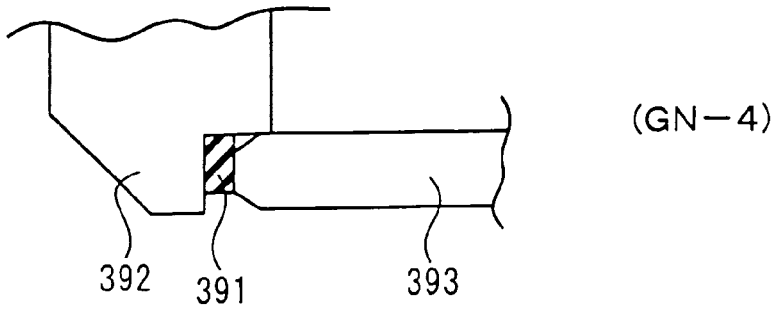
FIG. 39 is a drawing showing another example of the joining structure between the caseback part and the body part.

The method of forming the joining part 39 in the present invention can additionally be the packing holding method, and a specific example thereof that can be used is the packing holding method shown in FIG. 39 and generally known as GN-4.

Specifically, the GN-4 packing holding method was used in the past as a method of holding between the wind shield glass and the side part in electronic devices, including time pieces, although in the present invention this is used as the method of holding between the caseback and the body.

This GN-4 packing holding method is known as a method for performing holding between members for the purpose of achieving a high-pressure waterproofing, and specifically is a method whereby a high-elasticity material 391 such as Teflon® is interposed between a body 392 and a caseback 393, which is generally made of glass, the high-elasticity material being compressed between the sides of the body 392 and the caseback 393 so as to increase the water-tightness and the holding force on the caseback 393, and there is a need for dimensional accuracy and surface quality in the packing, which includes the body 392, the caseback 393 and the high-elasticity material such as Teflon®.

Of course, although in the present invention as well it is possible to make the caseback 393 from glass, in the present invention in particular it is preferable that the caseback 393 not be glass, but rather be made of a metal material similar to that of the body 392.

Figure 40:
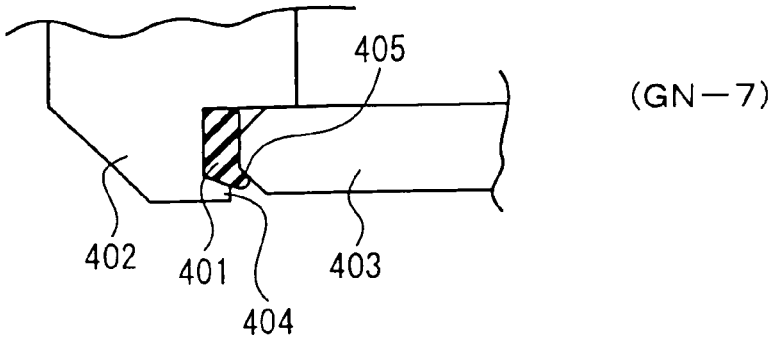
FIG. 40 is a drawing showing a different example of the joining structure between the caseback part and the body part.

In addition, as another specific example of this packing holding method in the present invention, it is possible to use the GN-7 packing holding method shown in FIG. 40.

The GN-7 packing holding method is also basically, similar to the GN-4 packing holding method, used in chiefly in high-quality time pieces to provide a thin, high-pressure waterproof construction.

Specifically, similar to the GN-4 packing holding method, a high-elasticity material 401 such as Teflon® is interposed between a body 402 and a caseback 403, which is generally made of glass, the high-elasticity material 401 being compressed between the sides of the body 402 and the caseback 403 so as to increase the water-tightness and the holding force on the caseback 403.

The difference between the GN-4 packing holding method and the GN-7 packing holding method is that, as shown in FIG. 40, in the GN-7 packing holding method a groove covering part 404 that covers a groove between the body 402 and the caseback 403 is provided in the end surface part of the joining part between the body 402 and the caseback 403, packing material made of a high-elasticity member 401 disposed in a gap between the body 402 and the caseback 403 being press fit so that it is pushed out from between an inclined surface 405 provided at the end part of the caseback 403 and the groove covering part 404.

In this specific example as well, it is desirable to use a metal material as the caseback 403 in the present invention.

Figure 41:
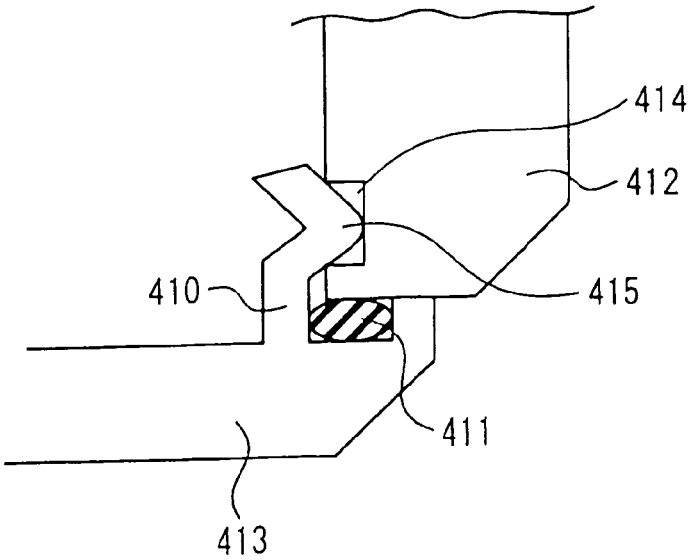
FIG. 41 is a drawing showing yet another example of the joining structure between the caseback part and the body part.

Additionally, in the present invention it is possible to use a dowel biting holding method, as shown in FIG. 41, as yet another method of forming the joining part 39. A specific example of this is one in which, as shown in FIG. 41, a plurality of dowels 410 are provided on the caseback 413, the protrusions 415 of the dowels 410 being caused to fit into a groove 414 provided in the body 412, and holding between the body 412 and the caseback 413 is done with an appropriate packing 411.

Although FIG. 41 shows an internal dowel biting holding method, it is also possible to use an external dowel biting holding method, wherein the structure is similar to but the reverse of the internal dowel biting holding method.

In the present invention, it is desirable that the joining part 39 be provided as close to the antenna 32 as possible or, stated conversely, it is desirable that the antenna 32 be disposed as close as possible to the joining part 39.

Although in the present invention, the joining part 39 having the above-noted characteristics is disposed at minimally one location on the metal exterior parts 31, it is also possible to provide a plurality of joining parts 39, and further it is desirable that the joining part 39 be disposed to have a prescribed width, a prescribed length, and a prescribed surface area.

Figure 2:
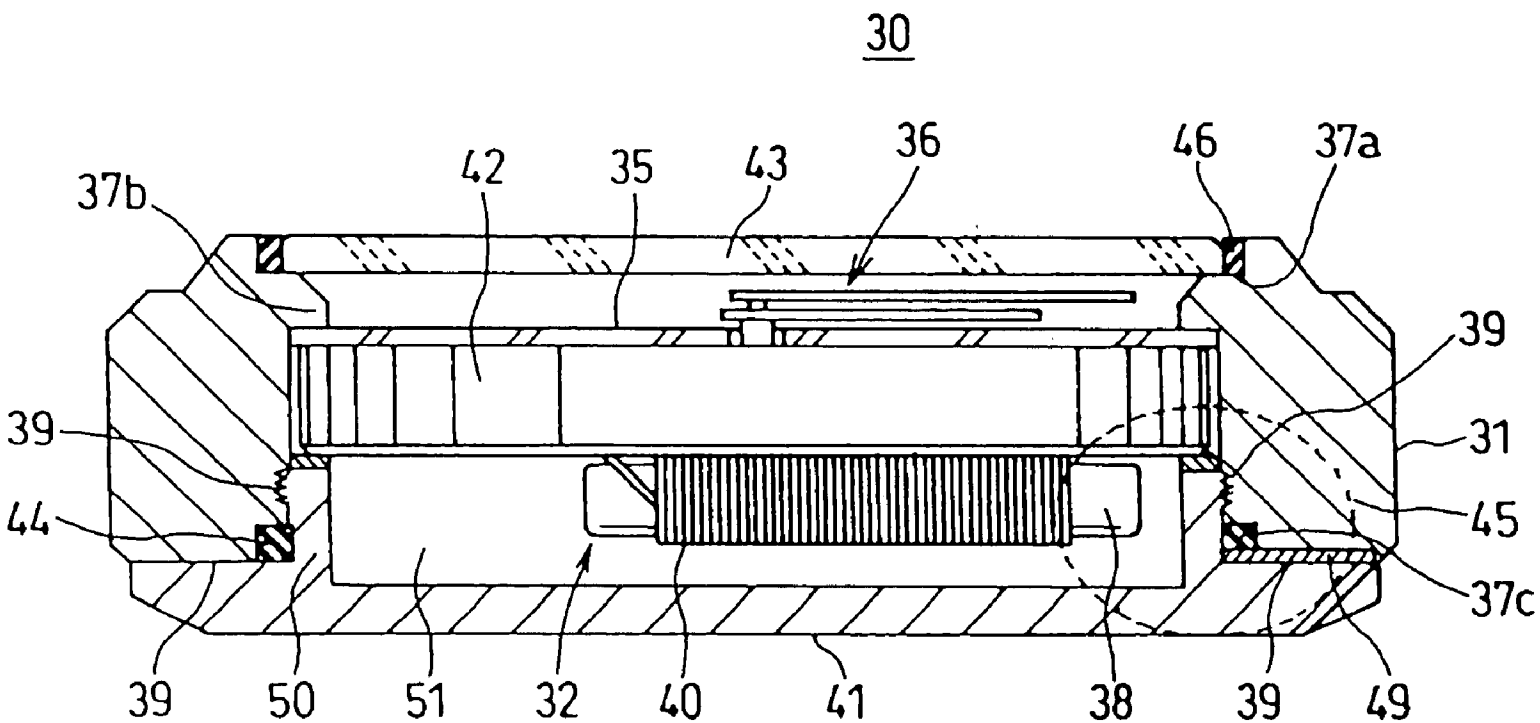
FIG. 2 is a cross-sectional view showing the configuration of another specific example of an electronic device according to the present invention.

Next, FIG. 2 shows the general cross-sectional view of an example of the configuration of the application of the present invention to a radio controlled time piece 30, which is a specific example of an electronic device 30 according to the present invention.

Specifically, in FIG. 2, the metal exterior parts 31 is formed by the body member 45 and the caseback member 41, the body member 45 being substantially tubular in shape, a wind shield glass 43 being mounted at the top aperture part thereof as shown in FIG. 2, with an interposed packing 46 at the step 37*a* on the inner periphery thereof, and a prescribed joining part 39 being formed between a peripheral portion of the body member 45 and a peripheral portion of the caseback member 41 by a means such as that of press fitting, screw mating, or using screws on the aperture part at the bottom part in FIG. 2.

The caseback member 41 shown in FIG. 2 is mounted to the body member 45 by a screw method, with packing 44 fitted between the rising part 50 thereof and an inside surface 37*c* of the body member 45.

Figure 20:
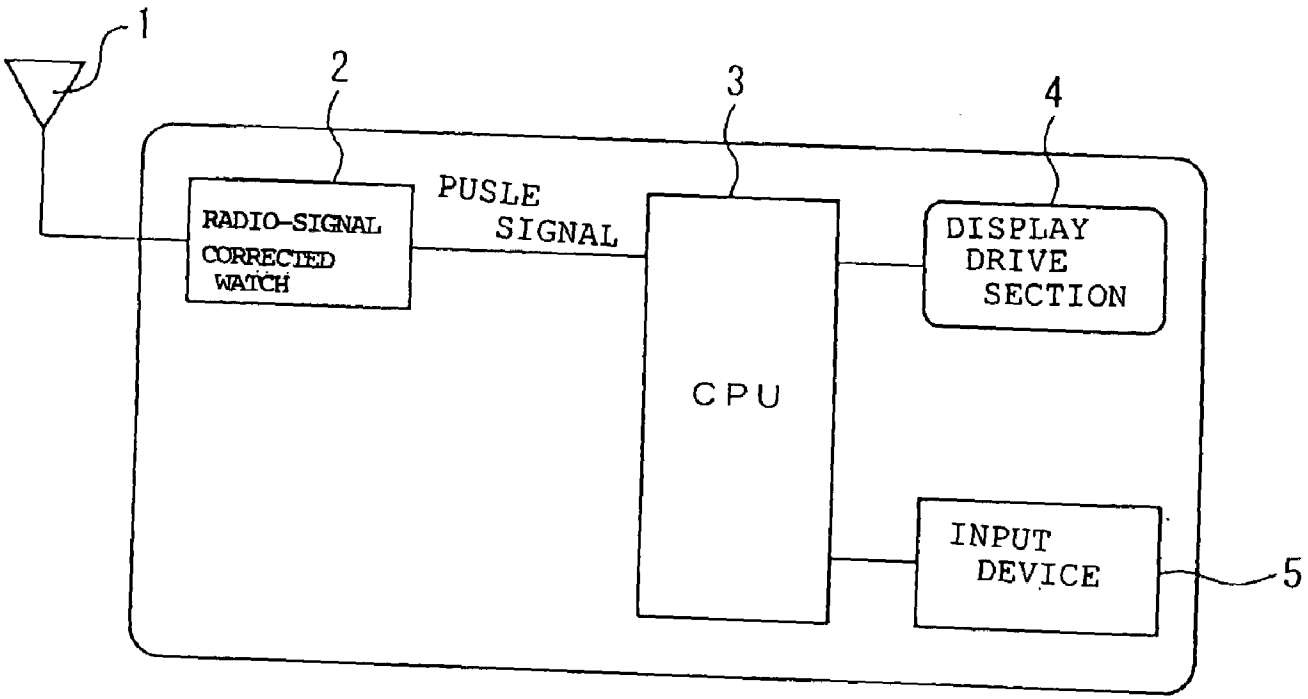
FIG. 20 is a drawing describing the general configuration of a radio controlled time piece as specific example of an electronic device according to the present invention.
Figure 21:
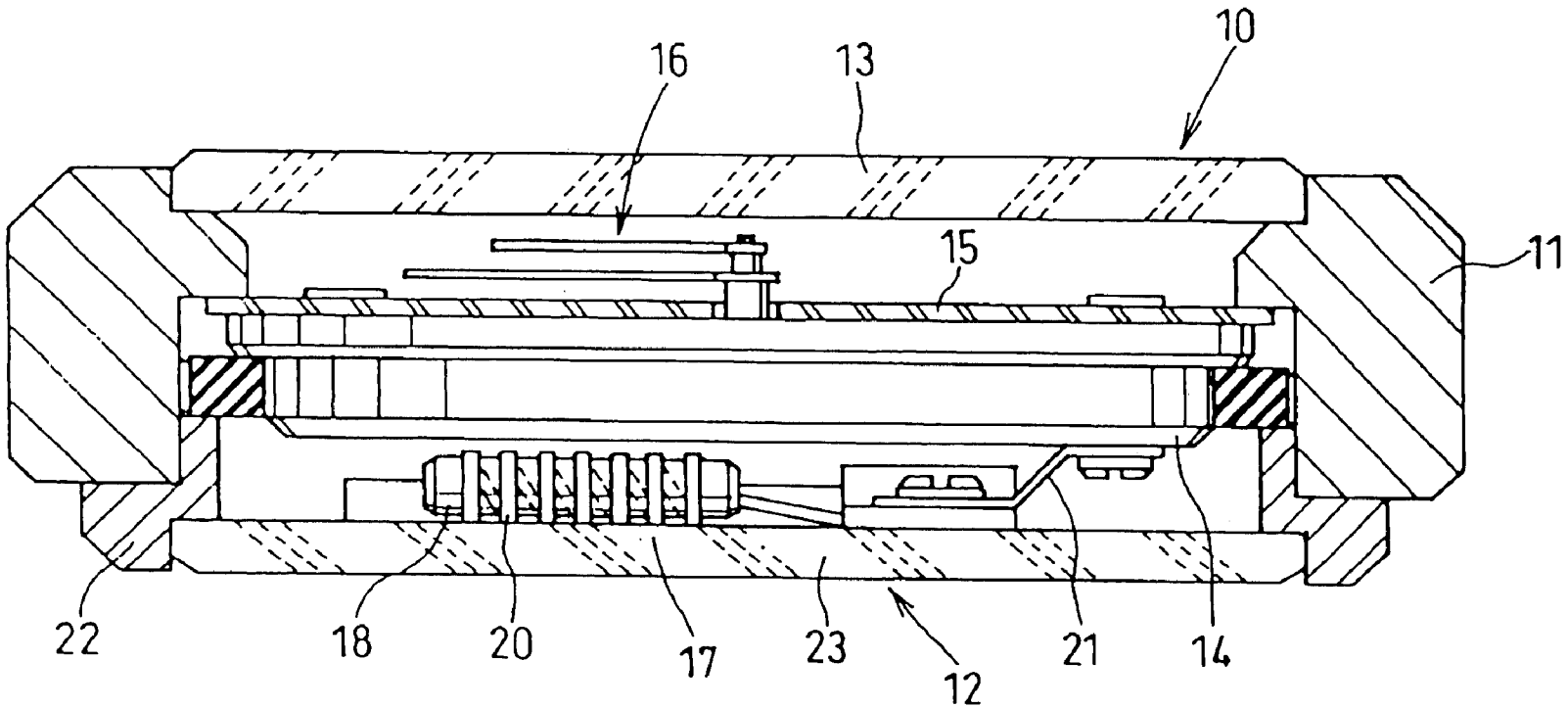
FIG. 21 is a drawing describing the details of the configuration of a radio controlled time piece of the past.

A movement 42 provided with a radio-controlled watch receiver 2, the CPU 3, and the display drive section, as shown in FIG. 20 and FIG. 21, is housed within the body member 45.

At the top of the movement 42 in FIG. 2 there are provided a watch dial 35, which is a time display section, and hands 36. The movement 42 is positioned by the watch dial 35 coming into contact with the lower surface (as shown in the drawing) of the inner protruding part 37*b* forming the step 37*a* of the metal exterior parts 31, and is held in place by being fit between this and the body member 45 disposed at the upper surface of the rising portion 50 of the metal exterior parts 41.

A prescribed space 51 is provided between the movement 42 and the caseback member 41, and the antenna 32 is disposed within this space 51. This antenna 32 is formed by a bar-shaped magnetic core material 38, and a coil 42 wound around the magnetic core material 38, and is held at the bottom surface of the movement 42.

The body member 45 and the caseback member 41 used in this embodiment are both made of titanium. In this specific example of the present invention, the thickness of the body member 45 is set at 1600 μm, and the distance from the antenna 32 to the inner surface of the body member 45 is set at 2000 μm. Additionally, the thickness of the caseback member 41 is set at 800 μm, and the distance from the antenna 32 to the caseback member 41 is set at 3000 μm.

In a radio controlled time piece configured as noted above, based on a standard radio signal received by the antenna 32, the CPU (not illustrated) within the movement 42 causes the display drive section(not shown) to operate, so as to constantly correct the hands 36. When this is done, although the body member 45 and caseback member 41 in this specific example are made of metal, because the thickness of the body member, the thickness of the caseback member and the distances between the antenna and the body member and caseback are each pre-established for the best sensitivity based upon the experimental data to have the receiving sensitivity best, a disorder in the resonance phenomenon in the vicinity of the antenna is reduced, and the sensitivity is increased.

If a non-magnetic material, such as gold, a gold alloy, silver, a silver alloy, copper, a copper alloy, brass, aluminum, an aluminum alloy, zinc, a zinc alloy, magnesium, or a magnesium alloy, having an electrical resistivity of 7.0 μΩ·cm or less is mounted to the inner surface of the caseback member 41 or the inner surface of the body member 45 of the metal exterior parts 31, it is possible to improve the gain by approximately 2 to 3 dB.

A detailed description of the case in which an intervening inserted member 49 is interposed in the joining part 39 in the present invention is presented below.

Specifically, in a specific example of the electronic device 30 according to the present invention, at minimally one part of a plurality of members forming the metal exterior parts 31, for example at the mutual joining part 39 between the body member 45 and the caseback member 41, this being for example the joining part 39 formed at a location in greatest proximity to the antenna 32, an intervening inserted member 49 having an electrical resistance value that is different from the electrical resistance value of the metal that forms the metal exterior parts 31 is inserted.

In this case, it is desirable that the plurality of members forming the metal exterior parts 31, for example the metal members forming both the body member 45 and the caseback member 41, be the same, but they can alternatively be different.

In this specific example, it is desirable that the electrical resistance value of the material forming the intervening inserted member 49 that is inserted in the joining part 39 be selected as a value that is higher than the electrical resistance value of all of the metal members forming the metal exterior parts 31.

Although there is no particular restriction with regard to the material of the intervening inserted member 49, it is desirable that this be a substance that is substantially an insulator.

Figure 3:
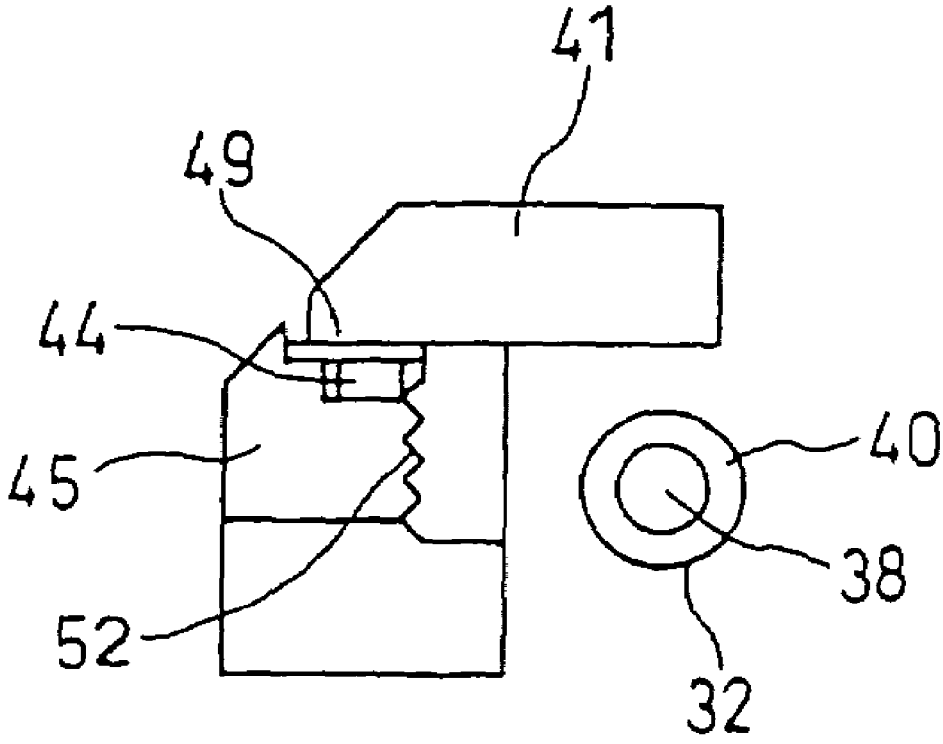
FIG. 3 is a partial cross-sectional view showing a specific example of an electronic device according to the present invention.

The joining part 39, as shown in FIG. 2 and FIG. 3, can be of a structure in which an interposed intervening inserted member 49, which is an insulator, is interposed via the packing member 44.

If the disposition position of the joining part 39 in this specific example of the present invention is viewed in plan-view manner, because the joining part 39 between the body member 45 and the caseback member 41 is usually round, elliptical, or rectangular, it is desirable that the intervening inserted member 49 be disposed along the entirety of the joining part 39.

In the present invention, of course, in the case in which the electronic device 30 has a structure that achieves waterproofness, it is possible for the intervening inserted member 49 to be provided at only a part of the periphery of the joining part 39, for example at only a location close to the antenna 32.

The intervening inserted member 49 in the present invention, therefore, is disposed and held between the joining part 39.

The position of interposing the intervening inserted member 49 in the present invention is not restricted to the above-noted specific example and, as noted above, can be achieved at all of the joining parts 39. For example, the intervening inserted member 49 can be disposed at a joining part formed by the fitting together of the body member 45 and the bezel or at, for example, a joining part between the upper and lower body parts or between inner and outer body parts.

It is desirable that the intervening inserted member 49 used in the present invention be a member formed separately from either the one or plurality of members that form the metal exterior parts 31. For example, it can be a film-like member or sheet like member made of synthetic resin or rubber (organic substance), and it is possible for it to be an insulator such as an oxide or the like, or a thin-film member having an oxide film, and it can further be ink, paint, adhesive, or paste.

In addition, the intervening inserted member 49 used in the present invention can be either one or a plurality of members forming the metal exterior parts 31 and which is a film formed on a member in contact with the joining part 39.

Specifically, this film can be formed on one or a plurality of members forming the metal exterior parts 31 by appropriate surface treating or hardening treatment.

The surface treatment can be, for example, one method selected from wet plating, dry plating, and heat treating.

It is desirable that the electrical resistance value of the intervening inserted member used in the present invention be greater than the electrical resistance value of the plurality of members that form the metal exterior parts.

As a description of the effect of the above-noted present invention, in the structure of the past as described above, as shown in FIG. 4(A), with the metal exterior parts 31 of the electronic device 30 being circular, the metal exterior parts 31 is formed, as shown in FIG. 4(B), by a body member 45 and a caseback member 41, these elements being mutually fitted and held together by the screw threads 52. Therefore, the joining part 39 of the present invention is formed at the mutually fitting surfaces S1 of the screw threads 52 and at the joining surface S2 between the body member 45 and the caseback member 41.

Therefore, the joining part 39 formed by the joining surface S2 between the body member 45 and the caseback member 41 is annular, as shown in FIG. 4(A), and considering the example in which the antenna 32 is disposed in proximity to a part of the joining part 39, as shown in FIG. 4(B), in the condition in which there is resonance of the antenna 32, an eddy current 54 is generated from both ends of the magnetic core 38 of the antenna 32 as shown by the arrows A, B, and $C_0$. However, as shown in FIG. 3, because the intervening inserted member 49, made of an insulator member, is interposed between the caseback member 41 and the body member 45 being mutually contacted to each other via part of the rubber packing 44, there is no eddy current $C_0$ as shown in FIG. 4(B), so that there is a reduction in the overall amount of eddy current, thereby reducing the loss of energy.

Next, another specific example of an electronic device 30 according to the present invention adopts a configuration in which, there is formed a non-joined part at at least a part of a plurality of members forming the metal exterior parts 31, for example, at at least a part of the joining part 39 between the body member 45 and the caseback member 41, which is, for more specific example, at the part of the joining part 39 formed at a location that is closest to the antenna 32.

In this specific example, in order to impart to the joining part 39 an electrical resistance value that is higher than the electrical resistance value of the metal material forming the metal exterior parts 31, a gap 55 is formed so as to interpose air in place of the intervening inserted member 49.

In this specific example of the present invention, the gap 55 is formed between the joining part 39 by removing a part of the joining surface of at minimally one of the metal members of the minimally two members that form the joining part 39.

More specifically, the gap 55 in the present invention is formed as a non-contacting part by removing an appropriate width and length of one of the joining surfaces of the two metal members and which facing to each other to form the joining part 39.

Alternatively, a part of the intervening inserted member 49 in the above-noted specific example, can be removed to form the gap 55.

It is desirable that the height of the gap 55 used in this specific example of the present invention be, for example, from 0.1 to 1000 μm, and further preferable that it be 60 to 160 μm. μm The gap 55, for example as shown in FIG. 6(A), is formed by removing a part of the joining part 39 between the caseback member 41 and the body member 45 forming the metal exterior parts 31, and in the specific example shown in FIG. 6(A) the gap 55 is formed by removing part of only the caseback member 41. As shown in the plan view thereof in FIG. 6(B), the gap 55 forms a non-contacting part of the joining part 39 at the part 57 of the joining surface of the annularly formed joining part 39.

Figure 6:
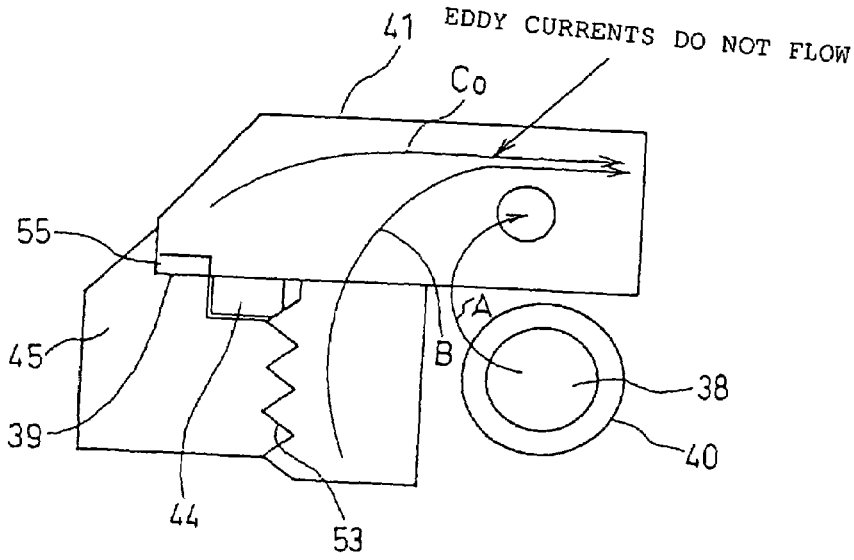
FIG. 6(A) is a partial cross-sectional view showing a different specific example of a metal exterior parts in the present invention.
FIG. 6(B) is drawing to describe the fan-shaped region.
Figure 6:
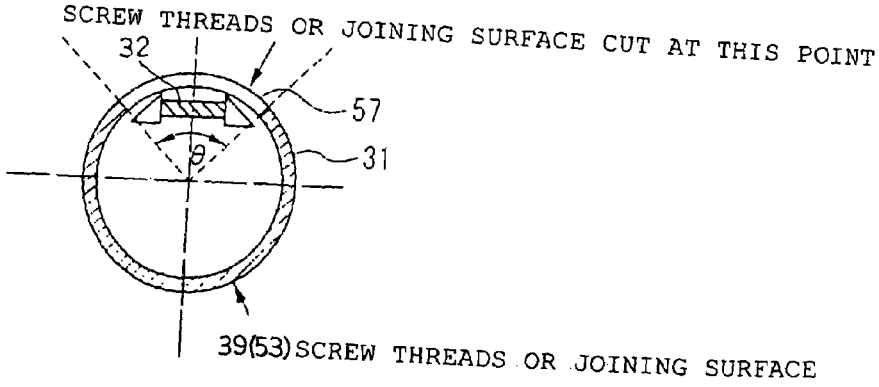

It is desirable, as shown in FIG. 6, that the gap 55 be formed in the vicinity of the antenna 32.

In another specific example of the present invention, as shown in FIG. 4(B), in the metal exterior parts, the body member 45 and the caseback member 41, for example, that form the metal exterior parts 31 are mutually joined by the screw thread mechanism 52, and in the case in which screw threads surface form the joining part 39, the gap 55 can be formed by removing a part of the screw threads mechanism 52.

Specifically, as shown in FIG. 7(A), it is possible to form the gap 55 by removing a part of the screw thread mechanism portion of at least one of the screw thread mechanism 52 of the joining part 39.

In this specific example it is desirable, as shown in FIG. 7(B), that the gap 55 be provided in the vicinity of the antenna 32.

Specifically, this specific example the configuration shown in FIG. 7(A) is one in which, a part of the screw thread mechanism 52 of the body member 45 is taken away, so that a gap 55 is formed between the screw thread mechanism of the caseback member side 41 and the side surface of the body member 45, which had been mated.

As shown by a drawing viewed from above, as indicated in FIG. 7(B), the gap 55 is formed as a non-contacting part in the joining part 39 that is formed by removing a part of the screw thread mechanism 52 of the body member 45 in a part 56 of the joining surface of the joining part 39, which has an annularly formed joining surface by means of screw thread mechanism.

Figure 7:
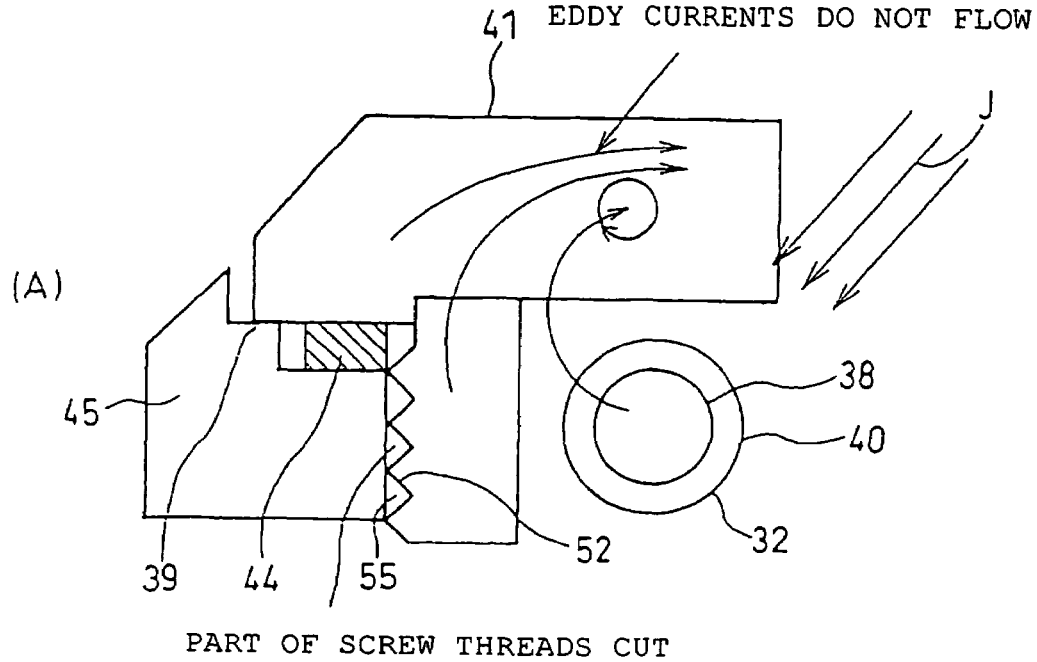
FIG. 7(A) is a partial cross-sectional view of yet another metal exterior parts in the present invention.
FIG. 7(B) is a drawing to describe the fan-shaped region.
Figure 7:
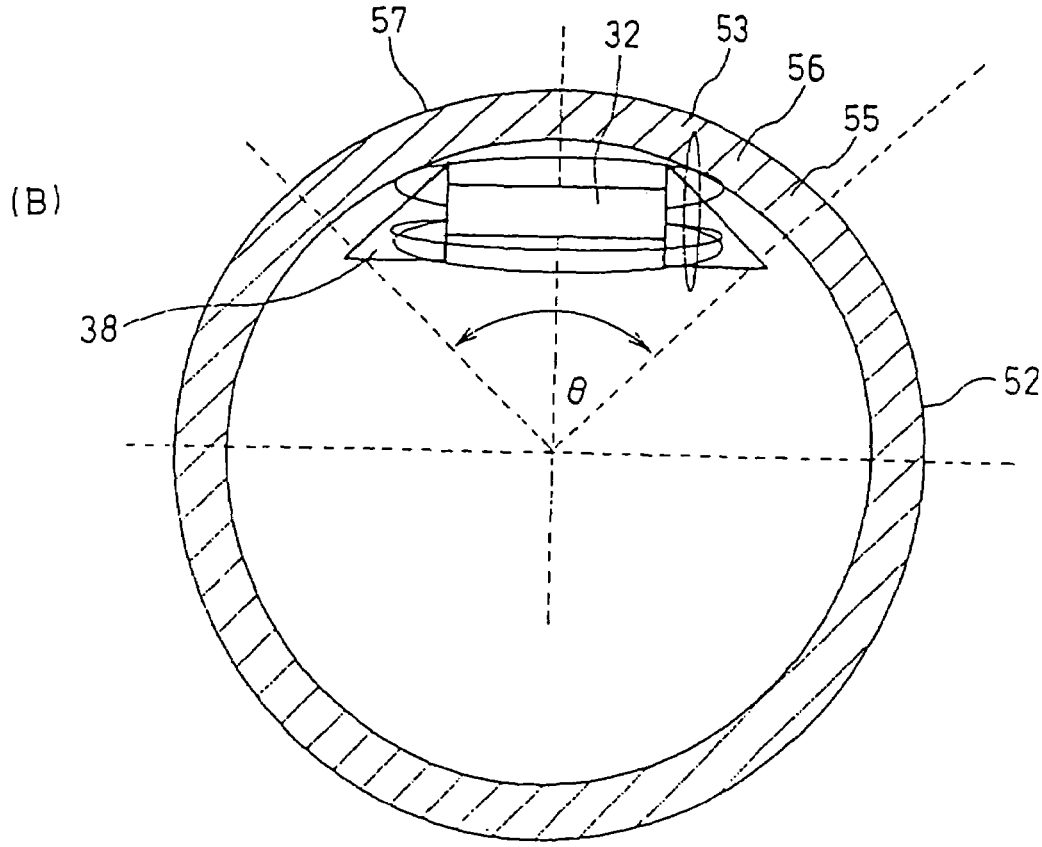

In the specific example shown in FIG. 7, although not shown in the drawing, it is possible to make commonly use of the gap 55 with above-noted intervening inserted member 49 and packing member 44, simultaneously as shown in FIG. 3.

In the above-noted specific example using the gap 55, because it is possible to have the space of the gap 55 filled with air, this can have the effect of an insulator, and can have an effect that is equivalent to the case in which an intervening inserted member 49 is inserted in the joining part 39.

In this specific example, it is further possible to insert the above-noted insulator into the space of the gap 55.

The gap 55 is not restricted to the position shown in FIG. 7, and can obviously be applied, as noted above, at any location at which at least two metal member are joined to each other with any joining configuration formed in the metal exterior parts 31.

In order to prove the above, the experimental results shown in FIG. 31 will be presented.

In the experiment shown in FIG. 31, measurements were performed at two selected frequencies for each of the antenna characteristics values for the case in which a gap 55 is not formed in the joining part 39 between the caseback member 41 and the body member 45 of the metal exterior parts 31 having an annular configuration (Experiment 1: no cut), for the case in which a gap 55 was provided in the joining part 39 in the vicinity of the antenna (Experiment 2), and for the case in which the gap 55 was provided in a part of the joining part 39 on the opposite side from the antenna (Experiment 3).

Judging from the experiment results shown in FIG. 31, it can be understood that, although there is a lack of a large difference in the antenna characteristics dependent upon the position at which the gap 55 is provided, both of these cases in which a cutting portion is provided, exhibit that an effect in gain in the case with cutting is superior to that of the case in which no cutting is provided, that is, the case of the structure in which there was no gap 55.

Next, the positional relationship between the intervening inserted member 49 or gap 55 or both of these elements disposed in the metal exterior parts 31 of the electronic device 30 and the antenna 32 disposed within the metal exterior parts 31 is described in detail below.

First, although the structure of the antenna 32 used in the present invention is not particularly restricted, it is desirable that the antenna be, as shown in FIG. 1 through FIG. 7, one in which a coil is wound around a straight or curved magnetic core having a maximum longitudinal length that is shorter than the maximum diameter of the metal exterior parts 31.

Figure 14:
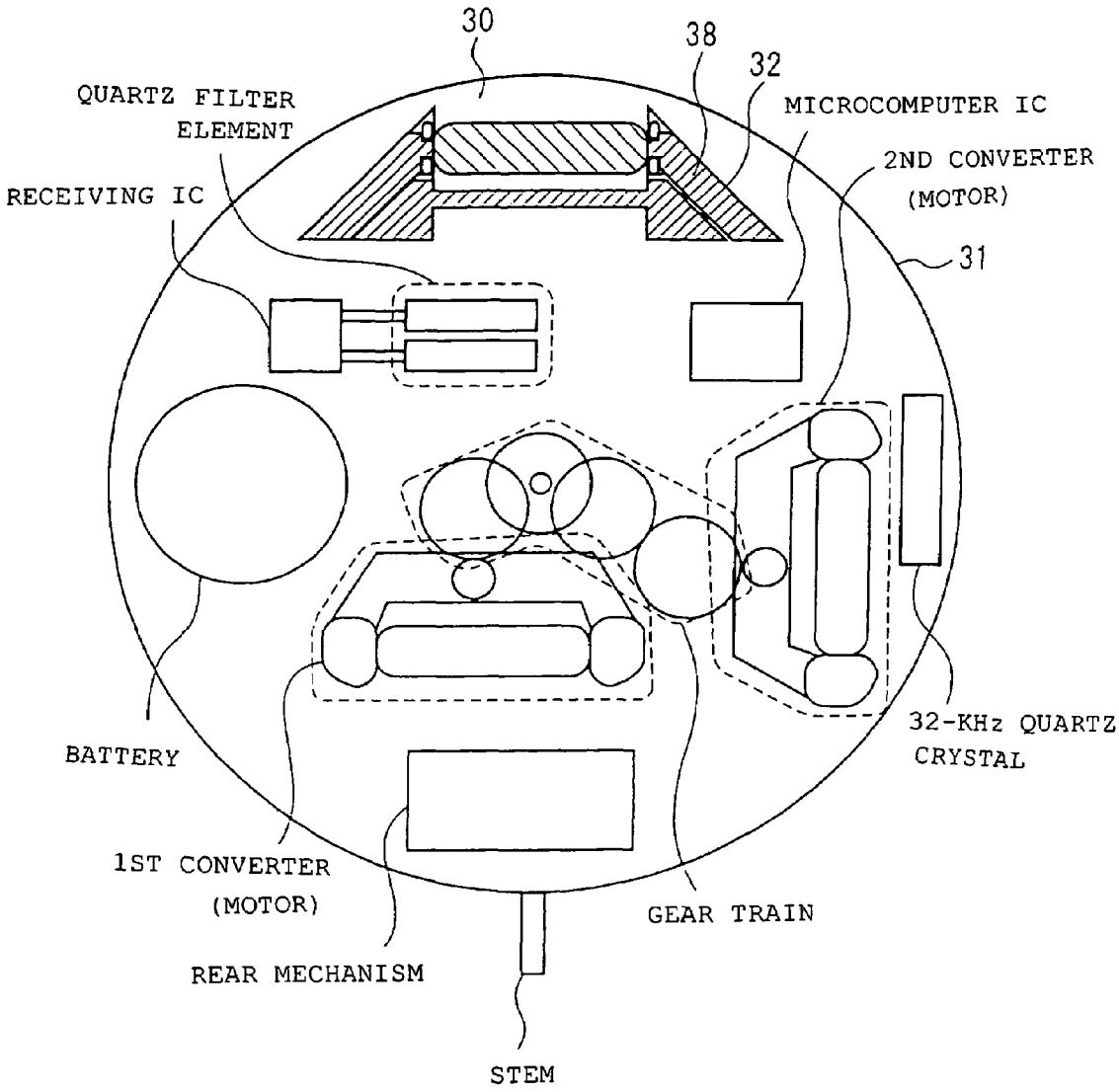
FIG. 14 is a drawing showing an example of the positional configuration of parts in a radio-controlled watch, which is a specific example of an electronic device according to the present invention.

In the present invention, of course, the magnetic core can be annular or in the shape of a closed loop, and can be an antenna 32 having the configuration shown in FIG. 14.

In the present invention, as noted above and shown in FIG. 4 through FIG. 7, it is desirable that the antenna 32 be disposed in the vicinity of the outer periphery of the metal exterior parts 31, and specifically in the vicinity of the above-noted joining part 39.

In the case in which the antenna 32 is disposed within the metal exterior parts, the antenna 32 can basically be disposed at any location in the vicinity of an outer peripheral portion that is the joining part 39 of the metal exterior parts 31.

In order to best achieve the object of the present invention, it is desirable, as in the above-noted specific example, that the antenna 32 be disposed in the vicinity of the location in which the intervening inserted member 49 or the gap 55 is disposed.

More specifically, the intervening inserted member 49 or gap 55 of the metal exterior parts 31 is continuously formed as shown in FIG. 6 or, intermittently formed as shown by 60 in FIG. 8(A), in a joining part 56 surrounded by a fan-shaped region 57 formed by the two end parts of the magnetic core of the antenna 32 of a prescribed length and the center part of the metal exterior parts 31, and the antenna 32 is provided so as to be in proximity to the position at which the intervening inserted member 49 or gap 55 is provided.

Because the length of the fan-shaped region 57 is determined by the core length A of the antenna 32 and the position of placement of the antenna 32, it is desirable the position at which the antenna 32 is disposed be within the range represented by an angle ratio (B/A) between the core length A of the antenna 32 and the joining part 39.

Figure 32:
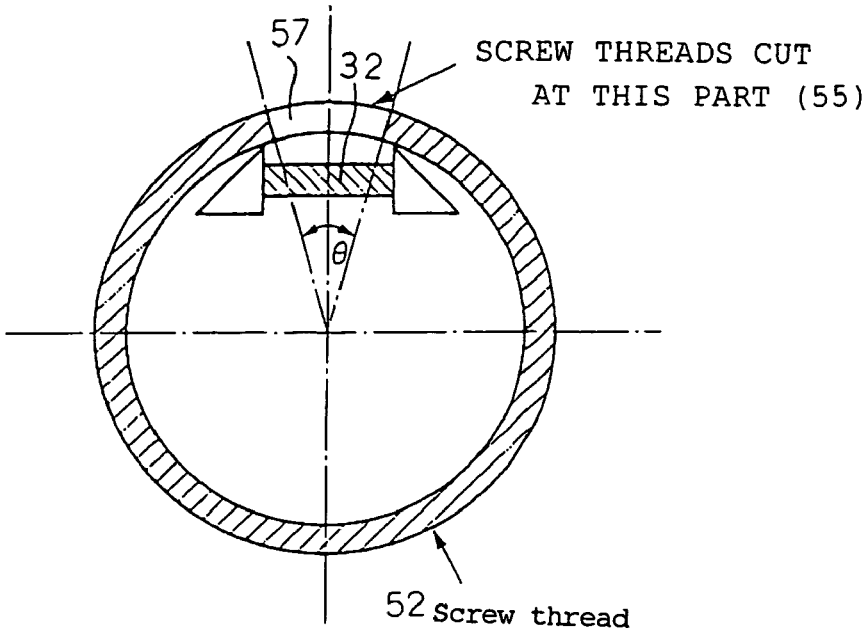
FIGS. 32 (A), (B), and (C) are drawings describing the relationship between the antenna position, the length of the gap, and the central angle of the fan-shaped region in the case in which a gap was provided in the joining part between the body member and the caseback member making up a metal exterior parts.
Figure 32:
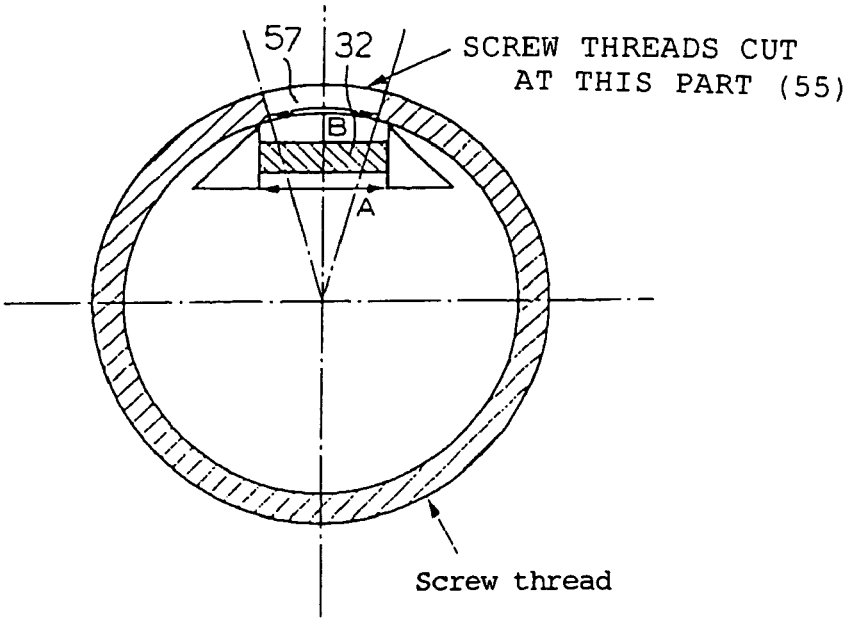

FIG. 32(A) shows the disposition of the antenna 32 within the metal exterior parts 31, FIG. 32(B) shows the relationship between the length of the gap 55, this being the length B of the fan-shaped region 57, for the case in which an antenna 32 having a prescribed length of A is moved in the direction of the gap 55 from the center part of the metal exterior parts 31, and the angle when that is done, and FIG. 32(C) shows an example of the ratio of the length B of the fan-shaped region 57 and the length A of the antenna 32.

Essentially, it can be understood that in the case in which it is desirable that the center angle range within the fan-shaped region is 30 to 180° for the case of not providing a contact point within the fan-shaped region, it is necessary that the angle ratio (B/A) be 0.64 to 2.5, and under the same conditions in the case in which it is desirable that the angle range within the fan-shaped region is 50 to 120°, it is necessary that the angle ratio (B/A) be 1.05 to 2.16.

Additionally, in the case in which a contact point is not provided within the fan-shaped region when the central angle within the fan-shaped region is 10° or less, it is understood that it is necessary for the angle ratio (B/A) to be 0.21 or smaller.

Therefore, summarizing the data of FIG. 32(C) and the information shown in FIG. 5(B) with regard to the preferable angle range, it is possible to predict the preferable position at which an antenna 32 of a prescribed length should be disposed.

The angle range of the fan-shaped region 57 in the present invention be 30 to 180°, preferably 50 to 120°, and more preferably 60 to 90°.

In order to study the preferable angle of the central angle for the fan-shaped region 57 such as indicated in FIG. 5(A), a specific example shown in FIG. 5(A) was constructed and measurements where made of the condition of change in the antenna gain (dB) while varying the central angle (θ) of the fan-shaped region 57 in which the screw thread grooves were removed as shown in FIG. 6(A), the results being shown in FIG. 5(B).

Because, as is clear from the graph of FIG. 5(B), with an increase in the angle of the region of removal of the joining part 39 in the threaded part, there is an increase in the gain (dB) of the antenna 32, it can be understood that it is possible to achieve the effect of the present invention in the angle range that was investigated, this preferably being 30 to 90°, and more preferably 60 to 90°.

In the specific example of the present invention shown in FIG. 8(A), the antenna characteristics obtained in the case in which the entire joining part 39 formed in the above-noted fun-shaped region 57 with a central angle of 120° or entire screw thread groove formed in the same region is entirely removed, and the antenna characteristics obtained in the case in which a part of the screw thread groove contained in the above-noted fan-shaped region 57, but especially located within a region defined by the central angle of 10° by extending both end edge lines by 5° each in left and right direction, from the center line of the fan-shaped region 57, is remained without removing it therefrom, or a part of the joining part 39 located in the same region as mentioned above, is also remained without inserting the intervening inserted member 49, are compared with that as obtained by a conventional one in which no removed part or no cutting portion is provided or no intervening inserted member 49 is inserted in the entire joining part.

From this comparison, although there is a considerable effect in the former configuration, compared to the configuration of the past, and on the other hand, although there is some effect can be seen on the latter configuration with respect to that of the past configuration, the effect thereof is small compared to that of the former configuration but still practical.

In the present invention, it is possible, as noted above, to dispose the antenna 32 at a position that does correspond to the above-noted fan-shaped region 57.

Next, the preferable configuration of the antenna 32 used in the present invention is described below.

Specifically, the antenna 32 used in the present invention is basically a bar antenna, and it is preferable that either the L value of the antenna be 1600 mH or less or that the resistance of the antenna coil be 1 kΩ or less, and further it is desirable that the number of antenna coil turns be 1000 or greater.

A preferable specific example of an antenna structure in the present invention is described in detail below.

Figure 9:
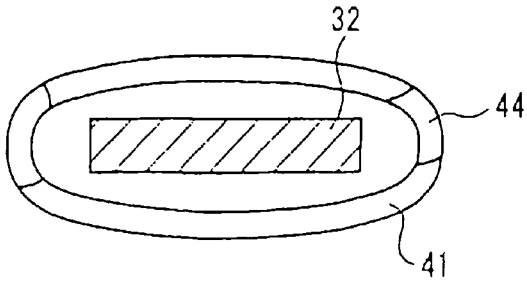
FIG. 9 is a drawing showing the configuration of a specific example of an antenna structure in the present invention.

Specifically, FIG. 9 is a schematic plan view showing a specific example of an antenna 32 of the present invention, this drawing showing an antenna 32 capable of receiving a radio signal and disposed within a time piece, configured minimally by a side part 44 and a caseback part 41 that are both made of metal.

In the above-noted example of the past, in the case of disposing an antenna within a metal exterior parts having metal sides or a metal cover, because a resonance phenomenon by virtue of the antenna (change of magnetic flux to electrical power to magnetic power, and so forth) is hindered by the metal exterior parts, specifically because the magnetic force generated by the resonance phenomenon is attracted into the metal part wherein eddy currents are caused, the result is that almost all of the magnetic force is consumed (because of iron losses), so that there is a great reduction in the gain and Q value of the antenna, this representing a problem for the implementation of a radio controlled time piece, an antenna being inside a metal exterior parts.

Although in a general, an antenna when the number of coil turns is increased, the gain improves, it is understood that when a certain number of turns is reached coil resistance (copper loss) becomes large, and the gain is attenuated.

Specifically, because the output of the antenna is made up of the output in accordance with Faraday's Law and the output due to the phenomenon of resonance in the antenna, when an antenna is placed in a metal exterior parts, because the Q value significantly decreases, the gain also greatly decreases.

Stated differently, in the usual situation in which an antenna is not in the vicinity of a metal object, almost the entire gain obtained from the antenna is due to the above-noted resonance phenomenon, the coil resistance (copper loss) of the antenna coil is increased, it hinders the resonance phenomenon resulting in a reduction in the gain (Q value), making it impossible to use an extremely increased number of coil turns or to make the coil wire thin.

In contrast, in the case in which an antenna is placed inside a metal exterior parts, because the influence of iron losses (the metal exterior parts) is great, there is a great reduction in the Q value and also a great reduction in gain.

For this reason, the inventors of the present invention did an investigation of a method for improving the gain of an antenna, on the presumption that it is not possible to avoid a reduction in the Q value when an antenna is placed inside a metal exterior parts.

Specifically, as a result of efforts to determine, in the present invention, in the case in which an antenna is placed inside a metal exterior parts, how it is possible to maximize the gain obtained, not by increase in the gain by the Q value (resonance) as in the past, but rather by Faraday's Law.

Figure 10:
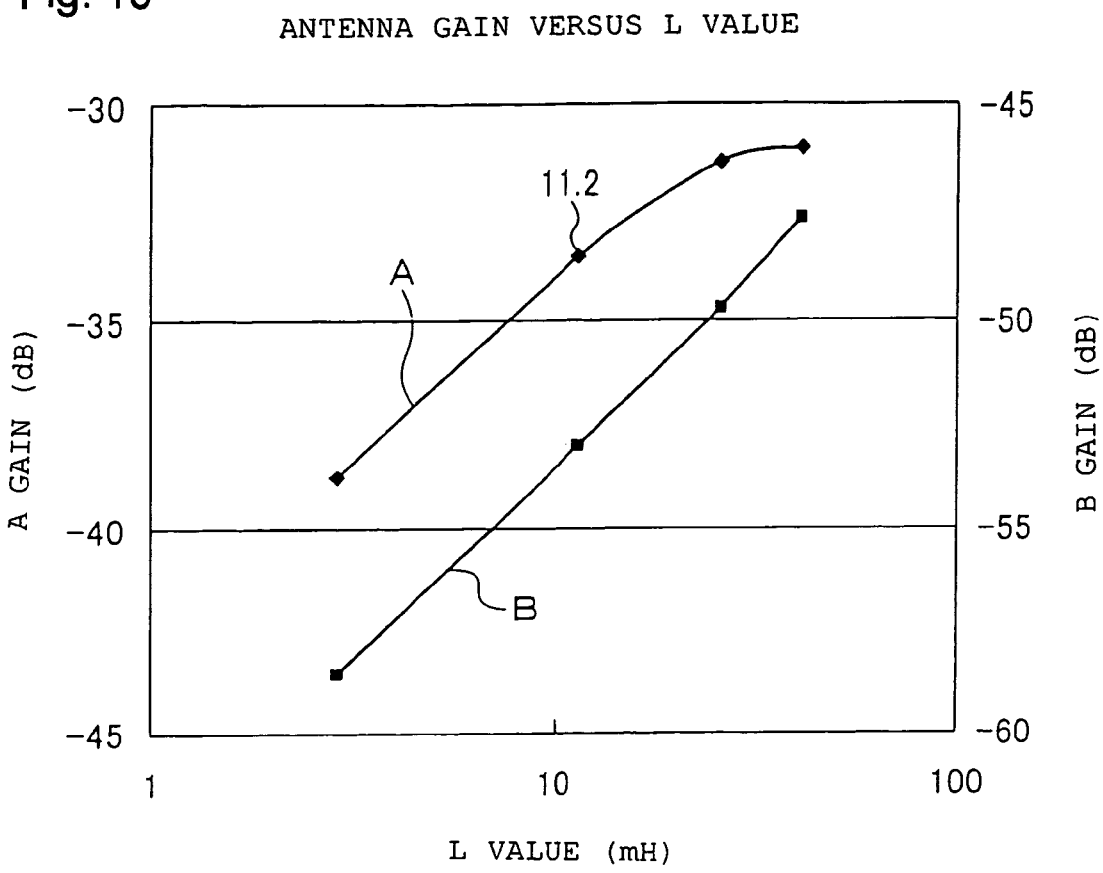
FIG. 10 is a graph showing the relationship between the L value to the gain in the antenna structure.

To verify the above-noted technical concept, the inventor first performed an experiment to measure the relationship between the L value (mH) and the gain (dB) of a prescribed antenna as shown in FIG. 10.

Specifically, in FIG. 10, in the condition in which a prescribed antenna is not inserted into a metal exterior parts, the relationship between the L value and the gain (dB) when receiving a 77.5 kHz radio signal was graphed at A and, with an antenna of the same construction but inserted into a metal exterior parts 31, the relationship between the L value and the gain (dB) when receiving a 77.5-kHz radio signal was graphed at B.

In this experiment, the coil was wound onto a conventional straight core using a known method, and the L value change was adjusted by changing the number of coil turns and changing the coil resistance.

As can be understood from FIG. 10, it was discovered that, in an antenna that is not placed in a metal exterior parts, although the gain increases with an increase in the L value, when the L value exceeds 10 mH there is gradual saturation, however with an antenna inserted into a metal exterior parts the above-noted saturation phenomenon does not occur, and there is a linear increase in gain in proportion to the increase in the L value.

That is, the above-noted experimental results indicate that, while in the case of placing an antenna into a metal exterior parts there is a prominent drop in gain accompanying the resonance phenomenon, there is only a very small attenuation level relative to the gain due to Faraday's Law.

The inventors came to the judgment after additional investigation that, from the results shown in FIG. 10, with an antenna 32 used in the metal exterior parts, because there is a linear increase in gain with an increase in the L value, it is desirable that the number of turns of the coil and the L value be made large.

When the number of coil turns in made large, however, because the capacity of the antenna itself increases, there is a limit imposed with regard to the resonant point of the antenna, this inevitably establishing an upper limit.

Given the above, the inventors made the judgment that, taking the capacitance of the antenna coil to be normally approximately 10 pF and because the lowest frequency used is 40 kHz, making the calculation of the L value of the antenna 32 from the equation $f=\frac{1}{2}\pi\sqrt{LC}$ as 1584 to 1600 mH, it is desirable that the L value be 1600 mH or smaller.

In practice, if we consider that including, in addition to the capacitance of the coil of the antenna, the capacitance of the parasitic capacitance of the substrate and ICs, because in a situation in which a parasitic capacitance of approximately 20 pF can be in envisioned, the L value is judged to be from 792 to 800 mH, it is desirable to use an antenna having that the L value be 800 mH or smaller.

Additionally, thinking practically, at the frequencies used, the highest frequency currently used is 77.5 kHz (Germany), and making a judgment based on the assumption of used in that frequency band, the L value of the antenna 32 under those circumstances, determined from the above-noted capacitance value an the frequency, would be approximately 211 to 220 mH, and it would be desirable to use an antenna 32 having an L value of 220 mH or greater.

Furthermore, it is desirable that the lower limit of the L value of the antenna 32 in the present invention be approximately 20 mH.

Although the minimum output demanded from the antenna depends upon the capability of the receiving IC, it can be envisioned that, if the minimum output demanded from the antenna is 50 dB, the lower limit of the L value from FIG. 10 is desirably made 25 mH, if the minimum output demanded from the antenna is 51 dB, the lower limit of the L value from FIG. 10 is. desirably made 20 mH, and further if the minimum output demanded from the antenna is desirably made 52 dB, the lower limit of the L value form FIG. 10 is 15 mH.

The L value judged to be preferable in the above-noted present invention, considering that the L value of an antenna in a radio controlled time piece of the past was at most 2 to 13 mH, is understood to be a special value.

Figure 11:
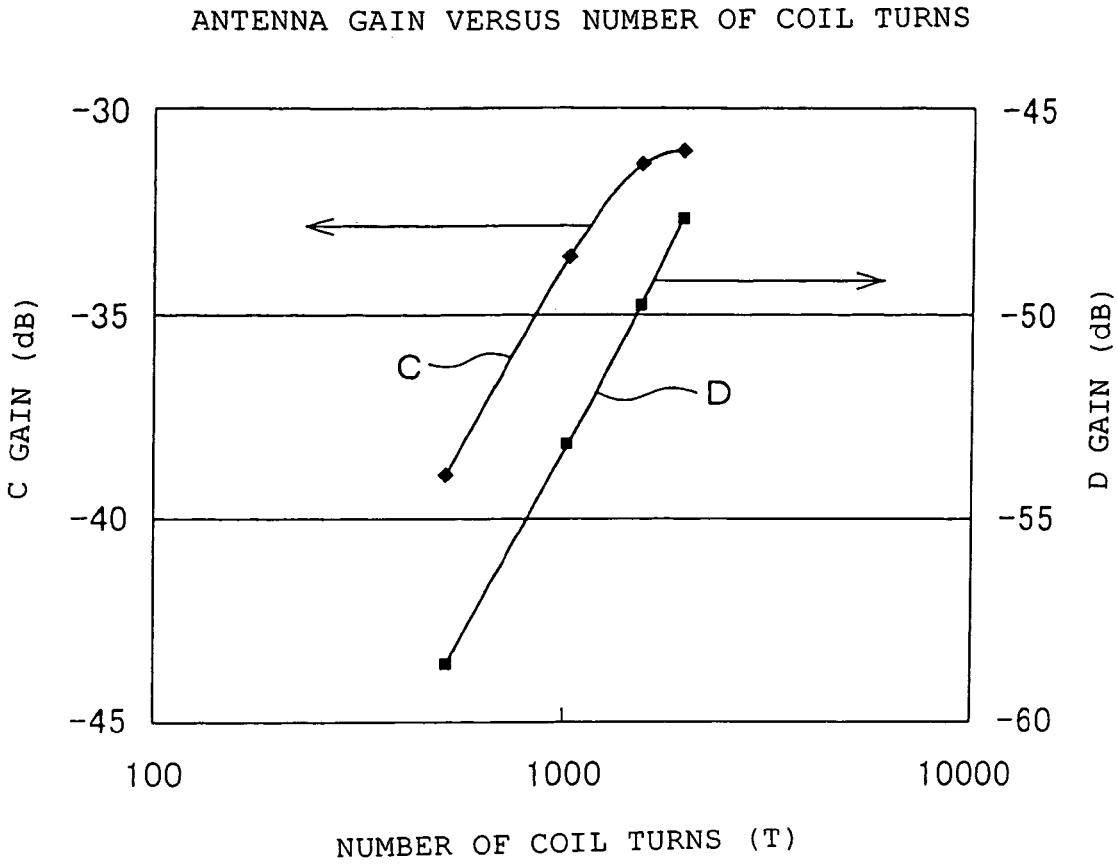
FIG. 11 is a graph showing the relationship between number of turns (T) of the antenna structure and the gain.

Next, we will investigate the relationship between the number of coil turns (T) and the gain (dB) of the antenna, the results of that investigation being shown in FIG. 11.

Specifically, in FIG. 11, similar to the experiment of FIG. 10, in the condition in which a prescribed antenna is not inserted into a metal exterior parts, the relationship between the number of coil turns (T) and the gain (dB) when receiving a 77.5-kHz radio signal was graphed at C and, with an antenna of the same construction but inserted into a metal exterior parts 31, the relationship between the number of coil turns (T) and the gain (dB) when receiving a 77.5-kHz radio signal was graphed at D.

As can be understood from FIG. 11, it is seen that in an antenna that is not placed in a metal exterior parts, although the gain increases with an increase in the number of coil turns (T), when the number of coil turns exceeds 1000, there is gradual saturation, however with an antenna inserted into a metal exterior parts the above-noted saturation phenomenon does not occur, and there is a linear increase in gain in proportion to the increase in the number of turns (T).

In the present invention, therefore, it is judged that it is desirable that, in a radio controlled time piece in which one or both of the side part and cover part of the exterior parts are metal, the number of coil turns (T) of the antenna 32 be 1000 T or greater.

Additionally, as can be understood from FIG. 11, because in the case in which the antenna 32 is used alone, without placing it in a metal exterior parts, at a number of coil turns (T) of 1500 or greater the gain saturates, although in the case in which the antenna 32 is disposed inside a metal exterior parts, even at a number of turns (T) of 1500 or greater, there is an increase in the gain, in a radio controlled time piece in which one or both of the side part or cover part are metal, the judgment is made that it is more effective if the number of coil turns of the antenna 32 is 1500 or greater.

When the number of coil turns (T) of the antenna is increased, however, because there is an increase in the resistance value of the antenna, there is a limit to the number of coil turns (T).

Figure 12:
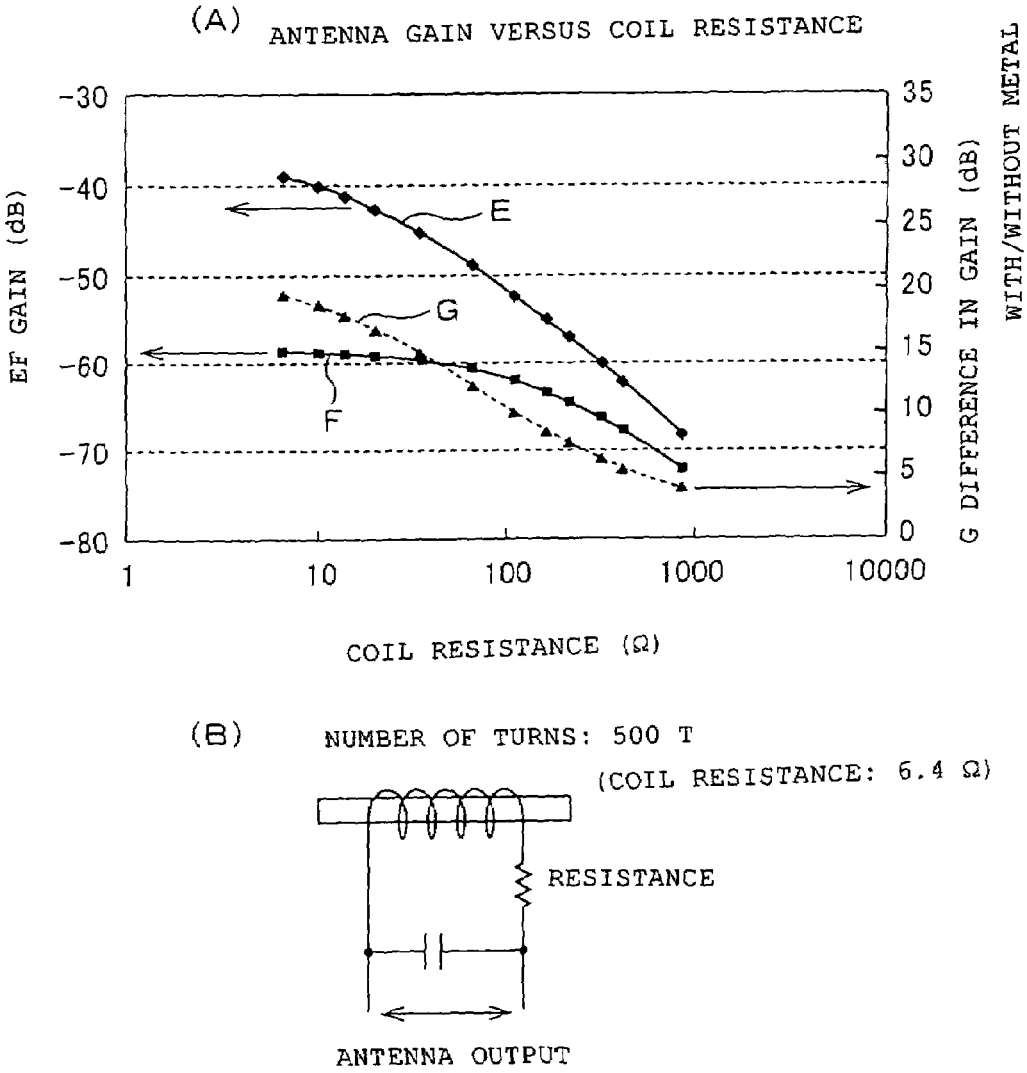
FIG. 12(A) is a graph showing the relationship between the coil resistance value (Ω) and the gain of the antenna structure.
FIG. 12(B) is a drawing showing an example of the configuration of a coil.

Given the above, the inventors carried out an experiment as shown in FIG. 12, similar to the experiment shown in FIG. 10, under the condition in which a prescribed antenna is not inserted into a metal exterior parts, and the inventors graphed the relationship between the coil resistance (Ω) and the gain (dB) of the antenna 32 when receiving a 77.5 kHz radio signal at E.

And the inventors graphed the same relationship at F under the condition in which the antenna having the same construction as mentioned above, is inserted into the metal enclosure, when receiving a 77.5 kHz radio signal.

A relationship between the coil resistance (Ω) and the gain (dB) of the antenna 32 and a relationship between the coil resistance(Ω) of the antenna 32 and a difference in gains obtained when the antenna is in proximity to the metal exterior parts and that obtained when it is not in proximity thereto, was graphed at G.

In the experiment shown in FIG. 12, the adjustment of the coil resistance (Ω) was done by appropriate combining of the resistance values as indicated in FIG. 12(B).

As can be understood from FIG. 12(A), even if the antenna 32 not using a metal exterior parts is used alone, and even in the case in which the antenna 32 is disposed inside a metal exterior parts, there is reduction in the gain with an increase in the coil resistance value (Ω).

When observing graph G, which shows the difference in the gain between the above-noted graphs E and F, we can see that when the coil resistance value (Ω) reaches or exceeds 1 kΩ, there is no longer any change in the difference in gain between the case in which the antenna 32 uses a metal exterior parts and the case in which the antenna is used inside a metal exterior parts, the difference in gain being constant in the region of approximately 3 to 4 dB.

In contrast to the idea of the past that, in the case in which a metal object having electrical conductivity is placed in the vicinity of or in contact with an antenna for the purpose of receiving a radio signal, the radio signal is absorbed by the metal body, the result being that the radio signal does not reach the antenna, thereby lowering the resonant output of the antenna and lowering the Q value, the results of an active investigation done by the inventors are that the above-noted grasp of the problem in the past was in error, and that even in the case in which a metal object having electrical conductivity exists in proximity to or in contact with the antenna, the radio signal substantially reaches the antenna, and in the non-resonant case although the flow of magnetic flux caused by an external radio signal attempting the enter the time piece is somewhat attenuated (for example, approximately 3 dB), the radio signal reaches the antenna without hindrance, and this has been verified to agree with the facts.

The problem is that, when the antenna resonates, the magnetic force lines (magnetic flux) exiting the magnetic core of the antenna are pulled into the metal object, in which eddy currents are generated, thereby resulting in an attenuation of the magnetic energy, lowering the output from the antenna, so that normal reception is not possible.

Figure 4:
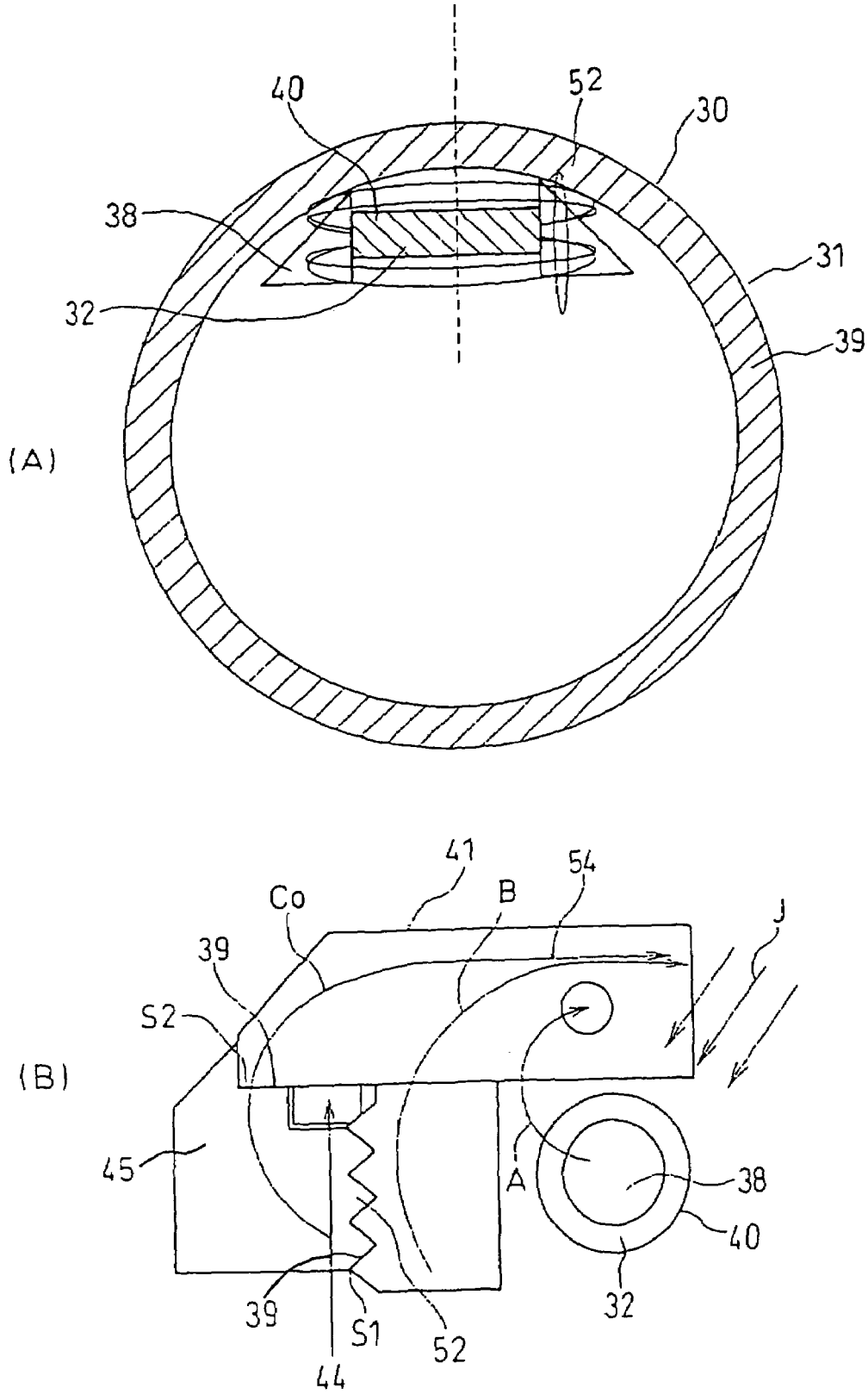
FIG. 4(A) is a drawing showing an example of the shape of the joining surface between the body member and the caseback member and the positional relationship of the antenna.
FIG. 4(B) is a partial cross-sectional view of FIG. 4(A).
Figure 5:
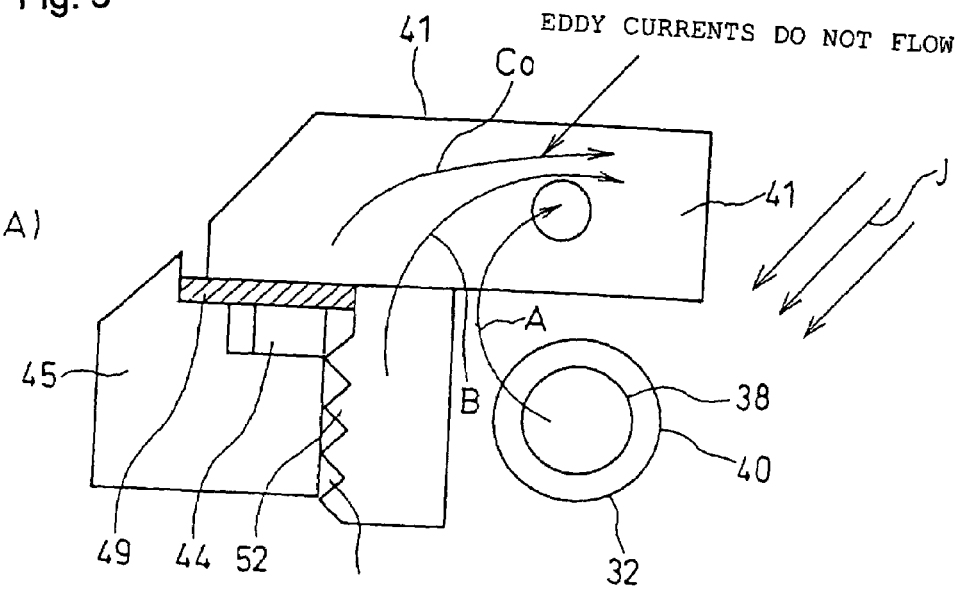
FIG. 5(A) is a partial cross-sectional view showing a different specific example of a metal exterior parts in the present invention.
FIG. 5(B) is a graph showing the relationship between the central angle of the fan-shaped region and the gain of the antenna.
Figure 5:
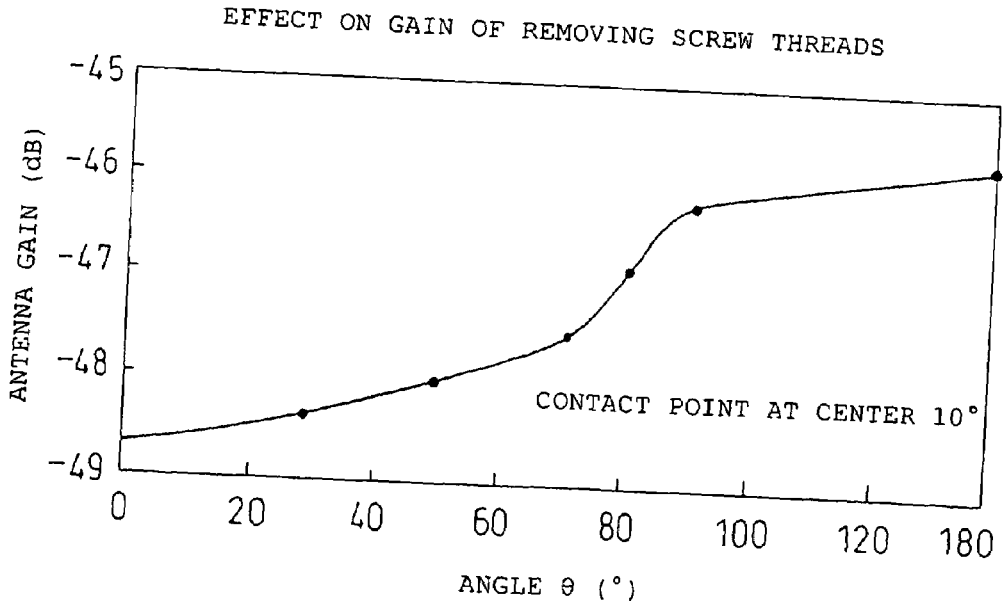

By way of detailed description of the above-noted problem, in FIG. 4, it was found that, in the case, for example, in which the antenna 32 is placed within a metal exterior parts 31 of the time piece 30 having a caseback made of metal and an attempt is made to receive a radio signal, although the flow of magnetic flux J caused by an external radio signal attempting to enter the electronic time piece 30 is somewhat attenuated (for example, approximately 3 dB), the radio signal reaches the antenna 32 without hindrance, the magnetic flux of the radio signal is received by the antenna 32 and, when the antenna 32 resonates, that is, when there is mutual alternation between electrical energy and magnetic energy, the flows A, B, and $C_0$ of resonant magnetic flux output from the ends of the magnetic core 38 of the antenna 32 are pulled into the metal exterior parts 31, which is a metal material, in which eddy currents are generated, thereby causing absorption of the energy of the resonant magnetic flux flow 7, resulting in a reduction in the resonant output from the antenna 32.

That is, if a characteristic value of the antenna 32 is defined as the Q value, because this Q value indicates the ratio of the output to the input of the antenna 32, Q=100 indicates an output characteristic to the effect that the output is 100 with an input of 1, and the higher the Q value is, the more superior is the antenna is judged to be.

That is, the higher the Q value is, the better the performance of the antenna is judged to be or, stated differently, the Q value is an index of the magnitude of the energy loss.

A specific example of a method that can be used for measuring the Q value is, for example, as noted in the specification of the Japanese Patent Application 2002-264985, which has already been filed by the inventors.

From the above-noted results, if the coil resistance (Ω) value is 1 kΩ or less, because it can be envisioned that the contribution to the effect on gain of the antenna 32 used within a metal exterior parts is greater than the effect on gain in the case in which the antenna does not use a metal exterior parts, it is desirable that the coil resistance (Ω) value of the antenna 32 in the present invention be 1 kΩ or less.

In general the thickness of a time piece is thought to approximately 10 mm, and in the case in which the width of the antenna coil is 20 mm, the coil core thickness is 1 mm, the wire and conductor diameters of the coil wires are 60 μm and 65 μm respectively, and the coil resistance is thought to be 1 kΩ, 25000 T is the limit of the number of coil turns.

Figure 13:
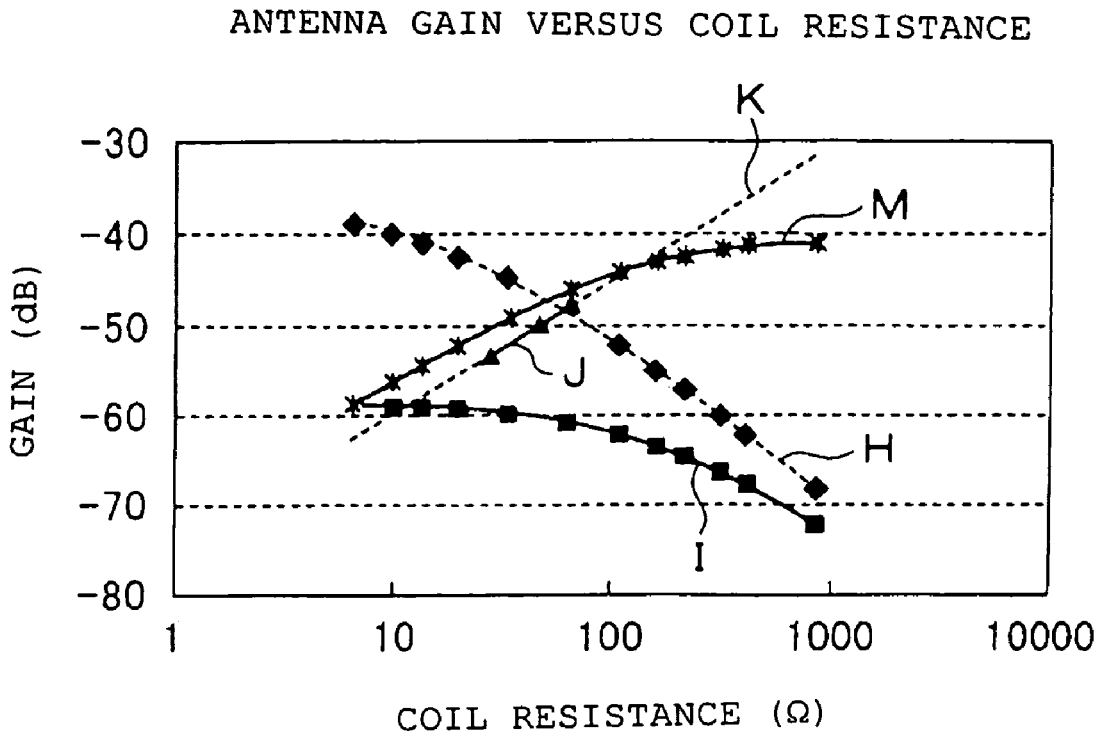
FIG. 13 is a graph showing the relationship between the coil resistance value (Ω) and the gain of the antenna structure.

More precisely, with the number of coil turns of the data of FIG. 10 replaced by the coil resistance values of those samples, as shown in FIG. 13 which is combined with the data of FIG. 12, in the condition in which the antenna 32 is not placed in a metal exterior parts, the relationship between the coil resistance (Ω) value and the gain (dB) of the antenna 32 when receiving a radio signal at 77.5 kHz was graphed at H, and the relationship between the coil resistance (Ω) value and the gain (dB) of the antenna 32 inserted into a metal exterior parts when receiving a radio signal at 77.5 kHz was graphed at I.

These graphs H and I are substantially the same as the graphs E and F of FIG. 12.

The graph J in FIG. 13 shows the relationship between the coil resistance (Ω) and the gain (dB) of an antenna of the same structure as above, inserted into a metal exterior parts when receiving a radio signal at 77.5 kHz, as the number of coil turns is varied from 1000 to 2000 T, and shows that when the number of turns (T) increases there is an improvement in the gain.

Graph K is an graph fitted approximately to the graph J.

The graph M is a graph that shows the balance between the ratio of decrement in gain due to the increment of the coil resistance (Ω) as indicated in graph I and the gain increment due to the increment in coil resistance caused by the increment in the number of coil turns (T).

As is clear from the graph M of FIG. 13, it is understandable that a balance between the increment and decrement in gain is saturated as the coil resistance (Ω) becomes higher than around 396Ω, so that is it understood that there no effect is achieved by increasing the coil resistance (Ω) beyond 400Ω.

It is therefore desirable that the coil resistance (Ω) of the antenna 32 in the present invention be made 400Ω or smaller.

Additionally, in the present invention, if it is considered that, in the case of using a metal exterior parts it is most efficient to use the antenna 32 in a region in which the gain is not only high but has little variation, it can be envisioned, as can be understood from the graph F in FIG. 12, that it is desirable that the coil resistance (Ω) of the antenna 32 be used in the condition of 100Ω or less.

It is also desirable that the lower limit value of the coil resistance (Ω) of the antenna 32 be approximately 18Ω.

Specifically, if the minimum output required from the antenna is −51 dB, from FIG. 11, the number of turns is 1400 T, and in the case of the usual coil with a wire diameter of 110 μm and a conductor diameter of 100 μm wound on an antenna having a width of coil winding portion of 20 mm and a thickness of core is 1 mm, the resistance is 18Ω, this becoming 22Ω in the case of a wire diameter of 85 μm and conductor diameter of 80 μm, 30Ω in the case of a wire diameter of 70 μm and a conductor diameter of 65 μm, and 38Ω in the case of a wire diameter of 65 μm and a conductor diameter of 60 μm, this region being taken to be the limit.

The coil resistance (Ω) of an antenna of a radio controlled time piece of the past was only approximately 20Ω, and the level of coil resistance (Ω) used in the present invention is significantly higher than that.

From the results of the above-described experiments, in the case in which the antenna 32 is placed in a metal exterior parts in the present invention, even if the coil resistance (copper loss) of the antenna increases, there is only a very small reduction in the Q value and, stated differently, even if the wire diameter is small and the number of turns are the same, there is little change in the Q value and gain G.

The antenna gain of the antenna 32 is improved by an increase in the number of coil turns.

As a result, in the case in which the antenna s placed inside a metal exterior parts, by using a design that makes the coil wire thin and also increases the number of turns it is possible to improve the gain.

In the condition in which the antenna 32 of the past was not inserted into a metal exterior parts, although the case in which the coil wire diameter was large, such as a coil wire diameter of 0.1 mmΦ having a small resistance value, obtained a better gain than the case in which the coil wire diameter was small, such as a coil wire diameter of 0.06 mmΦ having a large resistance value, in the case such as in the present invention in which the antenna 32 is placed inside a metal exterior parts, there is no difference in the gain characteristics.

In the present invention, therefore, it is desirable that the antenna 32 be configured with thin coil wire, so as to enable the formation an antenna 32 with smaller dimensions.

It is therefore desirable in another embodiment of the antenna of the present invention, that the coil wire diameter be 0.1 mmΦ or smaller, and preferably 0.06 mmΦ.

Although the above-noted antenna 32 is basically an antenna of the form in which a prescribed number of turns (T) of coil wire are wound around the usual straight antenna core part, the antenna 32 is not restricted to this configuration and can be applied to any form of antenna, in particular application being possible to an antenna having a configuration as disclosed in Japanese Patent Application 2002-297095 already filed by the inventors.

Additionally, the configuration relationship and positional relationship between the antenna 32 and the metal exterior parts 31 is an important factor in the present invention.

Therefore, the preferred configuration relationship and mutual positional relationship between the antenna 32 and the metal exterior parts 31 in the present invention will be described in detail below.

Specifically, in an electronic device 30 of the present invention, it is desirable that in the relationship between the metal exterior parts 41 and the antenna 32 housed within the enclosure, the thickness of the body member of the metal exterior parts such as a thickness of the body portion 45, or the thickness of the caseback member 41, and the distance from the antenna to the body member 45 or the caseback member 41 be established based on the receiving sensitivity.

If the thickness of the body member or the thickness of the caseback member and the distance from the antenna to the body member 45 or the caseback member 41 are established based on the receiving sensitivity, because it is possible to reduce disturbance of the resonance phenomenon in the vicinity of the antenna caused by metal material, it is possible to improve the receiving sensitivity even in the case of a metal exterior parts 31. By doing this, even in the case of a radio controlled time piece, it becomes possible to use titanium or stainless steel and the like for the body member, the caseback member, and the bezel and the like, and it is possible to improve the functionality of the radio controlled time piece in terms of both mechanism and appearance without reducing the receiving sensitivity.

Additionally, it is possible to achieve a further improvement in the receiving sensitivity by means of the material of the body member 45 or caseback member 41, the shape of the caseback member, the positional relationship between the antenna 32 and the body member 45 or caseback member 41, and by adding a non-magnetic material and the like. With regard to the thickness of the body member or caseback member and the distance from the antenna to the body member or caseback member, the most effective values were determined by repeated experimental verifications.

The configuration of the metal exterior parts 31 and antenna 32 used in the present invention are specifically described below, with reference made to drawings.

Figure 15:
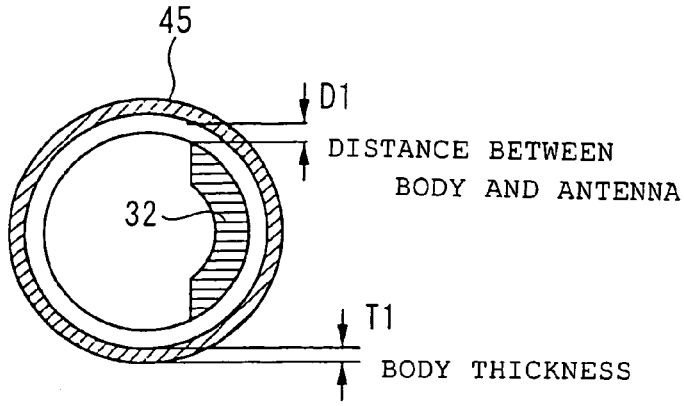
FIG. 15(A) and FIG. (B) are a plan view and a cross-sectional view describing the positional relationship between the metal exterior parts and the antenna.
Figure 15:
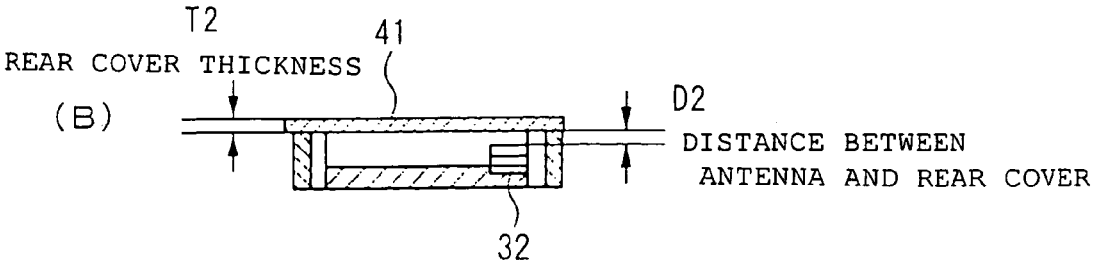

First, in order to investigate the relationship between the receiving sensitivity and the watch case, as shown in FIG. 15(A) and FIG. 15(B), the body member thickness T1 of the body member 45, the distance D1 between the antenna 32 and the inner surface of the body member 45, the caseback member thickness T2 of the caseback member 41, and the distance D2 from the antenna 32 to the inner surface of the caseback member 41 were selected as parameters, and the relationships between these four parameters and the gain, which is the peak height of a signal received by the antenna 32 were determined by experiments.

The body member 45, antenna 32, and caseback member 41 as used in each of the experiments noted below were formed for the experiments in shapes that assumed use in an electronic device 30, including a time piece.

The materials of the body member 45 and the caseback member 41 were selected from stainless steel, titanium, a titanium alloy, gold, a gold alloy, silver, a silver alloy, copper, a copper alloy, brass, aluminum, an aluminum alloy, zinc, a zinc alloy, magnesium, a magnesium alloy, and an ultra-hard metal (an alloy including tungsten carbide and tantalum carbide), and in all of the experiments although there was a difference up or down of several dB, because there was substantially no change in the relationship of gain to any of the parameters (shape of the graph curves), in all of the experiments indicated below, stainless steel (because an austenite-based stainless steel is preferred, for example SUS304, SUS304L, SUS316, SUS316L, or the like) was used for the numbers used in the case of using the body member 45 and the caseback member 41.

In the first experiment, the gain of a signal received was measured while varying the body member thickness T1 from 0 to 5000 μm. In this experiment, an experimental antenna was used that has 1500 turns having a conductor diameter of 65 μm and that was placed inside a body member 45, the distance between the body member 45 and the antenna 32 being set at a constant 1000 μm, and a caseback member 41 having a thickness of 800 μm being used. The distance between the antenna 32 and the caseback member 41 was set at a constant 100 μm, and the experiment was performed by transmitting a 40-kHz signal from a transmitting antenna installed at a prescribed position.

Figure 16:
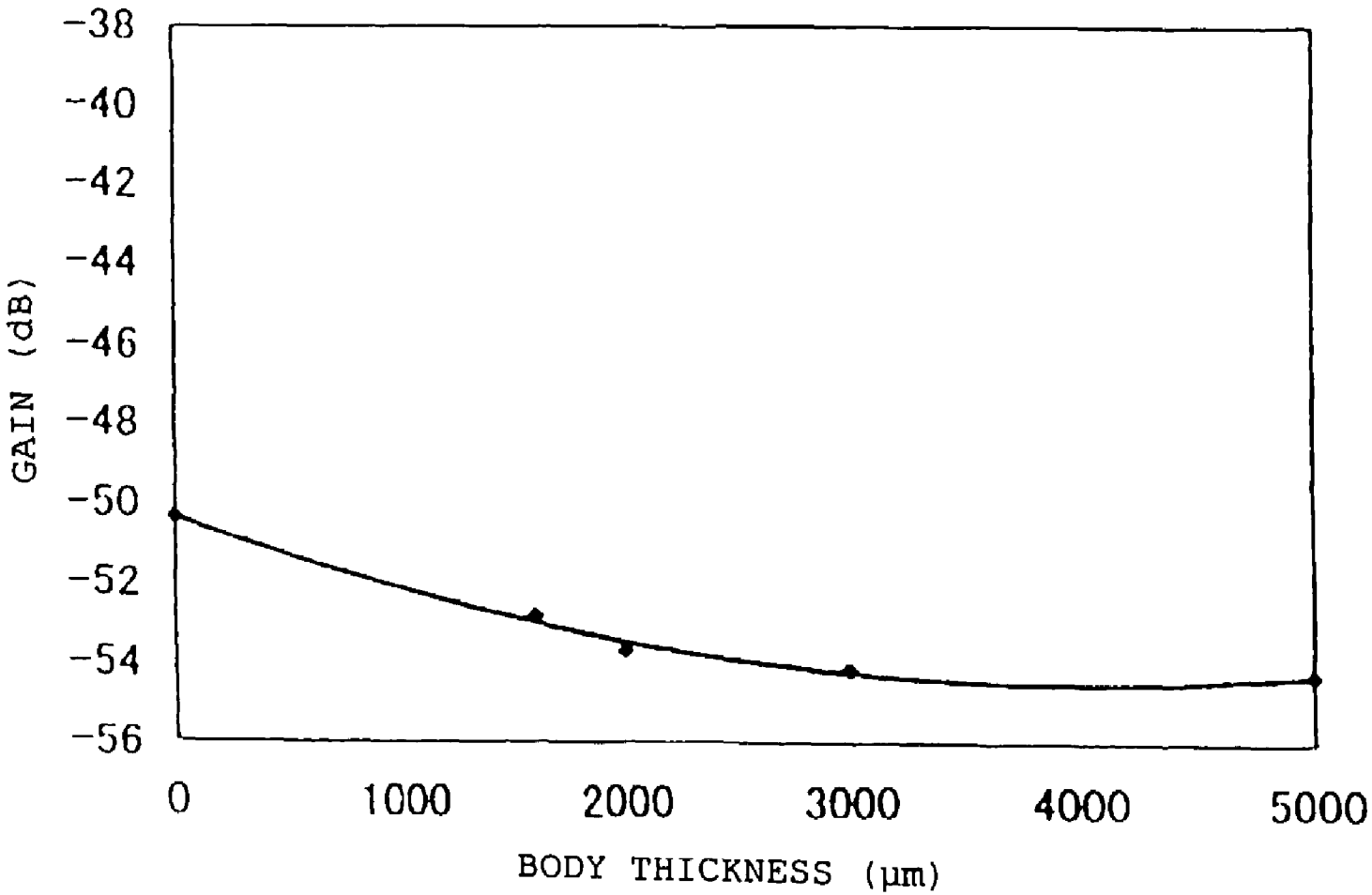
FIG. 16 is a graph showing the relationship between the body member thickness and the antenna gain in an electronic device according to the present invention.

The results of the above, as shown in FIG. 16, were that the gain of the received signal was gradually reduced from −50 dB as the body member thickness T1 was increased from 0 μm (the condition in which there is no body member 45), the reduction saturating when the body member thickness T1 reached 5000 μm. The solid line shown in FIG. 16 is an approximated curve determined from the experimental data.

According to the first experiment, it was discovered that when the body member thickness T1 exceeds 5000 μm, the reduction in gain saturates and becomes constant, the value at that time being the minimum value. For this reason, if the body member thickness T1 is set in the range 0 to 5000 μm, it is possible to improve the gain relative to the above-noted minimum value. In the above-noted range, if a practically usable strength is considered as the watch case, it is preferable that the body member thickness T1 be set in the range from 300 μm to 5000 μm, which is the largest practical value. Considering the outer appearance, machinability, and the corrosion resistance and the like of the case of the electronic device 30, that is, of the metal exterior parts 31, in order to form the most suitable body member, it is preferable that the body member thickness T1 be set in the range from 500 to 2000 μm.

Figure 17:
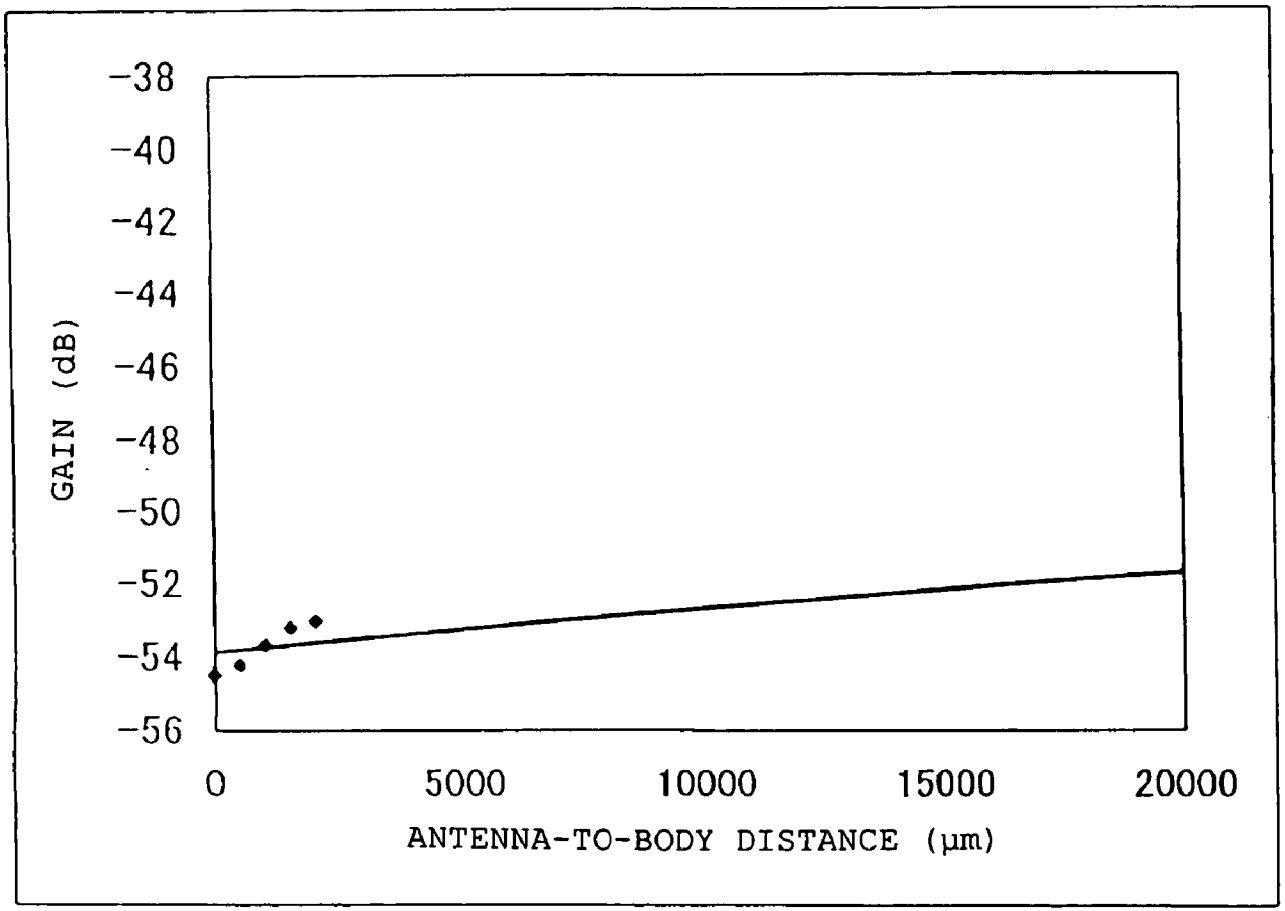
FIG. 17 is a graph showing the relationship between the antenna gain and the distance between the body member and the antenna in the present invention.

In the second experiment, the gain of a signal received was measured while varying the distance D1 between the antenna 32 and the body member 45 between 0 and 40000 μm. FIG. 17 shows the measurement results for the range 0 to 20000 μm. In this experiment, an experimental antenna 32 was used that has 1500 turns having a conductor diameter of 65 μm and that was placed inside a body member 45, a body member 45 having a thickness of 2000 μm was used and a caseback member 41 having a thickness of 800 μm was used, the distance from the antenna 32 to the caseback member 41 being set at a constant 100 μm, and the experiment was performed by transmitting a 40-kHz signal from a transmitting antenna installed at a prescribed position.

The results of the above, as shown in FIG. 17, were that the gain of the received signal was gradually increased from −54.5 dB at the distance D1 being 0 μm (the condition in which a part of the antenna 32 is in contact with the body member 45) as the distance D1 is increased. In this experiment, because the gain of the received signal in the case when only the caseback member 41 is used(the case in which the body member 45 is removed) is −50.34 dB, when the gain has come up to this value, the increment in the gain at the distance D1 between the antenna 32 and the body member 45 saturates. The distance D1 at which the gain saturates in this manner is 40000 μm, and further distancing the antenna 32 from the body member 45 does not result in an increase in the gain. The solid line shown in FIG. 17 is an approximated curve determined from the experimental data.

According to the second experiment, it was discovered that although as the distance D1 between the antenna 32 and the body member 45 is increased, the gain is increased and the receiving sensitivity becomes better, when the distance D1 exceeds 40000 μm, the increase in the gain saturates and the gain becomes constant.

For this reason, if the distance D1 is set in the range 0 to 40000 μm, it is possible to improve the gain. In the above-noted range, if the size and the like practical for use in a watch case is considered, it is preferable that the distance D1 be set in the range from 500 to 10000 μm.

Figure 18:
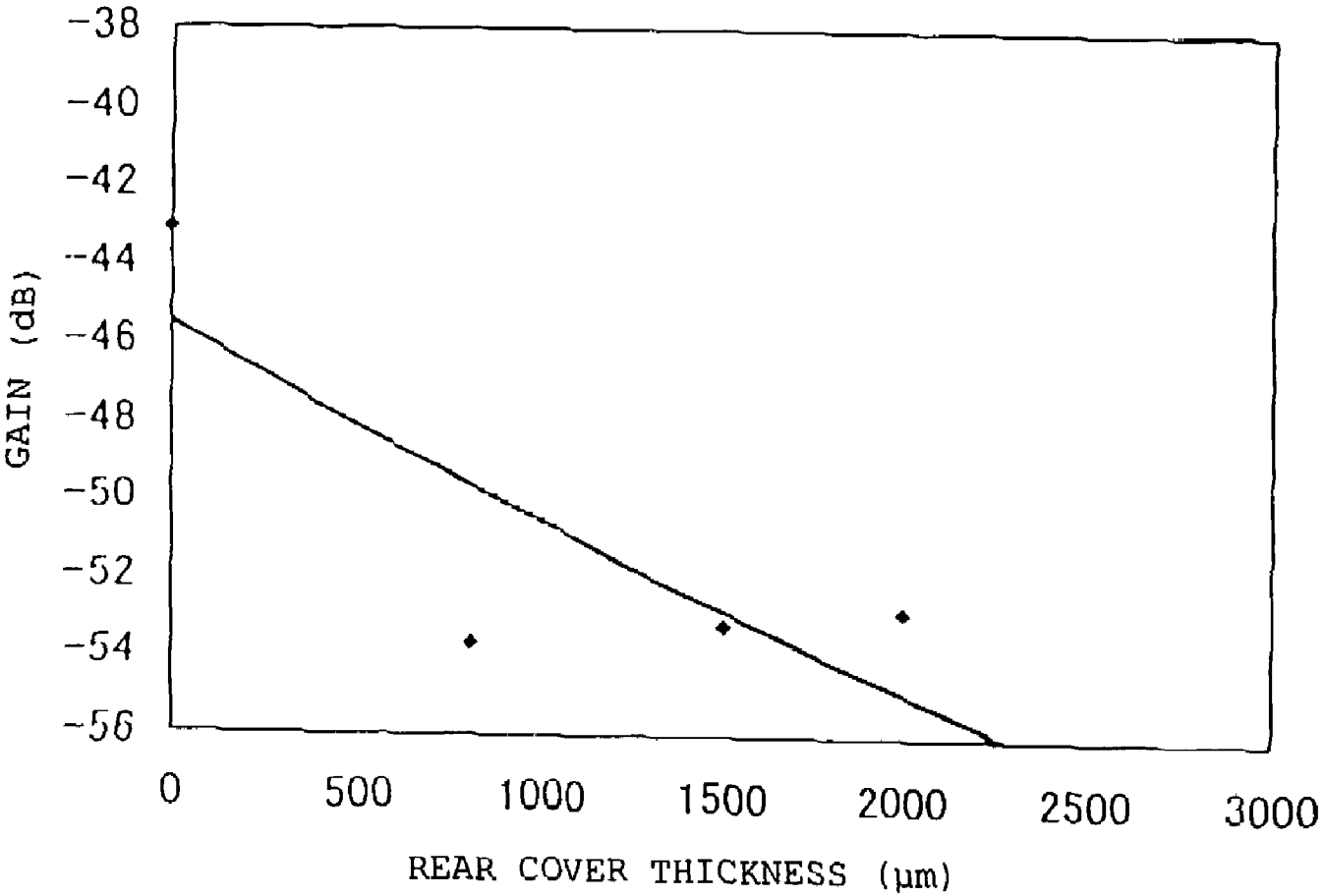
FIG. 18 is a graph showing the caseback member thickness and the antenna gain in the present invention.

In the third experiment, the gain of a received signal was measured while varying the caseback thickness T2 from 0 to 5000 μm. FIG. 18 shows the results of measurements from 0 to 3000 μm. In this experiment, an experimental antenna 32 was used that has 1500 turns having a conductor diameter of 65 μm, the distance from the antenna 32 to the caseback member 41 being set at a constant 1000 μm, a body member 45 having a thickness of 2000 μm was used, and the distance from the antenna 32 to the body member 45 was set at a constant 1000 μm, the experiment being performed by transmitting a 40-kHz signal from a transmitting antenna installed at a prescribed position.

From the results of the above, as shown in FIG. 18, it is understood that the gain of the received signal was drastically decreased as the thickness T2 of the caseback member 41 is changed from 0 μm (the condition in which there is no caseback member 41) at which the gain being approximately −43.4 dB, to 800 μm, while it is also understood that the gain does not change so much when the thickness T2 of the caseback member is changed from 800 μm to 5000 μm. That is, it was discovered that the minimum value occurred when the caseback member thickness T2 is at 800 μm. The solid line shown in FIG. 18 is an approximated curve determined from the experimental data.

The above-noted minimum value presents no problem in actual use, and within the above-noted range with taking practical strength as the metal exterior parts 31 of the electronic device 30 in to account, it is preferable that the caseback member thickness T2 be set in the range from 100 μm to the value 5000 μm, at which the practical maximum occurs. Considering the outer appearance, machinability, and the corrosion resistance and the like of the metal exterior parts 31, in order to form the most suitable caseback, it is preferable that the caseback member thickness T2 be set in the range from 300 to 2000 μm.

In the fourth experiment, the gain of a received signal was measured while varying the distance D2 from the antenna 32 to the caseback member 41 between 0 and 5000 μm. In this experiment, an experimental antenna 32 was used that has 2000 turns having a conductor diameter of 65 μm, a body member 45 having a thickness of 2000 μm was used, and a caseback member 41 having a thickness of 800 μm was used, the distance D1 from the antenna 32 to the body member 45 being set at a constant 1000 μm, and the experiment was performed by transmitting a 40 kHz signal from a transmitting antenna installed at a prescribed position.

Figure 19:
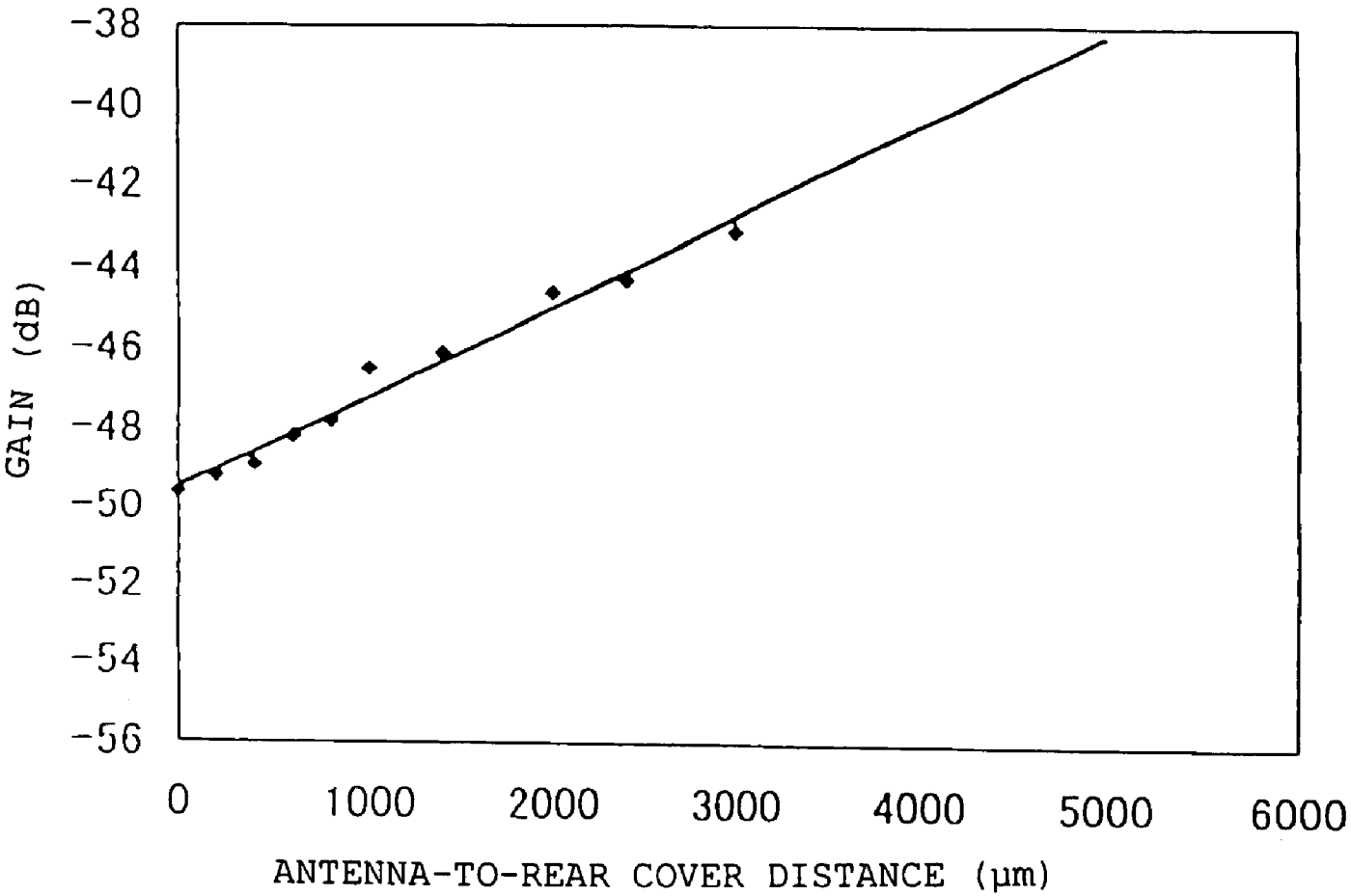
FIG. 19 is a graph showing the antenna gain and the distance between the antenna and the caseback member in the present invention.

The results of the above, as shown in FIG. 19, were that the gain of the received signal gradually increased as the distance D2 was increased from 0 μm (the condition in which a part of the antenna 32 is in contact with the caseback member 41) and the gain at this condition is −49.6 dB. In this experiment, because in the case of the body member 45 being only used (that is, in the case in which the caseback member 41 is removed) the gain is −38.8 dB when the gain has come up to this value, the increment of the gain at the distance D2 formed between the antenna 32 and the caseback member 41 is saturated.

The distance D2 at which the increase in gain saturates in this manner is 5000 μm, and it is not possible to increase the gain by further distancing the antenna 32 from the caseback member 41. The solid line shown in FIG. 19 is an approximated curve determined from the experimental data.

According to the fourth experiment, although the gain increases when the distance D2 from the antenna 32 to the caseback member 41 Is made longer, resulting in a good receiving sensitivity condition, the increase in the gain saturates when the distance D2 exceeds 5000 μm. For this reason, if the distance D2 is set in the range from 0 to 5000 μm, it is possible to improve the gain. Within the above-noted range, considering the maximum practically usable size as a watch case, it is preferable that the distance D2 be set in the range from 100 to 700 μm.

Next, a specific example of an electronic device 30 of the present invention, based on the above-noted experimental results, is described below, with reference made to FIG. 2.

FIG. 2 is a cross-sectional view showing a radio controlled time piece according to the present invention, the basic configuration of which has already been described.

A prescribed space 51 is provided between the movement 42 and the caseback member 41, and the antenna 32 is disposed within the space 51. The antenna 32 is fixed to the lower surface of the movement 42.

In the present invention, the antenna 32 can be disposed so as to be in contact with an inner surface of the metal exterior parts 31, and can alternatively be disposed so that there is a space between the antenna 32 and the inner surface of the metal exterior parts 31.

In this specific example, an austenite-based stainless steel (for example SUS316) is used for both the body member 45 and the caseback member 41. Based on the above-noted experimental results, the body member thickness of the body member 45 is set at 1600 μm, and the distance between the antenna 32 and the inner surface of the body member 45 is set to 2000 μm. The caseback thickness of the caseback member 41 is set to 800 μm, an the distance from the antenna 32 to the inner surface of the caseback member 41 is set to 3000 μm.

In the electronic device 30 configured as noted above, based on a radio signal received by the antenna 32 the CPU within the movement 42 causes the display drive section to operate so as to perform drive to correct the hands 36 at all times. When this is done, although the body member 45 or the caseback member 41 in this specific example are made of metal, because the body member thickness, the caseback thickness, and the distance between the antenna 32 and the body member 45 and caseback member 41 are each set to values based on the experimental results that obtain the best receiving sensitivity, so that there is a reduction in the disturbance of the resonance phenomenon in the vicinity of the antenna, thereby improving the receiving sensitivity.

Furthermore, if a non-magnetic material such as gold, a gold alloy, silver, a silver alloy, copper, a copper alloy, brass, aluminum, an aluminum alloy, zinc, a zinc alloy, magnesium, or a magnesium alloy, having an electrical resistivity of 7.0 μΩ·cm or less is mounted to the inner surface of the caseback member 41 or the inner surface of the body member 45 of the metal exterior parts 31, it is possible to improve the gain by approximately 2 to 3 dB.

Additionally, it is possible to perform hardening treatment such as carburizing on one or both of the body member 45 and the caseback member 41, and there was no reduction in gain noticed by the performance of this carburizing treatment.

In a specific example of the present invention different from the above-noted specific example, although the basic configuration shown in FIG. 2 is the same, the material of the body member 45 and the caseback member 41, the body member thickness of the body member 45, the distance between the antenna 32 and the body member 45, the thickness of the caseback member 41, and the distance between the antenna 32 and the caseback member 41 are set to as to be different from the above-noted specific example.

Specifically, in this specific example the body member 45 and the caseback member 41 are formed from titanium.

In the case of a body member 45 and a caseback member 41 made from titanium, the body member thickness, assuming a standard to accommodate high-pressure waterproofness, is set to a thickness of 2000 μm, which is thicker than the above-noted specific example, and in the same manner the thickness of the caseback is set to 1000 μm.

Because of the relationship with the material of the body member 45 and the caseback member 41, even if the distance between the antenna 32 and the body member 45 and caseback member 41 is made small, because it is still possible to obtain a receiving sensitivity that is not problematical, the distance between the antenna 32 and the body member 45 is set to 500 μm, and the distance between the antenna 32 and the caseback member 41 is set to 400 μm.

In the case of this specific example as well, if a non-magnetic material was mounted to the inner surface of the caseback member 41 or to the inner surface of the body member 45, similar to the case of the above-noted specific example it is possible to improve the gain approximately 2 to 3 dB.

In this specific example, it is possible to perform hardening treatment such as nitriding treatment to the surface of one or both of the body member 45 and the caseback member 41, and there was no reduction in gain noticed by the performance of this hardening treatment.

Figure 22:
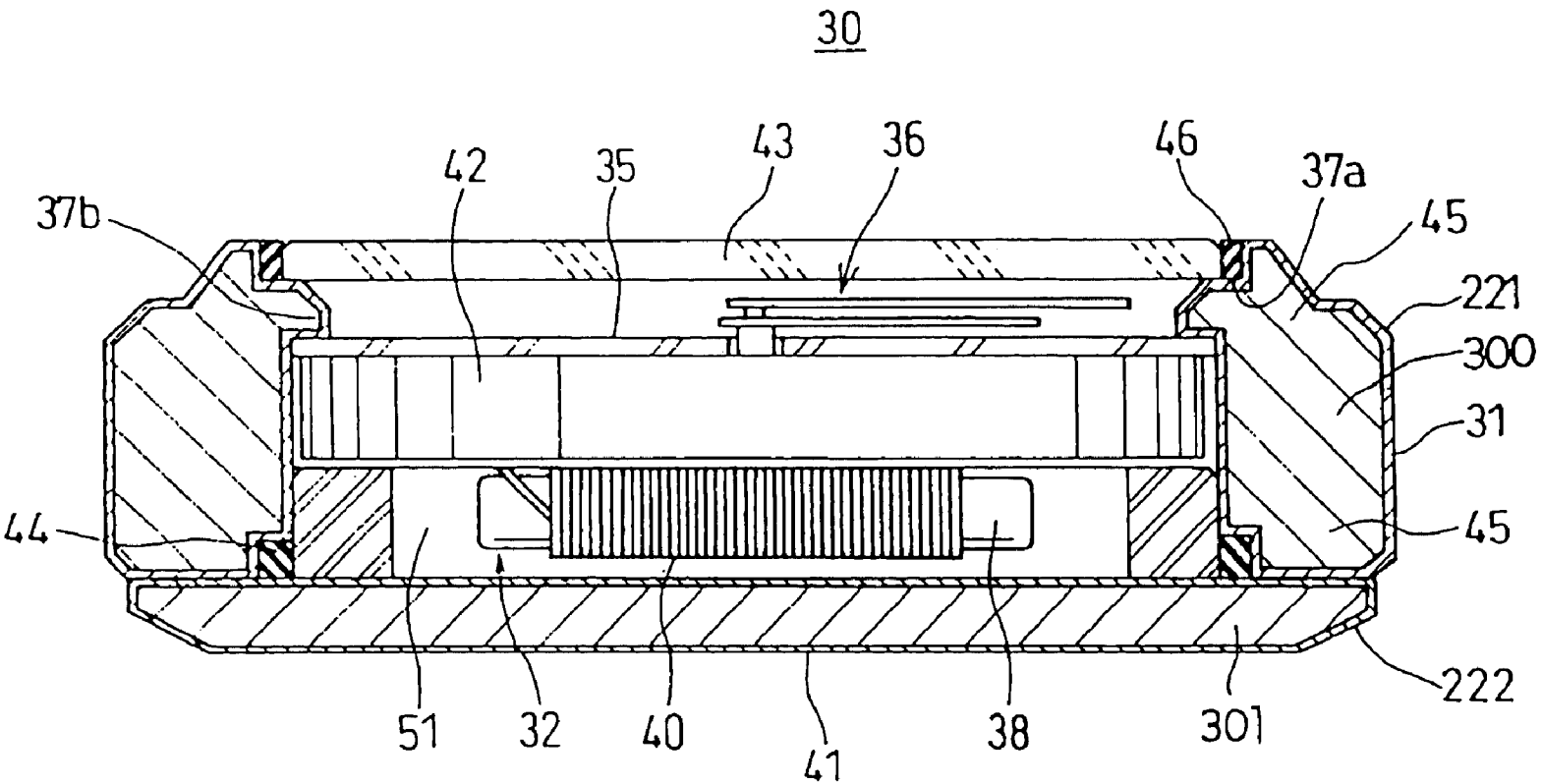
FIG. 22 is a drawing describing the details of the configuration of a radio controlled time piece as a specific example of an electronic device according to the present invention.

Another specific example of a radio controlled time piece according to the present invention shown in FIG. 22 has substantially the same configuration as shown in FIG. 2, but different material is used for the body member 45 and the caseback member 41.

Specifically, in the configuration of FIG. 2, the body member 45 and the caseback member 41 are made of brass, and are given a mirror finish, after which, as shown in FIG. 22, plating layers 221 and 222 of Pd or the like are formed thereon by means of wet plating so as to finish them. The brass material is a non-magnetic material having an electrical resistance value of 7.0 μΩ·cm or lower, which has been verified by experiment to result in a good receiving sensitivity condition, this setting being made along with the setting of the thickness of the body member so as to improve the receiving sensitivity.

The body member 45 and the caseback member 41 of this specific example, with the exception of applying plating, are the same as in the above-noted specific example, the body member thickness being set to 1600 μm and the caseback thickness being set to 800 μm. The distance between the antenna 32 and the body member 45 is set to 2000 μm and the distance from the antenna 32 to the caseback member 41 is set to 3000 μm.

The plating layers 221 and 222 of the body member 45 and the caseback member 41 are formed by the wet plating method shown below.

First, in order to form the plating underlayer, plating is applied to the main body parts 300 and 301, in a plating bath (composition: $Na_2SnO_3 \cdot 3H_2O$ 60 g/l (liter), CuCN 20 g/l, $K_2SO_3H$ 10 g/l, KCN (free) 30 g/l, KOH 60 g/l, Zn $(CN)_2$ 5 g/l), at a temperature of 50° C. and a current density of 2.4 A/dm$^2$, a pH of 12.5, a precipitation rate of 0.33 μm/minute, for 6 minutes. By doing this, a Cu—Sn—Zn alloy underplating layer is formed on the surfaces of the main body parts 300 and 301 to a thickness of approximately 2 μm.

Next, an Sn—Cu—Pd alloy plating layer is formed on the underplating layer under the following conditions. The plating bath: (composition: $Na_2SnO_3 \cdot 3H_2O$ 60 g/l (equivalent amount of Sn of 26.7 g/l), CuCN 20 g/l (equivalent amount of Cu of 14.2 g/l), $K_2SO_3H$ 10 g/l, KCN (free) 30 g/l, KOH 60 g/l, $K_2Pd(CN)_4 \cdot 3H_2O$ 30 g/l (equivalent amount of Pd of 9.3 g/l)). Plating conditions: bath temperature 50 to 55° C., current density 2.0 A/dm$^2$, current efficiency 47.8%, pH 12.5 to 13, precipitation rate 0.33 μm/minute, time 9 minutes. By this plating, a Sn—Cu—Pd alloy plating layer is formed on the underplating layer with a thickness of approximately 3 μm, a hardness (Hv) of approximately 300, and a density of 9.6 g/cm$^3$. Upon simple quantization of this composition of this plating layer using a scanning electron microscope and an X-ray micro-analyzer, it was verified that the composition was a tri-element alloy of 17.12% by weight of Sn, 44.22% by weight of Cu, and 38.66% by weight of Pd.

After the above, plating was done onto the Sn—Cu—Pd alloy plating layer using the following conditions so as to form a finishing plating layer. Plating bath: (Japan Pure Chemical Co. Ltd. Parabright SSS (product name)). Plating conditions: temperature 55° C., current density 1.5 A/dm$^2$, pH 7.6, precipitation rate 0.33 μm/minute, time 6 minutes. By this plating, a Pd plating layer having a thickness of approximately 2 μm and having a white gloss is formed so as to complete the plating layers 221 and 222.

The body member 45 and caseback member caseback member 41, onto which are formed the above-noted plating layers 221 and 222, even after immersion for 24 hours in synthetic sweat with a composition of sodium chloride 9.9 g/l, sodium sulfate 0.8 g/l, urea 7.1 g/l, aqueous ammonia 0.19 g/l, saccharose 0.2 g/l, and lactic acid (50%) 0.8 ml/l, so as to carry out anti-corrosion test due not exhibit surface coloration and have good corrosion resistance. The body member 45 and the caseback member 41, even when subjected to heat testing at 200° C. for 5 hours, showed absolutely no peeling of the plating layers 221 and 222, and had good heat resistance.

In this specific example as well, although the body member 45 and the caseback member 41 are formed from metal, because the body member thickness, the caseback thickness, the distance between the antenna 32 and the body member 45 and caseback member 41 are each set based on the experimental results that achieve the best receiving sensitivity, disturbance to the resonance phenomenon in the vicinity of the antenna is minimized, and the receiving sensitivity is improved. Additionally, because surface treatment is done of the body member 45 and the caseback member 41, the required corrosion resistance and heat resistance for used as a time piece are provided and, because a white gloss with a feeling of weight and high quality is provided, the result is a high quality outer appearance.

In all of the foregoing specific examples, as shown by the caseback member 41 of FIG. 22, if the inside surface of the caseback member 41 is made flat without a rising part and the caseback member 41 is provided with a secondary planar shape, there is a reduction in the disturbance of the resonance phenomenon in the vicinity of the antenna 32 and it is possible to improve the receiving sensitivity by approximately 2 dB, comparing with a case in which the rising part is provided.

In order to achieve a more compact, thinner time piece, it is possible to include a consideration of the directionality of the antenna 32, and to make the distance between the antenna 32 and the body member 45 or the caseback member 41 zero.

Additionally, it is possible to consider the directionality of the antenna 32 while disposing the antenna 32 so that an outer surface of the antenna 32 is parallel to an inner surface of the body member 45 or an inner surface of the body member 45, or while disposing the antenna 32 so that one end surface thereof is substantially standing upright, perpendicular to an inner surface of the caseback member 41.

Although the metal exterior parts 31 in the above-noted specific example is formed by a body member 45 and a caseback member 41, it is possible to provide a bezel or ring on the top part of the body member 45. Additionally, as described above, if any of the body, the bezel, and the caseback member is formed of a non-magnetic material, it is possible to further improve the receiving sensitivity. By making the bezel or the like separate from the body member 45, it is possible to improve the receiving sensitivity.

Rather than forming all of the body member, the bezel, and the caseback from a non-magnetic material, even if a part of these is formed of a non-magnetic material, the receiving sensitivity can be improved.

In the above-noted case, it is effective and preferred that the portion of the antenna 32 that is projected in a planar manner or that only the end part of the antenna 32 be made of a non-magnetic material.

It is possible not only to use one type of metal and non-magnetic material, but also to use a combination of a plurality of types of metals and non-magnetic materials.

In selecting the material used for the body member 45 and the caseback member 41, similar to the above-described experiments, an antenna for actual use was placed in the body member 45 and caseback member 41 for practical formed of the material to be used, and an experiment was performed in which a signal was transmitted from a transmitting antenna installed at a prescribed position.

The results of this experiment indicate that, in the case of gold, a gold alloy, silver, a silver alloy, copper, a copper alloy, brass, aluminum, an aluminum alloy, zinc, a zinc alloy, magnesium, a magnesium alloy, and an ultra-hard metal (alloy including tungsten carbide), compared to the case of stainless steel, titanium, a titanium alloy, and tantalum carbide, the gain was 2 to 3 dB higher. A similar experiment demonstrated that not only in the case in which the exterior parts is made of metal for which the receiving sensitivity is good, but also in the case in which the exterior parts is made of a metal for which the receiving sensitivity decreases, by providing a metal for which the receiving sensitivity is good at one part, it is possible to improve the receiving sensitivity of the antenna inside the exterior parts.

The electrical resistance values metals used in the experiment were compared, and it was discovered that one with an electrical resistivity value of 7 μΩ·cm or less maintained good receiving sensitivity. As a result, it was found that if a non-magnetic material such as gold, a gold alloy, silver, a silver alloy, copper, a copper alloy, brass, aluminum, an aluminum alloy, zinc, a zinc alloy, magnesium, a magnesium alloy, or an ultra-hard metal is used for all or part of the metal exterior parts, even with a metal exterior parts it is possible to achieve good receiving sensitivity.

Additionally, it was demonstrated that even in the case of a metal exterior parts of an electronic device made of a metal having a high electrical resistivity, such as stainless steel, titanium, a titanium alloy, or tantalum carbide, if one part thereof is a part made of an above-noted non-magnetic material, a receiving sensitivity can be achieved.

Additionally, with regard to the material of the body member body member 45 and the caseback member 41, although there are cases in which, in order to achieve reach coloring, a resin part is used in the bezel or the like, or a resin decoration is mounted to the side of the body member as a decoration, even in the case of such configurations, it is obvious that cases in which metal is used in the basic configuration fall under the scope of the metal exterior parts of the present invention.

In the present invention, it is also desirable that the configuration be such that the inner surface of the metal exterior parts 31 and the outer surface of the antenna are substantially parallel, or that the inner surface of the caseback of the metal exterior parts and the outer surface of the antenna are substantially parallel.

Additionally, in the present invention it is preferable that the caseback member of the metal exterior parts be configured so that it has a secondary planar shape.

In the present invention it is also preferable that one end surface of the end parts of the antenna be substantially perpendicular to an inner surface of the caseback member caseback member 41 of the metal exterior parts 31.

In the present invention, it is desirable that at least one non-magnetic member having an electrical resistivity of 7.0 μΩ·cm be fixed to the inner surface of the metal exterior parts 31, and further desirable that the non-magnetic material be at least one of gold, silver, copper, brass, aluminum, zinc, magnesium, or an alloy thereof.

Additionally, in the present invention it is preferable that the antenna 32 be configured by a magnetic core 38 and a coil 40 of a plurality of turns wound on the magnetic core 38, and that a member to which the antenna 32 is projected parallely along at least a plane that includes the axis of the magnetic core 38 or a part to which the member is projected, is made of the non-magnetic material.

It is preferable that in the present invention the antenna 32 is configured by a magnetic core 38 and coil 40 of a plurality of turns wound on the magnetic core 38, and that an end part of the antenna 32 or a member corresponding thereto, or a part corresponding to the member be made of the non-magnetic material.

In addition to each of the above-noted specific examples, it is also necessary to provide a countermeasure with respect to static electricity, and in the present invention it is also preferable that the at least one part of the metal exterior parts 31 be provided with an electrically conductive part.

As a static electricity processing mechanism in the present invention it is desirable that, for example, an appropriate electrically conductive part be provided on one part of the body member 45 or the caseback member 41, and that this be provided at a position that is a prescribed distance from the antenna 32, and further desirable that the electrical conduction method be, for example, welding, silver paste, a conductive ring, or a conductive resin or crimping and the like.

For example, in an electronic device or a radio controlled time piece, in the case in which a part of a pushbutton or a a stem is pushed or pulled, the configuration can be such that there be mutual contact between appropriate contact points so as to discharge static electricity or the configuration can be such that an appropriate conductive ring is inserted into the electronic device or radio controlled time piece.

Additionally, in a radio controlled time piece at least one location on the body member or a bezel part can be welded, and also for silver paste to be applied to at least one location between the body member and the bezel part.

Next, with regard to an electronic device 30 according to the present invention, it is possible to achieve another configuration for the purpose of making the electrical resistance value of at least one part of the joining part 39 be different from the electrical resistance value of another location, for example by making the planar surface area of at least one part of the joining part 39 formed by joining at least two metal members of the metal exterior parts 31 smaller than the planar surface area of the remainder of the joining part.

It is also possible to achieve this by making the material thickness of at least one part of the body member 45 and/or caseback member 41 to which the coil 40 of the antenna 32 is projected, is thinner than the material thickness of the other part of the body member 45 or caseback member 41.

The inventors, during an investigation for the achievement of practical use of the present invention, learned that the joining pressure of the joining part 39 formed between the plurality of metal members making up the metal exterior parts 31 that has a plurality of metal members in the electronic device 30 causes a change in the gain of the antenna 32.

Specifically, the inventors learned that, in the case in which the metal exterior parts 31 is configured by two or more metal members, a prescribed location, usually the peripheral part, of these plurality of metal members can be practically joined by one or a plurality of methods such as bringing them into mutual contact and welded to each other with a prescribed pressure applied, holding them in place with a prescribed tightening force using a plurality of threaded bolts, fitting them mutually together by a crimping method, threading both with separately formed male and female threads beforehand and then screwing them together to hold them together by a screw method using a prescribed tightening torque, or joining them by an internal screw method, packing fixing method, a dowel biting fixing method, a snap method, a welding method, a brazing method, a bayonet method, and a solid-state diffusion joining method or the like.

The inventors learned that a change in the contact pressure at the joining surfaces of the plurality of metal members in the metal exterior parts 31 changes gain of the antenna 32.

Figure 23:
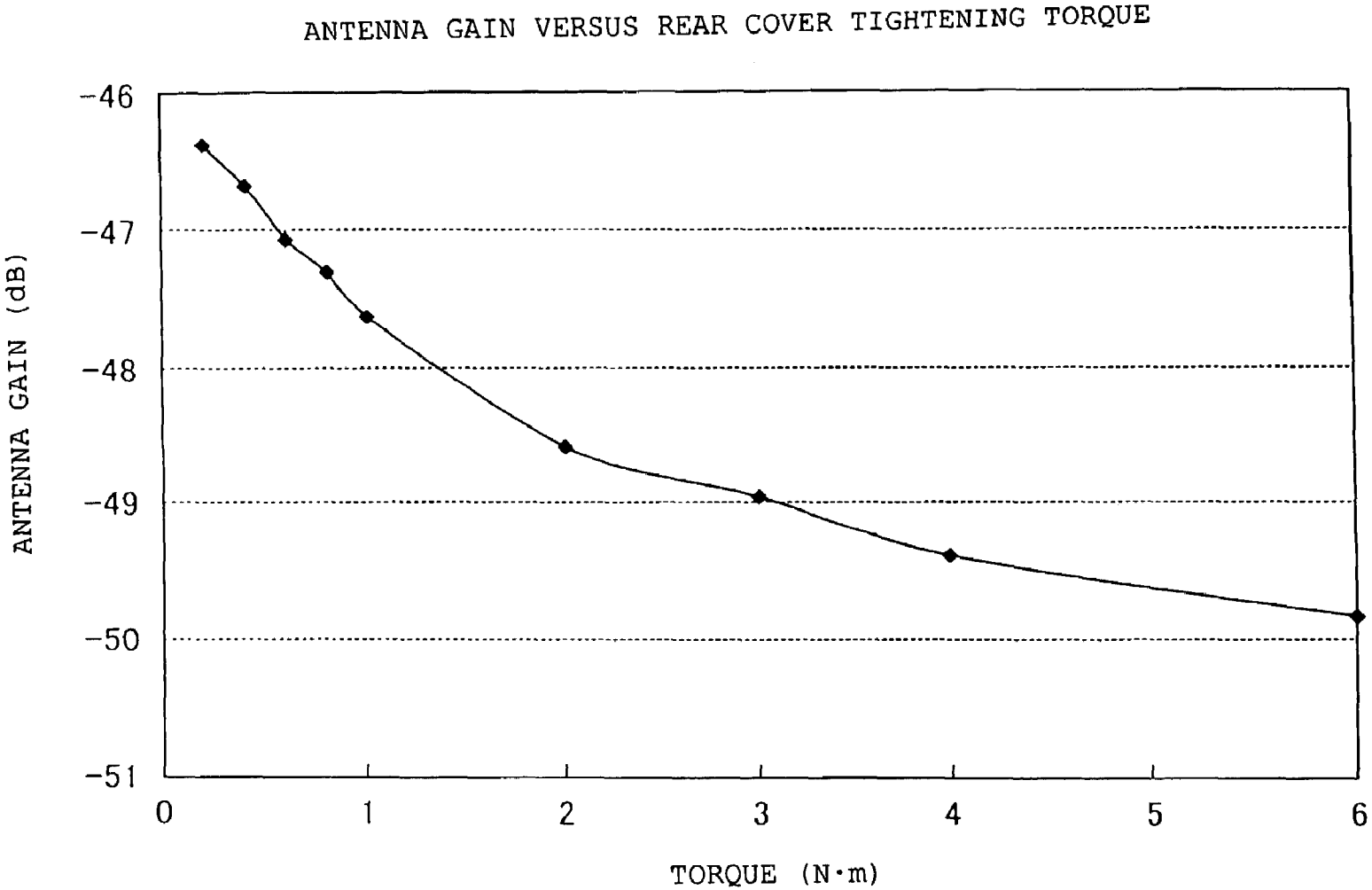
FIG. 23 is a graph showing the relationship between torque and the antenna gain.

That is, in a metal exterior parts 31 in which the body member 45 and the caseback member 41 in the electronic device are mutually connected, if the tightening torque of the caseback member 41 is changed, there is a change in the gain (dB) of the antenna 32, as shown in FIG. 23.

Specifically, it was learned that if the tightening torque is varied from 0 to 6 N·m, the stronger the tightening torque becomes, the more the gain of the antenna decreases, the maximum decrease being approximately 3 dB.

Furthermore, at a tightening torque exceeding 6 N·m, although it was not measured for lack of a practically usable measurement apparatus, as can be seen from FIG. 23, in the metal exterior parts 31 when the contact pressure between the body member 45 and the caseback member 41 is made strong, there is a decrease in the gain of the antenna.

Therefore, it can be envisioned that, in the metal exterior parts 31, rather than joining the body member 45 and the caseback member 41 using a screw method, the same type of effect as noted above can be achieved by using one or more of the above-noted welding method, holding method using a plurality of threaded bolts, crimping method, the previously described packing holding method, dowel biting holding method, snap method, welding method, brazing method, bayonet method, and solid-state diffusion joining method or the like.

For this reason, the inventors performed the following experiment for the purpose of investigating the reason for the occurrence of this phenomenon.

Figure 33:
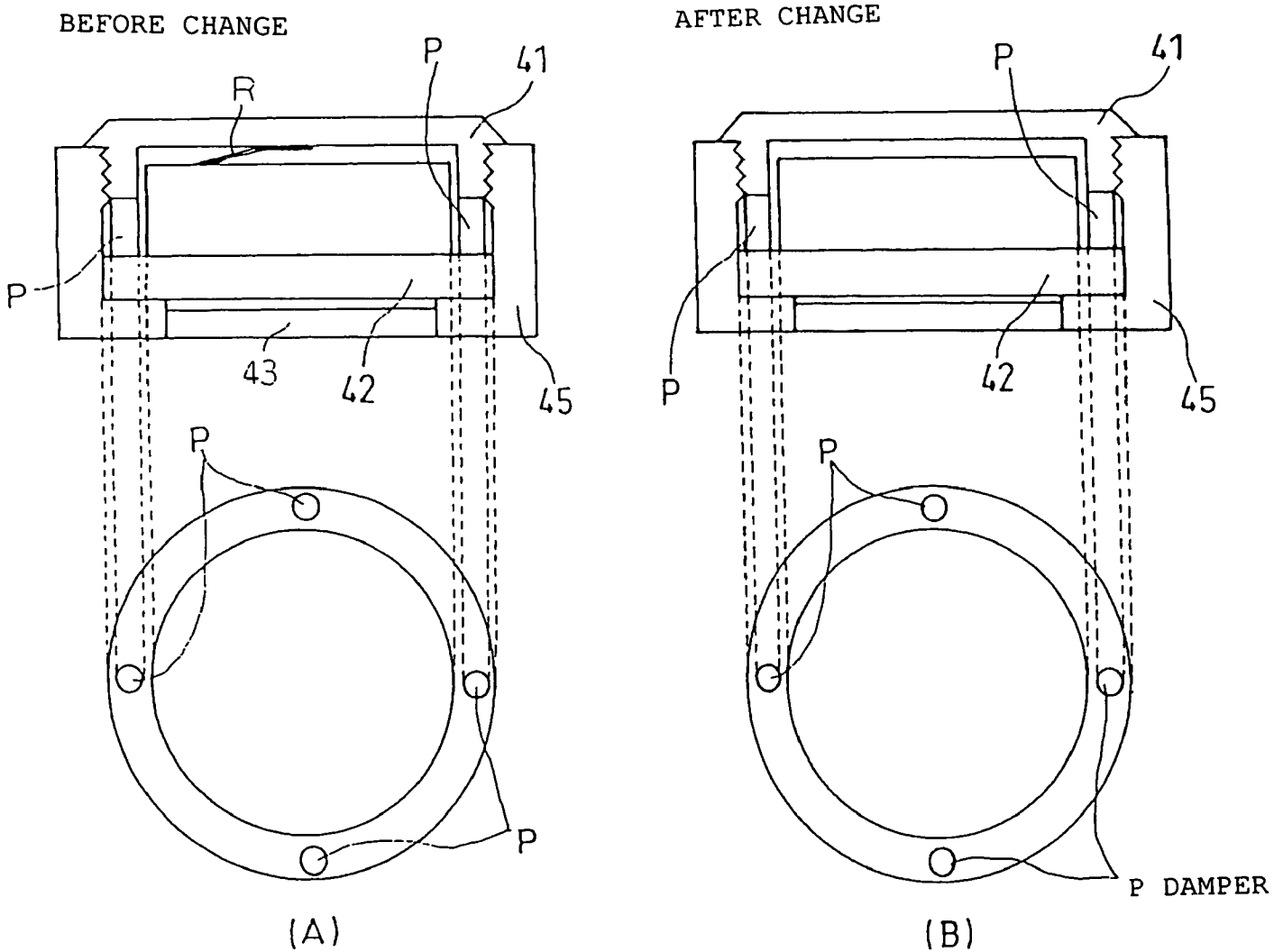
FIGS. 33 (A) and (B) are drawings describing an example of a configuration for the purpose of eliminating the influence of the Vdd contact point in the metal exterior parts.

First, as shown in FIGS. 33(A) and (B), a comparison was performed of the characteristics values of the antenna 32 for the case in which a Vdd contact point spring R is used within the electronic device 30, and for the case in which the contact with the caseback member 41 is interrupted by removing or bending the Vdd contact point spring R.

Figures 24, 25, 26:
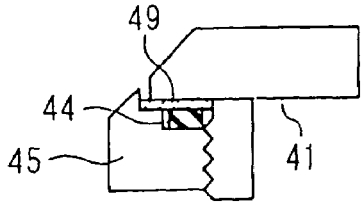
FIG. 24 is a drawing showing data indicating the change in the antenna characteristics values by the existence or non-existence of a contact point between the Vdd contact spring an the caseback member in an electronic device according to the present invention.
FIG. 25 is a drawing showing data indicating the change in the antenna characteristics values by the existence or non-existence of a contact point between the movement and the caseback member in an electronic device according to the present invention.

The results thereof are shown in FIG. 24.

In FIG. 24, the before change data is data measured in the condition in which the Vdd contact point spring R is used normally, and the after change data is data measured in the condition in which the contact between the Vdd contact point spring R and the caseback member 41 is interrupted.

If these two data are compared, looking at the characteristics values of the antenna 32, including the gain data, there is substantially no difference seen between the two.

However, even if the caseback member 41 is tightened, by eliminating the Vdd contact point spring R, it is possible to eliminate the influence of the Vdd contact point spring R cased by the tightening force.

Figure 34:
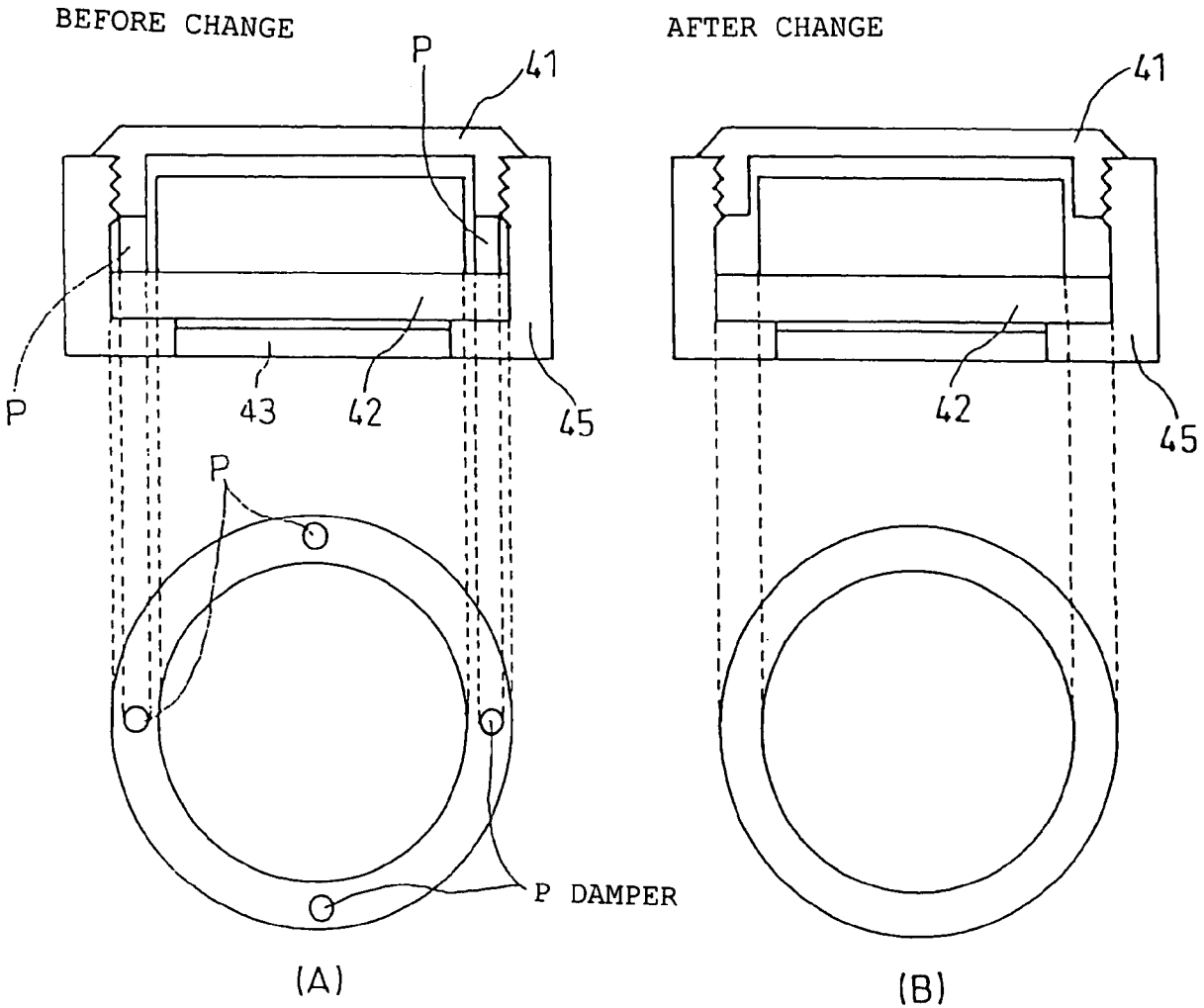
FIGS. 34 (A) and (B) are drawings describing an example of a configuration for eliminating the influence of the movement in the metal exterior parts.
Figure 35:
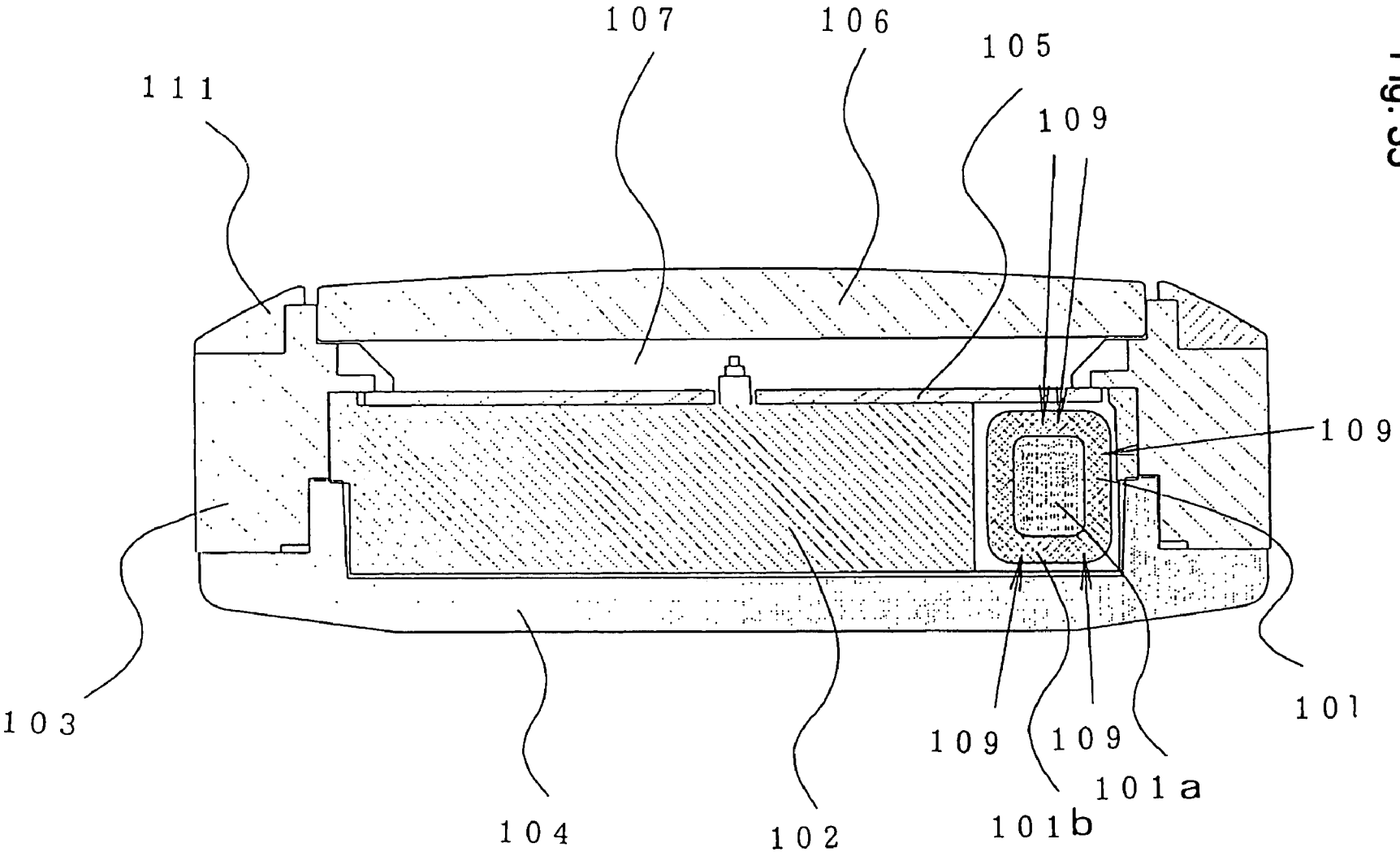
FIG. 35 is a cross-sectional view showing the general configuration of another specific example of a radio controlled time piece of the past.
Figure 36:
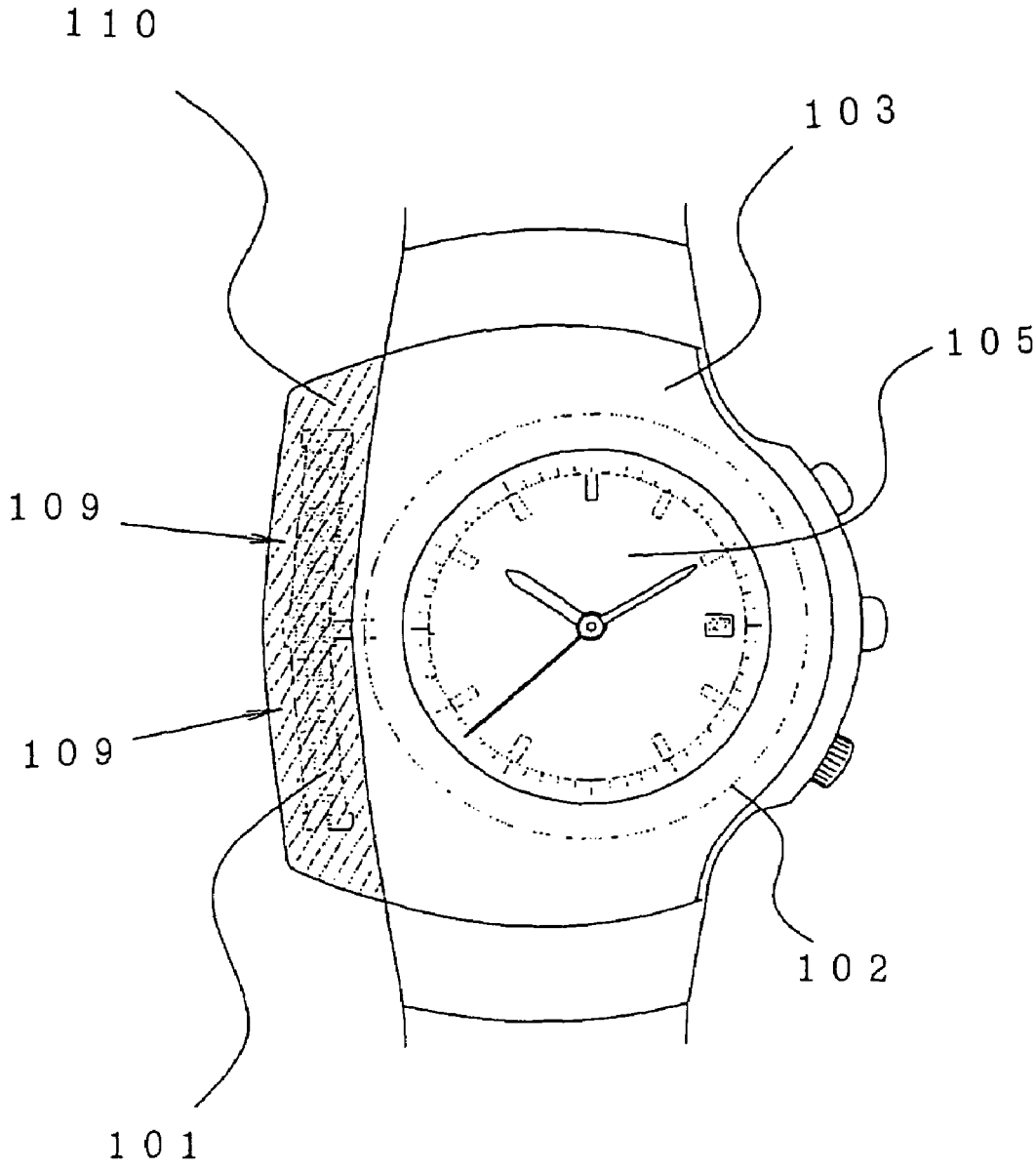
FIG. 36 is plan view showing the general configuration of yet another specific example of a radio controlled time piece of the past.

Then the inventors, as shown in FIGS. 34(A) and (B), performed a comparison of the characteristics values of the antenna 32 in the case in which the contact point between the movement 42 and the caseback member 41 is eliminated, and the influence on the deformation of the movement 42 by the tightening force to the caseback member 41 is eliminated.

In FIG. 25, the before change data is data measured with the contact point between the movement 42 and the caseback member 41 remaining via the damper P, as shown in FIG. 34(A), and the after change data is data measured with the contact point between the movement 42 and the caseback member 41 removed, as shown in FIG. 34(B).

If these two data are compared, looking at the characteristics values of the antenna 32, including the gain data, there is substantially no difference seen between the two.

However, even if the caseback member 41 is tightened, by eliminating damper P, it is possible to eliminate the influence of the movement 42 by the tightening force.

Additionally, the inventors, as shown in FIG. 26(A), inserted an appropriate insulator between the body member 45 and the caseback member 41 of the metal exterior parts 31, and investigated the influence when an extent of an amount in a pressing force caused by pressing the caseback member 41 to the movement 42, was lessened.

The results are shown in FIG. 26(B).

In FIG. 26(B), the before change data is data measured in the condition in which the insulator is not inserted, and the after change data is data measured in the condition with the insulator inserted.

If these two data are compared, because there is no increase in gain seen even when the tightening force on the movement 42 is reduced, it is difficult to think that the tightening of the caseback member 41 would cause the movement 42 to deform and lower the gain of the antenna 32.

Figure 8:
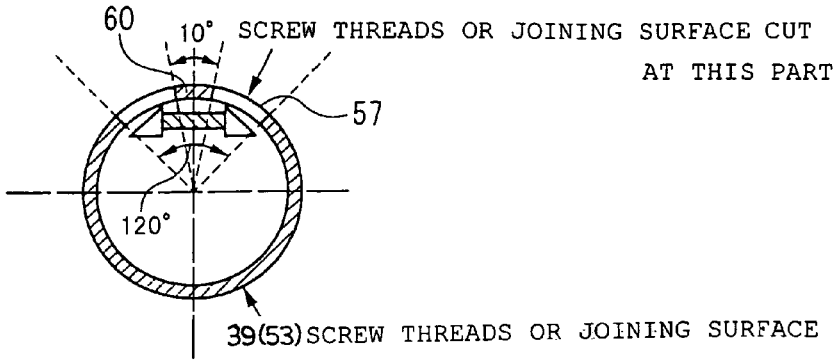
FIG. 8(A) is a plan view showing a specific example in the case in which part of the joining part in the fan-shaped region of the metal exterior parts is caused to remain in the present invention.
FIG. 8(B) is a drawing showing the experimental data to describe the effect of the structure of FIG. 8(A).

Given this, the inventors performed a re-investigation of the experimental results of FIG. 6 and FIG. 8.

The experiments of FIG. 6 and FIG. 8 were performed with a screw tightening torque of 3 N·m.

If part of the joining part is left within the fan-shaped region as shown in FIG. 8, the fact that it is understood that there is a slight decrease in the gain of the antenna 32 is as noted above.

The inventors performed yet another experiment.

Specifically, in the configuration of FIG. 6, a metal exterior parts 31 which was configured so that a fan-shaped region to which the gap 55 is provided, is set to have an central angle of 90°, is used, and the gain of the antenna 32 was measured when the tightening torque of the caseback member 41 was varied.

Figure 27:
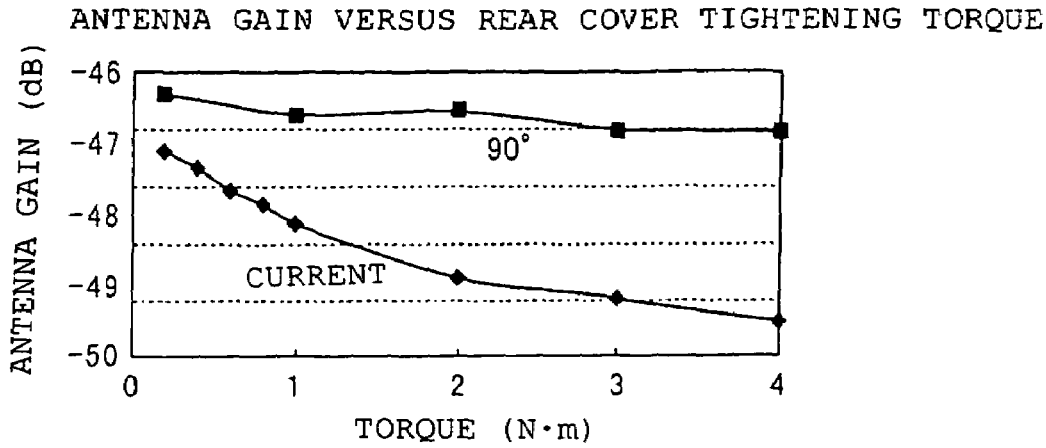
FIG. 27 is a graph showing the relationship between torque and the antenna gain.

The results are shown in FIG. 27.

In FIG. 27, the 90° graph is a graph showing the antenna gain obtained in this experiment, and the current graph is a graph showing gain of the antenna used in a metal exterior parts 31 in which there is no gap 55 formed.

What can be seen from these experimental results is that, in the case of the configuration of this experiment, the amount of attenuation of the antenna gain by the tightening torque of the caseback member 41 is greatly reduced in comparison to the structure of the past.

From these results, it can be presumed that, because the antenna gain increases by cutting the threaded part around the antenna, by making the tightening torque of the caseback member high magnetic coupling is caused by the threaded part surrounding the antenna, thereby causing the generation of eddy currents that hinder the resonance phenomenon in the antenna, thereby reducing the gain of the antenna.

In the present invention, therefore, because it is thought that it is not preferable to set the joining force between the body member 45 and the caseback member 41 of the metal exterior parts 31 excessively high, a proper tightening torque or joining force is required, depending upon the particular joining method.

However, even if the tightening torque of all samples which was used in the experiment was made constant, variations occurred in the loosening torque after waterproofness testing.

For example, in the case of a tightening torque of 2 N·m being set, after waterproofness testing, the maximum loosening torque was 1.6 N·m, the minimum loosening torque was 0.8 N·m; and the average loosening torque was 1.1 N·m (30 samples measured). In the case of a tightening torque of 3 N·m being set, after waterproofness testing the maximum loosening torque was 3.5 N·m, the minimum loosening torque was 1.7 N·m, and the average loosening torque was 2.5 N·m (30 samples measured).

Samples having a tightening torque of less than 0.1 N·m failed the waterproofness test regardless of the value of the tightening torque.

From the above, because it is difficult to measure a tightening torque greater than 6 N·m and also because it is not necessary to have a torque greater than 6 N·m, with respect to the antenna gain, it can be thought that it is acceptable that the loosening torque is 6 N·m or less.

From the above, the loosening torque can be 0.1 to 6 N·m, and preferably in practice can be 0.2 to N·m.

Furthermore, in the case of the packing holding method and the dowel biting holding method and the like, even if the force for removing the body member and the caseback member (hereinafter call the mutual peeling force) is $10^{-4}$ N·m, there is no problem with waterproofness testing.

However, because it is also difficult to measure a mutual peeling force of greater than 6.0 N·m, and because the peeling force being greater than 6.0 N·m, is not required with respect to the antenna gain, the mutual peeling force can be $10^{-4}$ N·m to 6.0 N·m.

Another embodiment of the present invention, therefore, is an electronic device having at least an antenna, an information processing apparatus for the purpose of processing information captured by the antenna, and a metal exterior parts capable of housing therewithin the antenna and the information processing apparatus, wherein the metal exterior parts is configured so that the antenna can receive magnetic flux from outside the metal exterior parts that has passed through the metal exterior parts and can resonate, and also wherein at the metal exterior parts comprises an body (side) member and a caseback member, and wherein the body (side) member and the caseback member are mutually joined, the mutual peeling force between the body (side) member and the caseback member being $10^{-4}$ N·m to 6.0 N·m.

Further embodiment of the present invention, therefore, is an electronic device comprising at least an antenna, an information processing apparatus for the purpose of processing information captured by the antenna, and a metal exterior parts capable of housing therewithin the antenna and the information processing apparatus, wherein the metal exterior parts is configured so that the antenna can receive magnetic flux from outside the metal exterior parts, that has passed through the metal exterior parts and can resonate, and also wherein at the metal exterior parts comprises an body (side) member and a caseback member, and wherein the body (side) member and the caseback member are mutually joined by a screw mechanism, the mutual loosening torque between the body (side) member and the caseback member being 0.1 N·m to 6.0 N·m, and preferably being 0.2 N·m to 3.5 N·m.

Next, to demonstrate whether or not, in the present invention, there is a difference in the effect of the present invention depending upon the difference in the joining part of the metal exterior parts 31 of the electronic device, the following experiment was performed.

Figure 28:
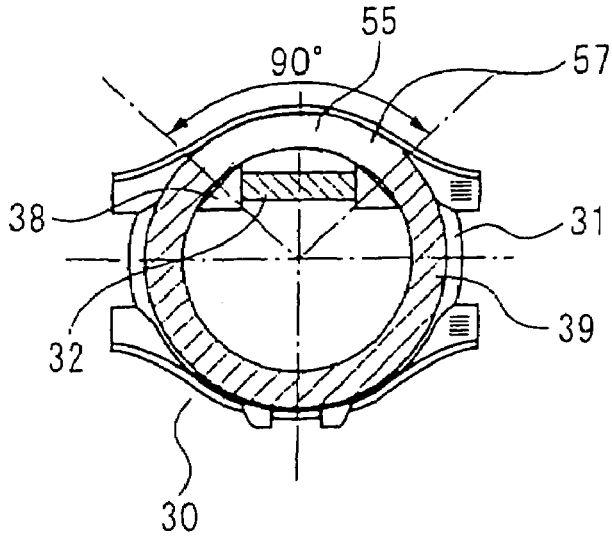
FIG. 28 is a plan view showing the positional relationship between the fan-shaped region and the antenna in an electronic device according to the present invention.

Specifically, samples A, B, C, and F were prepared by forming the body member 45 of the metal exterior parts 31 from an upper body part and a middle body part and closing the same with the caseback member after press fitting packing between the upper body part and the middle body part, joining the same with a tightening torque to the caseback member of 3 N·m, and samples D and E were prepared by forming by joining the upper body part and middle body part by laser welding and, after closing the same with the caseback member, joining with a tightening torque to the caseback member of 3 N·m. The same antenna 32 was disposed in the same position, as shown in FIG. 28, in each of the samples, and the antenna characteristics were measured.

The results are shown in FIG. 29.

As is clear from the comparison experiment results of FIG. 29, the antenna gain for the sample D made of Ti and the sample E made of stainless steel decreased.

The cause of this is presumed to be a strong magnetic coupling that is formed at the joining surface between the upper body part and the middle body part.

For this reason, of the laser welded joining part 39 formed at the joining surfaces between the upper body part and the middle body part shown in FIG. 28 in samples D and E, a part corresponding to a portion defined by the central angle of 90° in the fan-shaped region 57 was removed to form the gap 55 so as to impart an insulation function thereto, therefore, the same type of gain was obtained as in the other samples.

The results are shown in FIG. 30.

Although the above example is one in which the joining part between the upper body part and the middle body part is joined by welding, it is also possible to join the mutual joining part between the body member and the caseback member in the present invention using laser welding.

In this case, the mutual joining part between the body part and the caseback member, as indicated in the above-noted FIG. 4 (A), serve to form substantially the same shape as the annular joining part 39, and the entire surface of the annular joining part 39 can be laser-welded or, of an annular joining part 39 similar to the above, it is desirable that the part of the joining part 39 opposite the antenna is left intact, by not welding that part by the laser.

Next a specific example related to yet another embodiment of the present invention is described below.

Specifically, this embodiment is a radio controlled time piece having an antenna, a watch movement, a watch dial, an outer case, and a caseback, said outer case and caseback are formed from metal, and the antenna is surrounded by the outer case, the caseback and the watch dial, and is disposed inside the space formed by the outer case, the caseback and the watch dial, together with the watch movement inside said outer case, said caseback and said watch dial, and it is disposed so that said antenna overlaps with said watch dial in a planar manner, and wherein said watch dial is made of a non-magnetic material.

Additionally, in this embodiment there is a solar cell, which serves as the drive power for the movement, between the watch dial and the movement, this solar cell being substantially formed by a material that is non-magnetic and also magnetically permeable.

In this embodiment it is desirable that the solar cell be formed from amorphous silicon as the main material.

The configuration of a specific example of this radio controlled time piece according to the above-noted embodiment of the present invention is described below, with references made to FIG. 37 and FIG. 38.

Figure 37:
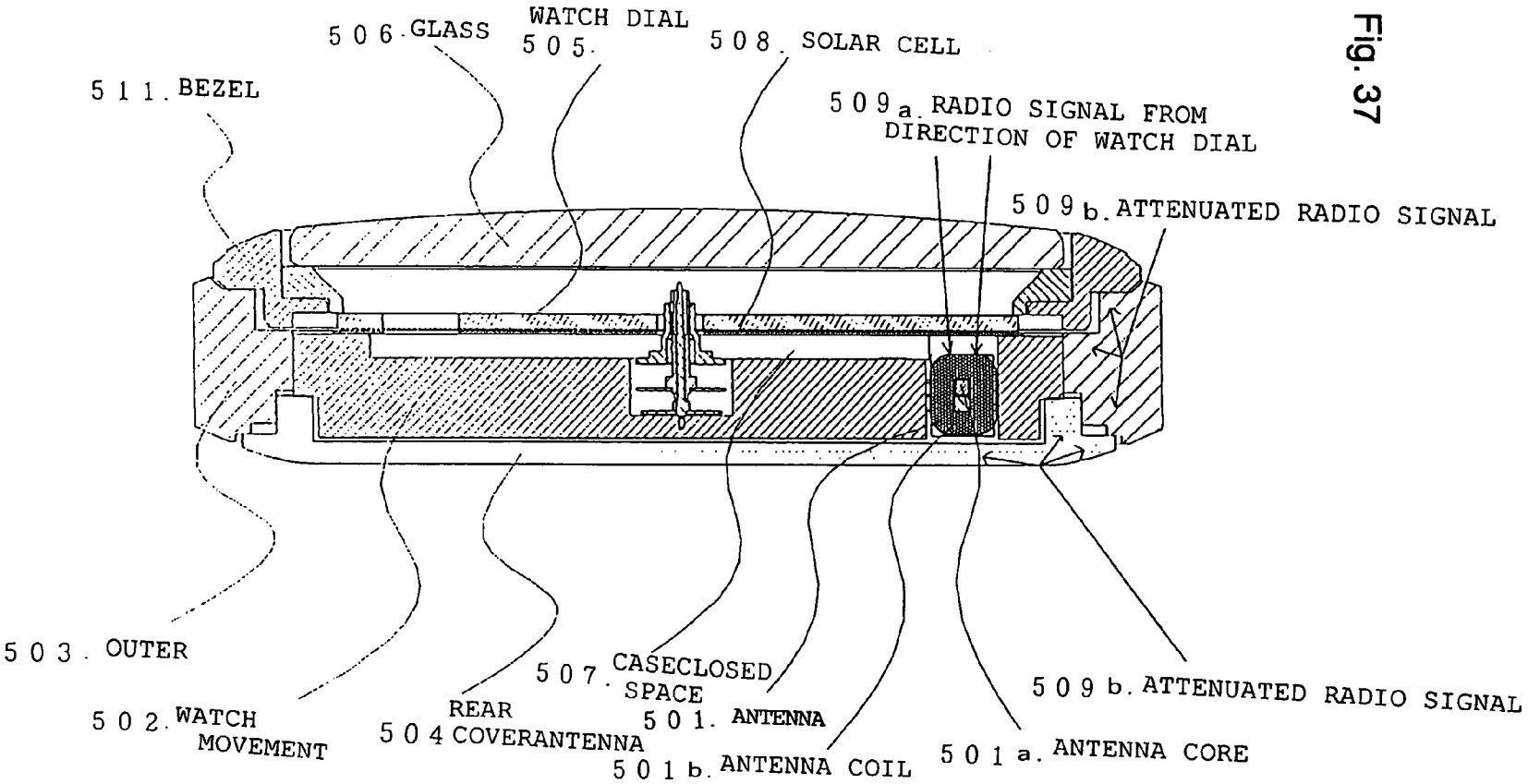
FIG. 37 is a cross-sectional view showing the general configuration in another specific example of a radio controlled time piece according to the present invention.
Figure 38:
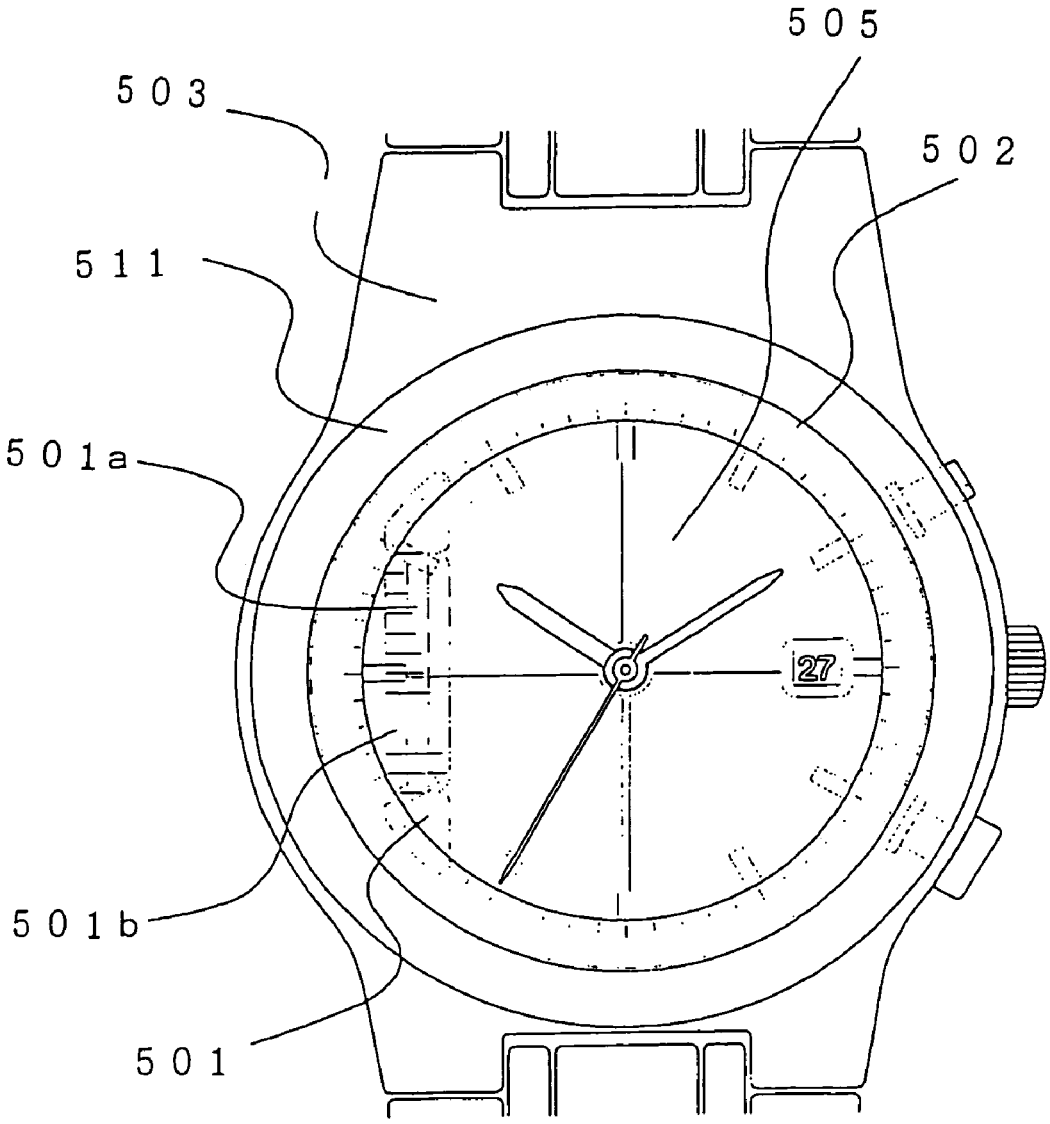
FIG. 38 is a plan view showing the general configuration of another specific example of a radio controlled time piece according to the present invention.

Specifically, FIG. 37 and FIG. 38 show as solar-cell driven analog radio controlled time piece that is one embodiment of the present invention as noted above, FIG. 37 being a cross-sectional view generally showing the main constituent parts and FIG. 38 being a general plan view from the watch dial side.

In FIG. 37 and FIG. 38, the outer case 503 and the caseback 504 are both formed from metal. By doing this, it is possible to achieve a radio controlled time piece as thin as a conventional watch.

In this case, the antenna 501 is housed within the inside of a cylindrically shaped closed space 507 formed by the outer case 503 made of metal, the caseback member 504 which is also metal, the watch dial 505 and the solar cell 508, which generates electricity by the light which passes through the watch dial 505, is disposed between the watch movement 502 and antenna 501 and the watch dial 505.

In this configuration, in the case in which the outer case 503 and the caseback 504 are formed from metal, when the watch dial 505 is also formed from metal, because the structure is one in which the antenna 501 is housed in a closed space that is complete shielded by metal members, the radio signal 509 that reaches the antenna 501 is attenuated by these metal members. As a result, there was the problem of not being able to achieve a receiving sensitivity sufficient for use as a finished watch.

Specifically, when a radio signal 509 strikes the antenna 501, because the antenna core 501*a* passes the radio signal, a magnetic field is generated in the area surrounding the antenna 501, and a current is generated in the antenna coil 501*b*. However, in the case in which a large metal member that easily passes a magnetic field is located in the region of the antenna 501, part of the magnetic field generated about the antenna 501 as its center is absorbed into the metal member, thereby resulting in hindrance to the resonance phenomenon in the antenna 501 and leading to the problem of not being able to achieve sufficient receiving sensitivity.

In response to the above, in this embodiment of the present invention, the watch dial 505, which forms one of the surfaces of the closed space 507 housing the antenna 501 therein, and the solar cell 508, which is sandwiched between the watch dial 505 and the watch movement 502, are formed of a non-magnetic material that passes a magnetic field easily. Specifically, the watch dial 505 is formed of a high polymer resin through which light can pass. Because the dial graduations that indicate the time and decorations occupy only a very small proportion of the overall watch dial 505, even if metal or plated, there is almost no affect on reception, although it is preferable that these be high polymer resin, the same as the base material.

The solar cell 508 is formed from a non-metal material, such as typified by amorphous silicon. An alternative that is often used is a film formed by depositing amorphous silicon onto a non-metallic sheet such as high polymer resin or the like. In this manner, because the material of the solar cell 508 is, similar to the watch dial 505, a non-metal that passes a magnetic field, there is no affect on a radio signal 509 the impinges from the direction of the watch dial 505 and passes through the non-metallic glass 506.

By doing this, as shown in FIG. 37, the closed space 507 that houses the antenna in a form of a completed watch in this embodiment is a cylindrical space, and because it is possible, by opening one surface thereof to form a magnetic space to reduce the amount of magnetic flux absorbed by metal members in the vicinity, it is possible to receive the radio signal 509 using the antenna 501.

Specifically, in this embodiment rather than the antenna being placed in a closed space that is completely magnetically shielded space, one portion thereof is opened. By doing this, although a radio signal 509*b* that is incident from the direction of the metal case 503 and caseback member 504 is attenuated, a radio signal 509*a* that is incident from the direction of the watch dial 505 passes through the glass 506, the watch dial 505 and solar cell 508 and can reach the antenna 501.

By adopting this configuration, the radio signal 509 can be received even when the outer case 503 and the caseback member 504 are made of metals.

As mentioned above, in a radio controlled time piece according to the present invention, for a radio-controlled watch in which the outer case and caseback are made of a metallic material, by opening one side thereof magnetically, it is possible to achieve a radio-controlled watch with the required sensitivity, even in the case of a metal exterior parts.

Specifically, in a radio-controlled watch using a metal outer case and a metal caseback, a non-metallic material that is magnetically permeable is used for the watch dial and for the solar cell that is laminated with the watch dial. By doing this, the structure achieved is one in which it is possible for a radio signal to reach an antenna that is housed in a closed space formed by the outer case and caseback and a watch dial, thereby enabling use of a metal exterior parts and caseback.

By doing this, it is possible to achieve thinness in the overall thickness of the finished time piece, which was difficult in the past, thereby enabling the achievement of wide range of products.

It is also possible to achieve a radio controlled time piece that makes maximum use of the property of a metal exterior parts of having the high mass-feeling with high quality.

By enabling the use of a metal exterior parts, the present invention is dramatically effective by enabling application to such watches as waterproof diver's watches.

In addition, by making use of the above-described constitution, the present invention solves the above-noted problems in the prior art, and enables the use of a simply antenna configuration to achieve good receiving efficiency without the need to greatly change the structure, metal exterior parts material, or the design and the like from that of past radio controlled time pieces, while not requiring a large thickness in the electronic device itself, thereby enhancing the degree of freedom in design and reducing the manufacturing cost of the electronic device.

What is claimed is:

1. An electronic watch comprising at least an antenna, an information processing apparatus for the purpose of processing information captured by said antenna, a watch movement including therein said information processing apparatus, a watch dial and a metal exterior parts capable of housing therewithin said antenna, and said watch movement, said metal exterior parts having an outer case and a caseback;

wherein said metal exterior parts is configured so that said antenna can receive magnetic flux from outside said metal exterior parts, and can resonate, said antenna being in the vicinity of said information processing apparatus and surrounded by said outer case and said caseback, wherein said antenna is disposed inside a space surrounded by said outer case, said caseback and said watch dial together with said watch movement, so that said antenna overlaps with said watch dial in a planar manner, said watch dial is made of a non-metallic material, and said metal exterior parts are set so that the thickness of a body member of said metal exterior parts is 300 μm to 5000 μm.

2. An electronic watch comprising at least a watch dial, an antenna, a watch movement for the purpose of processing information captured by said antenna and a metal exterior parts capable of housing therewithin said antenna, and said watch movement, wherein said metal exterior parts is configured so that said antenna can receive magnetic flux from outside said metal exterior parts and can resonate, said metal exterior parts having an outer case and a caseback, further wherein said antenna is disposed inside a space surrounded by said outer case, said caseback and said watch dial together with said watch movement, so that said antenna overlaps with said watch dial in a planar manner, and wherein said watch dial is made of a non-metallic material, further wherein said electronic watch includes a solar cell, which serves as the drive power of said watch movement, between said watch dial and said watch movement, said solar cell being substantially formed by a material that is non-metallic material and that is also magnetically permeable.

3. An electronic watch according to claim 2, wherein said solar cell is in the shape of a film using a non-metal sheet.

4. An electronic watch according to any one of claim 1 or 2, wherein said metal exterior parts and said antenna are set so that a gap between an inner surface of said caseback and said antenna is 0 to 5000 μm.

5. An electronic watch according to any one of claim 1 or 2, wherein said metal exterior parts and said antenna are set so that a gap between an inner surface of said caseback and said antenna is 100 μm to 700 μm.

6. An electronic watch comprising at least an antenna, an information processing apparatus for the purpose of processing information captured by said antenna, and a metal exterior parts capable of housing therewithin said antenna and said information processing apparatus, wherein said metal exterior parts is configured so that said antenna can receive magnetic flux from outside said metal exterior parts, and can resonate, at least a part of said metal exterior parts has an electrical resistance value that is different from another part of said metal exterior parts, and said metal exterior parts and said antenna are set so that a gap between an inner surface of said caseback and said antenna is 100 μm to 700 μm.

7. An electronic watch according to claim 6, wherein said metal exterior parts is configured so as to be able to suppress the generation of eddy currents in said metal exterior parts in a condition in which said antenna resonates.

8. An electronic watch according to claim 6, wherein said metal exterior parts is made of one or a plurality of materials selected from a group consisting of stainless steel, titanium, a titanium alloy, gold, a gold alloy, silver, a silver alloy, copper, a copper alloy, brass, aluminum, an aluminum alloy, zinc, a zinc alloy, magnesium, a magnesium alloy, and an ultra-hard metal (an alloy including tungsten carbide and tantalum carbide).

9. An electronic watch according to claim 6, wherein said metal exterior parts is formed by a least two metal members.

10. An electronic watch according to claim 9, wherein said metal exterior parts comprises an outer case and a caseback member, wherein said outer case and said caseback member are mutually joined together.

11. An electronic watch according to claim 10, wherein said outer case and said caseback member are either mutually held together or mutually removably joined together.

12. An electronic watch according to claim 10, wherein said outer case and said caseback member are mutually joined by one or a plurality of methods selected from a group consisting of a screw method, an internal threading method, a holding method using a plurality of threaded bolts, a crimping method, a packing holding method, a dowel biting holding method, a snap method, a welding method, a brazing method, a bayonet method, and a solid-state diffusion joining method.

13. An electronic watch according to claim 10, wherein in said metal exterior parts said outer case and said caseback member are integrally configured as one, and wherein said outer case is configured so that a plurality of body sub-members are mutually joined.

14. An electronic watch according to claim 13, wherein in said metal exterior parts said outer case and said caseback member are integrally configured as one and wherein said metal exterior parts is formed by an inner body member and an outer body member, said inner body member and said outer body member being mutually joined together.

15. An electronic watch according to claim 10, wherein in said metal exterior parts said outer case and said caseback member are integrally configured as one, and wherein one part of said outer case comprises at least one inserted member selected from a group consisting of a pipe, a glass, a bezel, an internal register ring, and an dial open.

16. An electronic watch according to claim 1, 3, 5 or 9, wherein of a plurality of members forming said metal exterior parts, an electrical resistance value of a metal forming one member thereof is different from an electrical resistance value of a metal forming another part.

17. An electronic watch according to claim 16, wherein an electrical resistance value of a mutually joining part of a plurality of members forming said metal exterior parts is different from an electrical resistance value of a metal forming said metal exterior parts.

18. An electronic watch according to claim 17, wherein at least one part of a plurality of mutually joining parts formed between said outer case and said caseback each forming said metal exterior parts, has an inserted member interposed therebetween, said inserted member having an electrical resistance value differing from an electrical resistance value of a metal forming said metal exterior parts.

19. An electronic watch according to claim 18, wherein said inserted member is a member formed separately from a plurality of members forming said metal exterior parts.

20. An electronic watch according to claim 18, wherein said inserted member is at least one member of a plurality of members forming said metal exterior parts and is a film formed on a member making contact with said metal exterior parts.

21. An electronic watch according to claim 20, wherein said film is formed by an appropriate surface treatment and/or hardening treatment of a least one part forming said metal exterior parts.

22. An electronic watch according to claim 21, wherein said surface treatment is one method selected from a group consisting of a wet plating method, a dry plating method, and heat treatment.

23. An electronic watch according to claim 18, wherein an electrical resistance value of said inserted member is larger than an electrical resistance value of a plurality of members forming said metal exterior parts.

24. An electronic watch according to claim 18, wherein said inserted member is made of one material selected from a group consisting of resin, rubber (organic), an oxide insulated material, a thin film, ink, and a paint.

25. An electronic watch according to claim 17, wherein a non-contacting part is formed on at least one part of said joining part formed by the joining of at least two metal members in said metal exterior parts.

26. An electronic watch according to claim 25, wherein one part of a joining surface in at least one metal member of at least two metal members forming said joining part is removed to form a gap between said joining parts.

27. An electronic watch according to claim 26, wherein a height of said gap is 0.1 to 1000 μm and preferably 60 to 160 μm.

28. An electronic watch according to claim 27, wherein the planar surface area of at least one part of a joining surface formed by a joining of at least two metal members in said metal exterior parts is formed so as to be smaller than the planar surface area of the remaining part.

29. An electronic watch according to either claim 25 or claim 26, wherein said metal exterior parts comprises said outer case and said caseback which are integrally formed as one, and further wherein in a case in which said outer case and said caseback are mutually joined by a screw mechanism, one part of said screw mechanism is removed to form said gap.

30. An electronic watch according to any one of claims 18, 25 or 26, wherein said antenna is disposed in the vicinity of said inserted member said non-contacting part or said gap.

31. An electronic watch according to claim 30, wherein said inserted member, said non-contacting part or said gap of said metal exterior parts is formed either continuously or intermittently in said joining part surrounded by a fan-shaped region formed by both end parts of said magnetic core of said antenna having a prescribed length and the center part of said metal exterior parts.

32. An electronic watch according to claim 31, wherein said fan-shaped region is a region expressed as a ratio between the core length of said antenna and the angle of said joining part.

33. An electronic watch according to claim 31, wherein an angle range of said fan-shaped region is 30 to 180°, preferably is 50 to 120°, and more preferably is 60 to 90°.

34. An electronic watch comprising at least a watch dial, an antenna, a watch movement for the purpose of processing information captured by said antenna, and a metal exterior parts capable of housing therewithin said antenna and said watch movement, wherein said metal exterior parts is configured so that said antenna can receive magnetic flux from outside said metal exterior parts and can resonate, said metal exterior parts having an outer case and a caseback, said antenna being in the vicinity of said watch movement, wherein said outer case and caseback are formed from metal, and said antenna is disposed inside a space surrounded by said outer case, said caseback and said watch dial together with said watch movement, so that said antenna overlaps with said watch dial in a planar manner, said watch dial is made of a non-metallic material, said outer case and said caseback member are mutually joined together, the mutual peeling force between said outer case and said caseback member being 104 N·m to 6.0 N·m, and said metal exterior parts and said antenna are set so that a gap between an inner surface of said caseback and said antenna is 100 μm to 700 μm.

35. An electronic watch comprising at least a watch dial, an antenna, a watch movement for the purpose of processing information captured by said antenna, and a metal exterior parts capable of housing therewithin said antenna, and said watch movement, wherein said metal exterior parts is configured so that said antenna can receive magnetic flux from outside said metal exterior parts and can resonate, said metal exterior parts having an outer case and a caseback, said antenna being in the vicinity of said watch movement, wherein said outer case and said caseback are formed from metal, and said antenna is disposed inside a space surrounded by said outer case, said caseback and said watch dial together with said watch movement, so that said antenna overlaps with said watch dial in a planar manner, said watch dial is made of a non-metallic material, said outer case and said caseback member are mutually joined by a screw mechanism, the mutual loosening torque between said outer case and said caseback member being 0.1 N·m to 6.0 N·m, and preferably being 0.2 N·m to 3.5 N·m, and said metal exterior parts and said antenna are set so that a gap between an inner surface of said caseback and said antenna is 100 μm to 700 μm.

36. An electronic watch according to claim 35, wherein the material thickness of at least one part of said body member and/or said caseback member to which a coil of said antenna is projected, is thinner than the material thickness of the other part of said body member or said caseback member.

37. An electronic watch according to any one of claims 1, 2, 6, 34 or 35, wherein said antenna is configured so that said antenna is provided with a straight or curved magnetic core having a maximum longitudinal length that is shorter than the maximum diameter of the metal exterior parts.

38. An electronic watch according to claim 37, wherein said antenna is disposed in the vicinity of the outer periphery of said metal exterior parts.

39. An electronic watch comprising at least an antenna, an information processing apparatus for the purpose of processing information captured by said antenna, and a metal exterior parts capable of housing therewithin said antenna and said information processing apparatus, wherein said metal exterior parts is configured so that said antenna can receive magnetic flux from outside said metal exterior parts, and can resonate, and also wherein said antenna is configured so that said antenna is provided with a straight or curved magnetic core having a maximum longitudinal length that is shorter than the maximum diameter of the metal exterior parts, and said metal exterior parts and said antenna are set so that a gap between an inner surface of said caseback and said antenna is 100 μm to 700 μm.

40. An electronic watch according to claim 39, wherein said antenna is disposed in the vicinity of a peripheral end part of said metal exterior parts.

41. An electronic watch according to claim 1, 2, 6, 34, 35 or 39, comprising an electrically conductive part in at least one part of said metal exterior parts.

42. An electronic watch according to claim 1, 2, 6, 34, 35 or 39, wherein an L value of said antenna is 1600 mH or less.

43. An electronic watch according to claim 42, wherein said L value is 800 mH or less.

44. An electronic watch according to claim 42, wherein said L value is 220 mH or less.

45. An electronic watch according to claim 1, 2, 6, 34, 35 or 39, wherein a coil resistance value of said antenna is 1 kΩ or less.

46. An electronic watch according to claim 45, wherein said coil resistance value is 400 Ω or less.

47. An electronic watch according to claim 45, wherein said coil resistance is 100 Ω or less.

48. An electronic watch according to claim 1, 2, 6, 34, 35 or 39, wherein a number of coil turns of said antenna is 1000 or greater.

49. An electronic watch according to claim 48, wherein said number of coil turns is 1500 or greater.

50. An electronic watch according to claim 1, 2, 6, 34, 35 of 39, wherein said coil wire has a wire diameter of 0.1 mm or less.

51. An electronic watch according to claim 1, 2, 6, 34, 35 or 39, wherein said antenna is disposed so as to come into contact with an inner surface of said metal exterior parts.

52. An electronic watch according to any one of claims 1, 2, 6, 34, 35 or 39, wherein said antenna is disposed with a gap between it and an inner surface of said metal exterior parts.

53. An electronic watch according to any one of claims 2, 6, 34, 35 or 39, wherein said metal exterior parts are set so that the thickness of a body member of said metal exterior parts is 300 μm to 5000 μm.

54. An electronic watch according to any one of claims 1, 2, 6, 34, 35 or 39, wherein said metal exterior parts are set so that the thickness of a body member of said metal exterior parts is 500 μm to 2000 μm.

55. An electronic watch according to any one of claims 1, 2, 6, 34, 35 or 39, wherein said metal exterior parts and said antenna are set so that a gap between said inner surface of said body member and said antenna is 0 to 40000 μm.

56. An electronic watch according to any one of claims 1, 2, 6, 34, 35 or 39, wherein said metal exterior parts and said antenna are set so that a gap between said inner surface of said body member and said antenna is 500 μm to 10000 μm.

57. An electronic watch according to any one of claims 1, 2, 6, 34, 35 or 39, wherein said metal exterior parts are set so that the thickness of a caseback member of said metal exterior parts is 100 μm to 5000 μm.

58. An electronic watch according to any one of claims 12, 6, 34, 35 or 39, wherein said metal exterior parts are set so that the thickness of a caseback member of said metal exterior parts is 300 μm to 2000 μm.

59. An electronic watch according to any one of claims 1, 2, 6, 34, 35, or 39, wherein an inner surface of a body member of said metal exterior parts and an outer surface of said antenna are substantially parallel.

60. An electronic watch according to any one of claims 1, 2, 6, 34, 35 or 39, wherein an inner surface of a caseback member of said metal exterior parts and an outer surface of said antenna are substantially parallel.

61. An electronic watch according to any one of claims 1, 2, 6, 34, 35 or 39, wherein a caseback member of said metal exterior parts is formed with a planar secondary shape.

62. An electronic watch according to any one of claims 1, 2, 6, 34, 35 or 39, wherein one end surface of two end parts of said antenna is substantially perpendicular to an inner surface of a caseback member of said metal exterior parts.

63. An electronic watch according to any one of claims 1, 2, 6, 34, 35 or 39, comprising a non-magnetic material having an electrical resistivity of 7.0 μΩ· cm or less is fixed to an inner surface of said metal exterior parts.

64. An electronic watch according to any one of claims 1, 2, 34, 35 or 63, wherein said non-magnetic material is one material selected from a group consisting of gold, a gold alloy, silver, a silver alloy, copper, a copper alloy, brass, aluminum, an aluminum alloy, zinc, a zinc alloy, magnesium, and a magnesium alloy.

65. An electronic watch according to any one of claims 1, 2, 6, 34, 35 or 39, wherein said antenna comprises a magnetic core and a coil multiply wound around said magnetic core, and wherein a member to which said antenna is projected parallel along at least one plane that includes the axis of said magnetic core or a part to which said member is projected, is made of a non-magnetic material.

66. An electronic watch according to any one of claims 1, 2, 6, 34, 35 or 39, wherein said antenna comprising a magnetic core and coils multiply wound around said magnetic core is configured so that at least an end part of said antenna or a member corresponding thereto, or a part corresponding to the member be made of said non-magnetic material.

67. An electronic watch according to any one of claims 1, 2, 6, 34, 35 or 39, wherein at least one of said outer case and caseback member is subjected to surface treatment and/or curing.

* * * * *